US006282932B1

(12) United States Patent
Surina et al.

(10) Patent No.: US 6,282,932 B1
(45) Date of Patent: Sep. 4, 2001

(54) AXIAL AND TRANSVERSE ROLLER DIE ADJUSTMENT APPARATUS AND METHOD

(75) Inventors: Michael Surina, Waterdown; Ernest Robert Bodnar, Toronto, both of (CA)

(73) Assignee: Formtek, Inc., Westfield, MA (US)

( * ) Notice: Subject to any disclaimer, the term of this patent is extended or adjusted under 35 U.S.C. 154(b) by 0 days.

(21) Appl. No.: 09/394,309

(22) Filed: Sep. 10, 1999

Related U.S. Application Data

(63) Continuation-in-part of application No. 08/983,089, filed on Jan. 12, 1998, now Pat. No. 5,970,764.

(51) Int. Cl.[7] ..... B21D 5/08

(52) U.S. Cl. ..... 72/7.6; 72/181; 72/247; 72/248

(58) Field of Search ..... 72/181, 164, 247, 72/248, 7.6, 9.2, 240

(56) References Cited

U.S. PATENT DOCUMENTS

| | | | | |
|---|---|---|---|---|
| 3,348,403 | * | 10/1967 | Bartley | 72/248 |
| 3,595,056 | * | 7/1971 | Hutton | 72/181 |
| 4,109,499 | | 8/1978 | Brooks et al. . | |
| 4,787,232 | | 11/1988 | Hayes . | |
| 5,319,952 | * | 6/1994 | Cadney | 72/181 |
| 5,829,294 | * | 11/1998 | Bradbury | 72/181 |

FOREIGN PATENT DOCUMENTS

| | | |
|---|---|---|
| 1092864 | 2/1979 | (CA) . |
| 0247886 | 12/1987 | (EP) . |
| 2436634 | 4/1980 | (FR) . |

* cited by examiner

*Primary Examiner*—Daniel C. Crane
(74) *Attorney, Agent, or Firm*—McCormick, Paulding & Huber LLP

(57) ABSTRACT

A roller die apparatus for supporting pairs of roller dies in predetermined clearances for processing a web workpiece, and for varying the clearances between the dies to accommodate variations in the thickness of a web workpiece and having first and second roller dies rotatably mounted on respective roller die bearings, one of the first and second roller dies being moveable both upwardly and downwardly transversely to its axis of rotation, and being moveable axially along its axis of rotation, thereby achieving adjusting of the die clearance between the first and second roller dies in two planes. The two adjustments take place simultaneously so as to cause an adjustment movement in a diagonal direction, as between one die and the other in each pair.

27 Claims, 45 Drawing Sheets

AXIAL AND TRANSVERSE ROLLER DIE ADJUSTMENT APPARATUS AND METHOD

CROSS REFERENCE TO RELATED APPLICATIONS

This application is a continuation-in-part of U.S. application, Ser. No. 08/983,089, filed Jan. 12, 1998, now U.S. Pat. No. 5,970,764.

TECHNICAL FIELD

The invention relates to roll forming machinery, forming, a continuous strip of sheet material, and in particular, to such roll forming machinery in which the spacing between the rolls can be adjusted in response to variations in the thickness of the web, by a single adjuster, in response to variations in the thickness of the web. Adjustment is also provided for webs of varying width, and for correcting warping of the workpiece.

BACKGROUND ART

Roll forming machinery usually has a plurality of sets of rolls, usually arranged in upper and lower pairs, and usually spaced apart along the length of the machine on roller stands. Typically, the roller dies at one stand will produce a continuous formation in the web, and the roller dies of the next stand will produce another formation, or for example increase the angle of the formation which has already been started at the previous stand and so on.

A wide variety of commercial and other products are made on such roll forming machines, such as roof decking siding, and a large number of components for consumer equipment. The shapes may simply be webs with edge formations formed along one edge or both, or may be C sections or U sections but in many cases consist of relatively complex formations with longitudinal formations being formed along the length of the web, side by side.

Generally speaking at each stand of rolls there are two lower dies and two upper dies arranged in pairs, to form the web on either side of a central web axis. The lower dies engage the underside of the web and the upper dies engage the upper side of the web. The dies have circular shapes, and are mounted on rotatable axles so that the dies can rotate at the same speed as the sheet metal.

A gear drive mechanism is coupled to the dies so as to drive them at the speed of the sheet metal.

Each set of such roller dies must be designed to provide a particular formation in the web. In addition, each pair of dies must have a clearance between them determined by the thickness of the web.

Thus where it is desired to discontinue working on a web of one thickness, and to then run a web of another thickness through the dies, each pair of roller dies must be readjusted to a new clearance, to accommodate the new thickness of the new web. This involves costly down time, in order to make the fine adjustments.

All of this is very well known in the art and is accepted as the normal operating procedure.

It is however well known that a further problem exists in roll forming. The web of sheet material which provides the basic feed stock for the roller machine should preferably maintain its thickness within very narrow limits, along the entire length of the web. If there is any significant variation in thickness in the web, then the dies, being fixed as to clearance, will produce varying effects on the web as the web passes along the roller stands, or the web may jam causing stoppage of the line.

In practice, it is well known that some web material varies in thickness to a greater extent than is permissible. This results in unusual effects being produced in the final formed web, which may warp or bend or twist, or even jam.

Generally speaking, it is not possible to adjust the clearances of the roller dies, during the actual operation of the machine, and the best that can be done is that in the initial set up, the machinist will set the die clearances to a predetermined average web thickness. The results obtained in this way however are not always entirely satisfactory.

It would in theory be desirable to provide for automatic self-adjustment of the spacings or clearances between the pairs of dies in each stand. However, due to the shaping of the dies there are difficulties in such adjustments. Usually the dies will have two surfaces, one of the surfaces being more or less horizontal, or at least parallel to the plane of the web itself, and the other of the surfaces being at a web forming angle.

Another set of problems a rises if it is desired to use the same roller dies, to form a web having a width which is greater, or narrower than a preceding web.

In the past each of the stands would have to be manually moved further apart, or closer together, to take in to account the width of the new web to be processed. However, it was time consuming to dismantle the arrangement of dies for one web width, and then reassemble the dies with a greater or lesser number of rolls between them to suit the new web width. In addition, this was awkward and time consuming manual work.

It is therefore desirable to provide for roller die stands arranged in pairs, in which one of each of the stands in each of the pairs shall be transversely moveable relative to the other.

Given both die clearance adjustment, and stand width adjustment, it would be possible, using one set of roller die stands and dies, to provide for the processing of webs both of different thicknesses, and also of different widths. This enables a manufacturer to produce a standard rolled form section such as a "C"0 section in a variety of widths and in a variety of gauges, from a single machine. This would reduce the capital investment in machinery. In addition would reduce the down time required for change over from one web to another and also reduce the need for skilled labour.

Additional savings would be achieved if the spacer rolls could be introduced between the pairs of dies by some form of powered mechanism.

A further problem arises with roll forming certain sections, particularly sections which have the shape of a letter C with in turned flanges, or a partially closed-in box section.

In this type of section, the two edges or flanges of the C, or partially closed-in box, are turned inwardly. This is usually done by roll forming the edge flanges first, and then roll forming the C bends later, i.e. downstream. Special dies are required to form the last bends, and it is desirable to provide for adjustment of these dies. Adjustment of such dies in this location however, to accommodate variations in web thickness and to form different sizes of C-section presents further problems.

DISCLOSURE OF THE INVENTION

One aspect of the invention provides for transverse width adjustment of the die stands, and means for inserting or removing spacer rolls between the dies.

This form of the invention includes a movable support table movable upwardly and downwardly between the die stands, with the spacer rolls stored on the table.

One embodiment of the invention provides for transverse width adjustment of the die stands, and means for inserting or removing a web support mechanism between the adjacent die stands.

This form of the invention includes a movable web support movable upwardly and downwardly between the die stands, with the support being provided with a plurality of smaller free running rolls which can be introduced between each pair of adjacent die stands, thus supporting the web where it extends from one set of dies to the next, instead of being supported by spacer rolls located directly between the pairs of lower dies, as was done in the past.

Another aspect of the invention provides a roller die apparatus for supporting pairs of roller dies in predetermined clearances, and having means for moving one of said roller dies upwardly and downwardly transversely to its axis of rotation, and means for moving one of said roller dies axially along its axis of rotation, thereby achieving adjusting of the die clearance in two planes.

Preferably one of the dies is fixed, and the other of said dies incorporates both axial adjustment movement and also transverse adjustment movement, so as to keep all of the adjustment movement in a common location where it is readily accessible for servicing and adjustment.

Preferably one of the dies is fixed, and the other of the dies incorporates adjustment means for adjusting one die relative to the other in two planes simultaneously thereby producing a diagonal adjustment movement.

Preferably the adjustment means is a single adjustment control which produces both movements at once, so as to keep all of the adjustment movement in a common location where it is readily accessible for servicing and adjustment.

The invention provides a single control movement transmission coupling all of the moveable dies together for diagonal movement in unison, and power operated means for operating the movement transmission.

The invention provides a thickness sensor for sensing the thickness of said web material workpiece, and generating a thickness signal and signal responsive means for generating movement signals for moving said movement transmission means, whereby to procure simultaneous movement of said moveable dies.

The invention also provides for an edge forming roller die assembly for rolling the edge formations and means for moving said at least some of said roller dies relative to one another, to vary the clearance between them.

A further aspect of the invention provides for a straightening assembly, comprising straightening rolls adapted to engage the workpiece after exiting from the roller dies to prevent warping.

A further aspect of the invention provides for positive rotary driven pinch rolls and side guide rolls engaging the web upstream where it enters the machine and keeping the web axis truly centered with respect to the forming dies.

The invention also relates to a method of roll forming a web workpiece.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

MODES OF CARRYING OUT THE INVENTION

Figure 1:
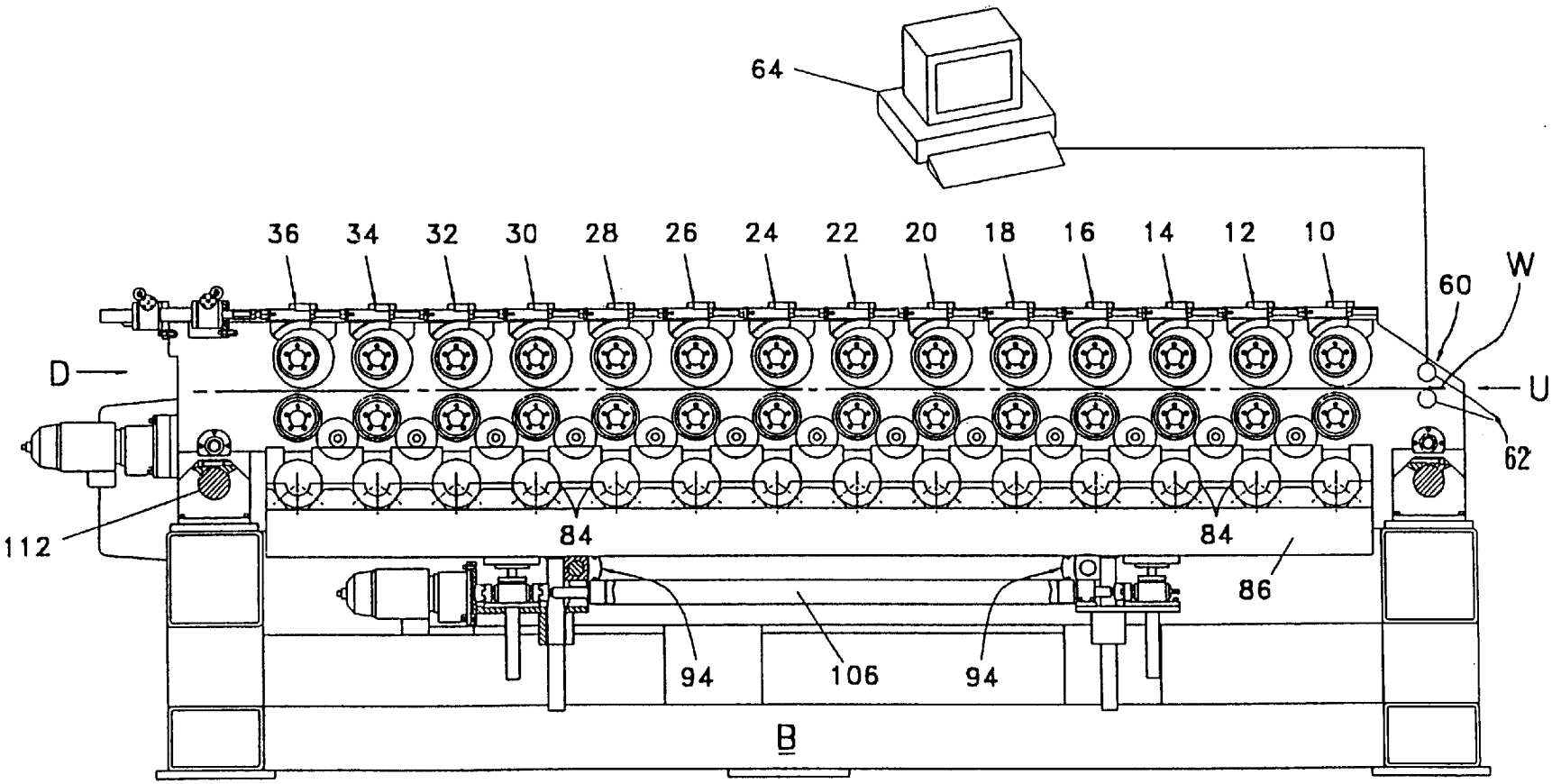
FIG. 1 is a side elevation of a roller die apparatus for working a web of sheet material partially cut away, and illustrating a plurality of roller die stands at spaced apart intervals along the path of the sheet material and controls shown schematically.

Referring first of all to FIG. 1, it will be seen that this illustrates what appears to be at first sight a conventional roll forming apparatus, of type used in conjunction with web sheet metal processing lines. Additional equipment may comprise an uncoiler, a flattener, a cut off die of shear, and a stacker or conveyor, all of which components are essentially well known in the art.

The roll forming apparatus comprises a base indicated generally as B, defining an upstream end U, and a downstream end D, and the web sheet metal passes from right to left, from the end U, to the other end D, continuously, while being progressively roll formed.

Figure 2:
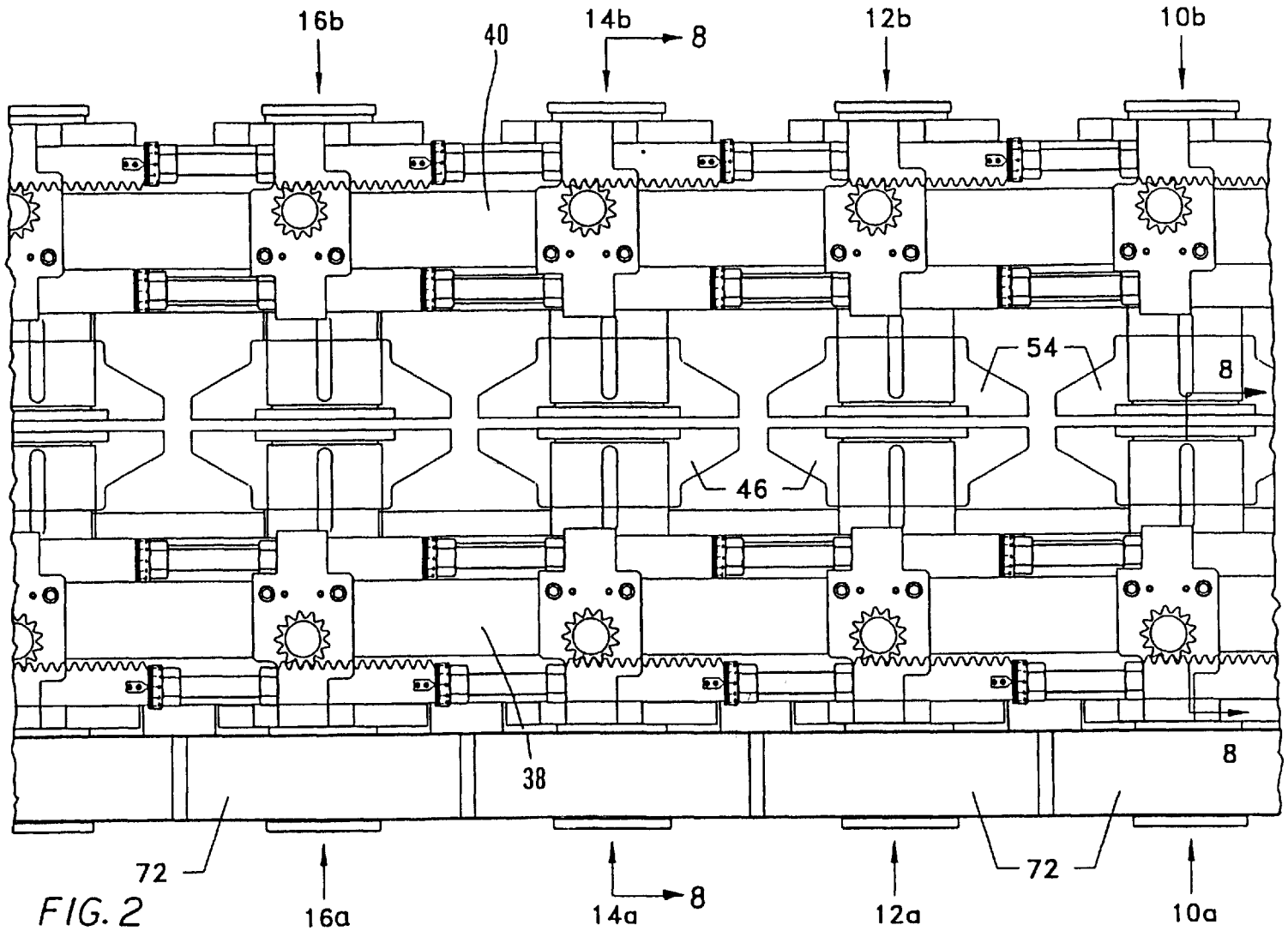
FIG. 2 is a top plan of part of FIG. 1 in cross section.

The roll forming of the web W, is performed progressively at a series of pairs of roller die stands indicated generally as 10, 12, 14, 16, 18, 20, 22, 24, 26, 28, 30, 32, 34, 36. The stands are secured to the base B, in spaced apart intervals, along the path of the web W. As shown in FIG. 2, each pair of stands is designated as 10A, 10B, 12A and 12B, etc. The stands are moveable relative to one another, so as to accommodate webs W of different widths. The stands 10A and 10B, etc., are supported by continuous upright plates 38 and 40, FIGS. 1 and 3 the lower end of which are secured to base B.

Each of the stands 10A, 12A, etc. (FIG. 5) consist of upper and lower transverse bearing shafts 42 and 44. Upper and lower dies 46 and 48 are adapted to be mounted on the respective shafts 42 and 44. Complementary bearing sleeves 50 and 52 are supported by stands 10B, 12B, etc. and support upper and lower dies 54 and 56.

The apparatus also incorporates means for moving the side plates 38 and 40 transversely relative to one another. This comprises a longitudinal side shaft 58, driven by a suitable motor, and connected in a suitable manner to transverse movement means shafts 59 at each end of plates 38 and 40 for moving all of the stands transversely relative to each other, so as to accommodate strips of webs of different widths (described below).

In accordance with the present invention, as explained above, there is also provided means for adjusting at least one of the upper and the lower dies relative to the other, so as to adjust the clearance between the dies, to match the thickness or gauge of the web material as closely as possible. Such adjustments in accordance with the invention can be made while the web is actually running through the dies, thus compensating for variations in the thickness of the web along its length, all of which will be described below.

Referring to FIG. 1 it will be seen that a web thickness sensing unit 60 is provided at the upstream end U of the roll forming apparatus. The thickness sensing unit may typically comprise a pair of rolls 62, and a signal generator (not shown) connected to a computer control centre 64.

In a manner to be described below, the sensing unit 60 senses the thickness or gauge of the web as it passes through the sensing unit, and before it enters the roller die stands. The signal generator 60 sends a gauge signal to the computer 64. By mechanism to be described below the clearances between the dies is adjusted either closer or further apart depending upon the actual thickness or gauge sensed by the sensing unit.

The lower roll shafts have drive gears 70 secured thereon, and upper roll shafts 42 have gears 72 secured thereon meshing with gears 70. Thus as lower roll shafts 44 are all driven in the same rotational direction, all of the upper roll shafts are driven in the reverse rotational direction. The shafts connect telescopically with respective sleeves 50 and 52 and drive them.

This, therefore, causes the dies 46 and 48 and 54, 56 to rotate in opposite directions on opposite sides of the workpiece (W), in well-known manner.

Each of the lower shafts 44 are rotatably mounted in bearings in openings 74 in plate 38.

The upper shafts 42 are carried in bearing housings 76. Each bearing housing 76 is supported in a suitable opening in plate 38.

Bearing housing 76 is able to rotate in a manner to be described below, and thus cause upward and downward movement of upper die 46. This then enables the clearance between the upper and lower dies to be adjusted by adjusting the upper die in a plane transverse to its axis in a manner described below.

Lower bearing sleeves 52 are mounted in suitable openings in side plate 40. Upper bearing sleeves 50 are mounted in upper bearing housings 80 and are rotatable in the same way as housings 76. Roller bearings are mounted within the bearing housings 76 and 80.

The side plates 38 and 40 are between 5 and 6 inches in thickness, in this case, and provide strong support for the shafts, sleeves and dies of the roller stands.

The axial adjustment movement of the upper dies 42 and 54 is achieved by means to be described below thus providing adjustment movement in both the transverse plane, and in the axial direction.

As explained above, the plates 38 and 40, incorporating the die stands 10A, 10B, 12A, 12B etc., are relatively movable away from and towards each other, by means of the two transverse movement transmission shafts 59. The upper and lower shafts 42 and 44 are dimensioned and designed so as to make a telescopic sliding fit within the sleeves 50 and 52. In this way the drive from the die stands 10A, 12A, etc., is transmitted to the die stands 10B, 12B, etc., as described above.

Figure 5:
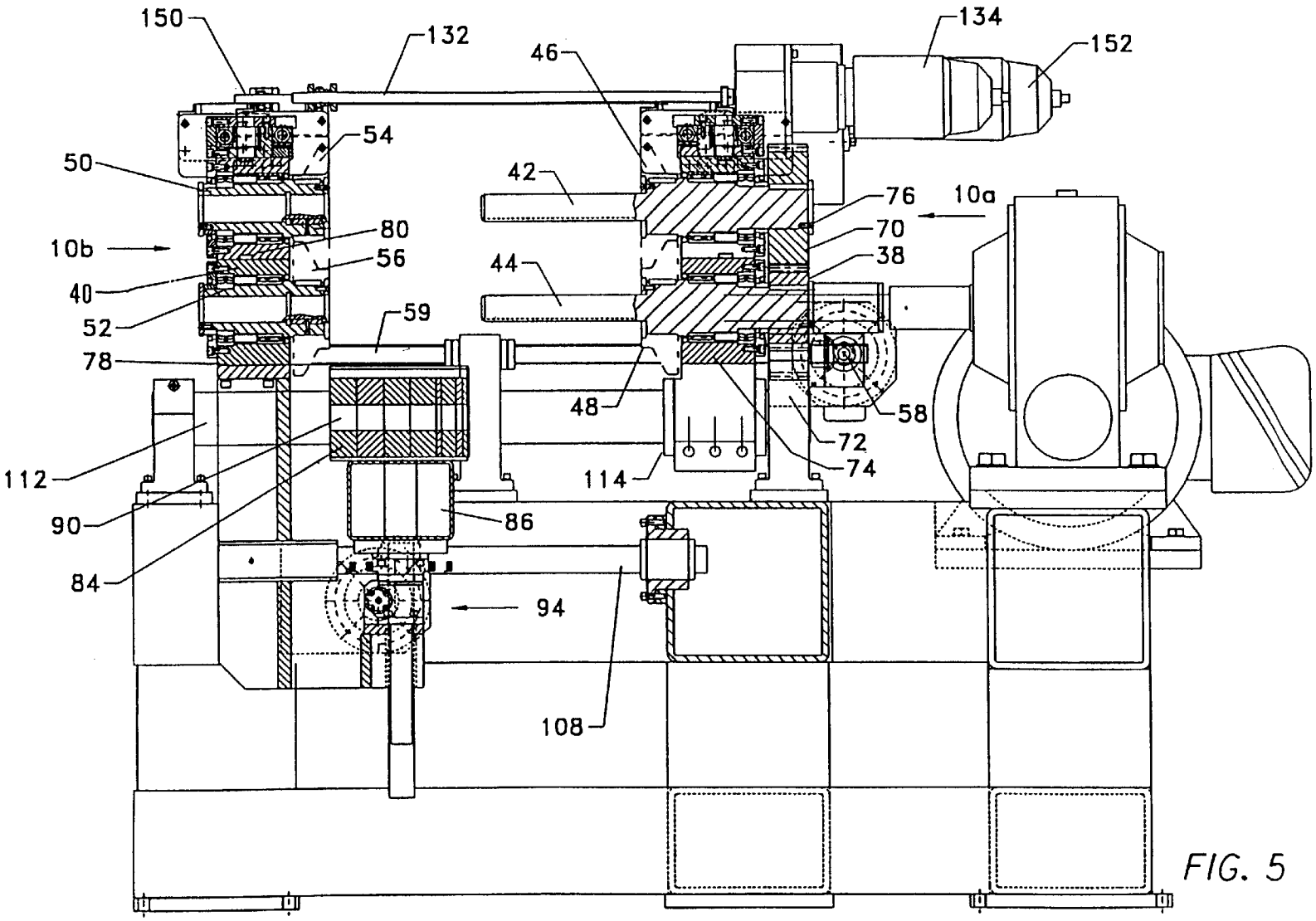
FIG. 5 is a cross section of the roller die apparatus of FIG. 1 at the line 5—5, in a first position.
Figure 6:
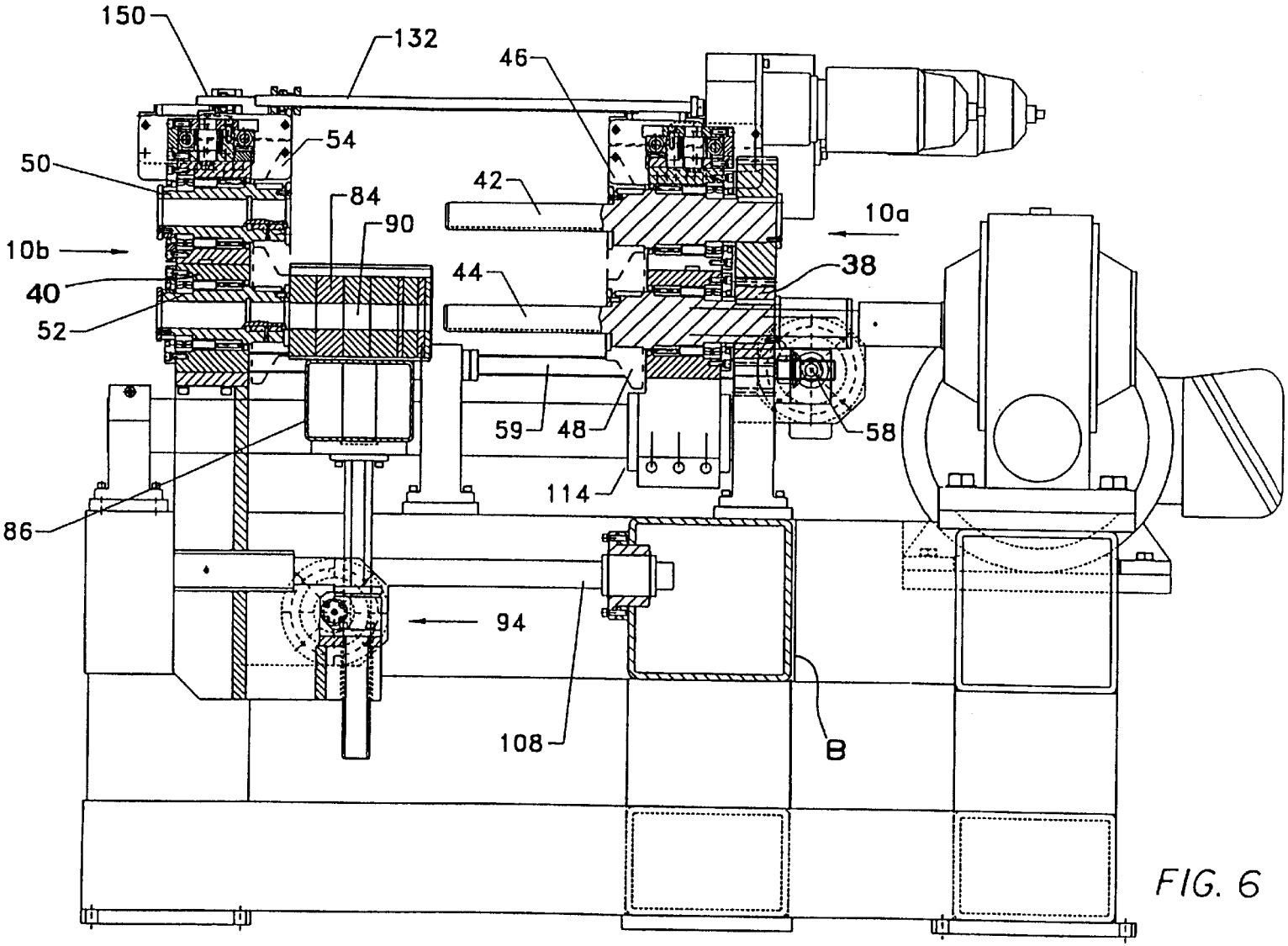
FIG. 6 is a cross section, corresponding to FIG. 5, showing parts in a second position.
Figure 7:
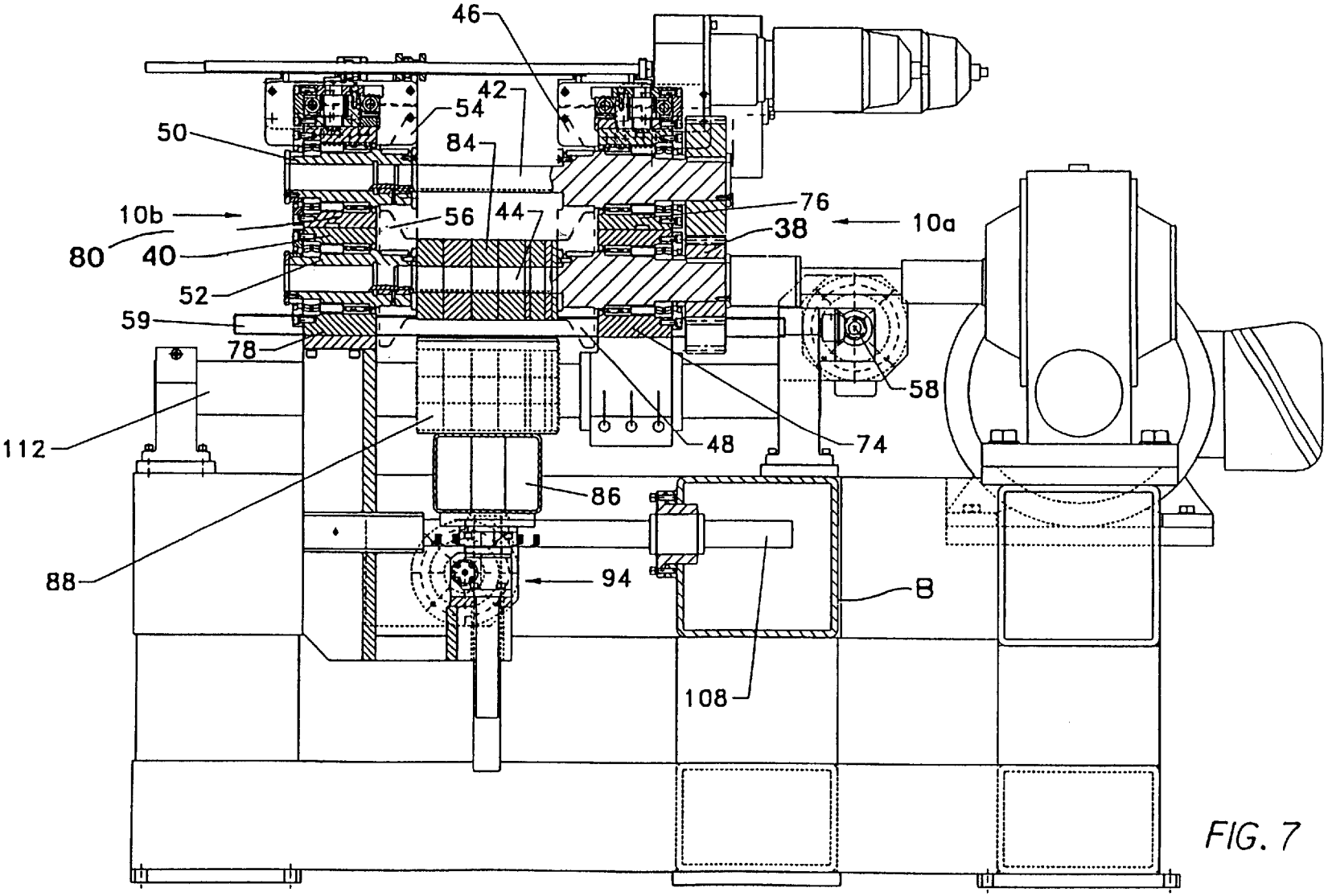
FIG. 7 is a cross section corresponding to FIG. 5, showing parts in a third position.
Figure 8:
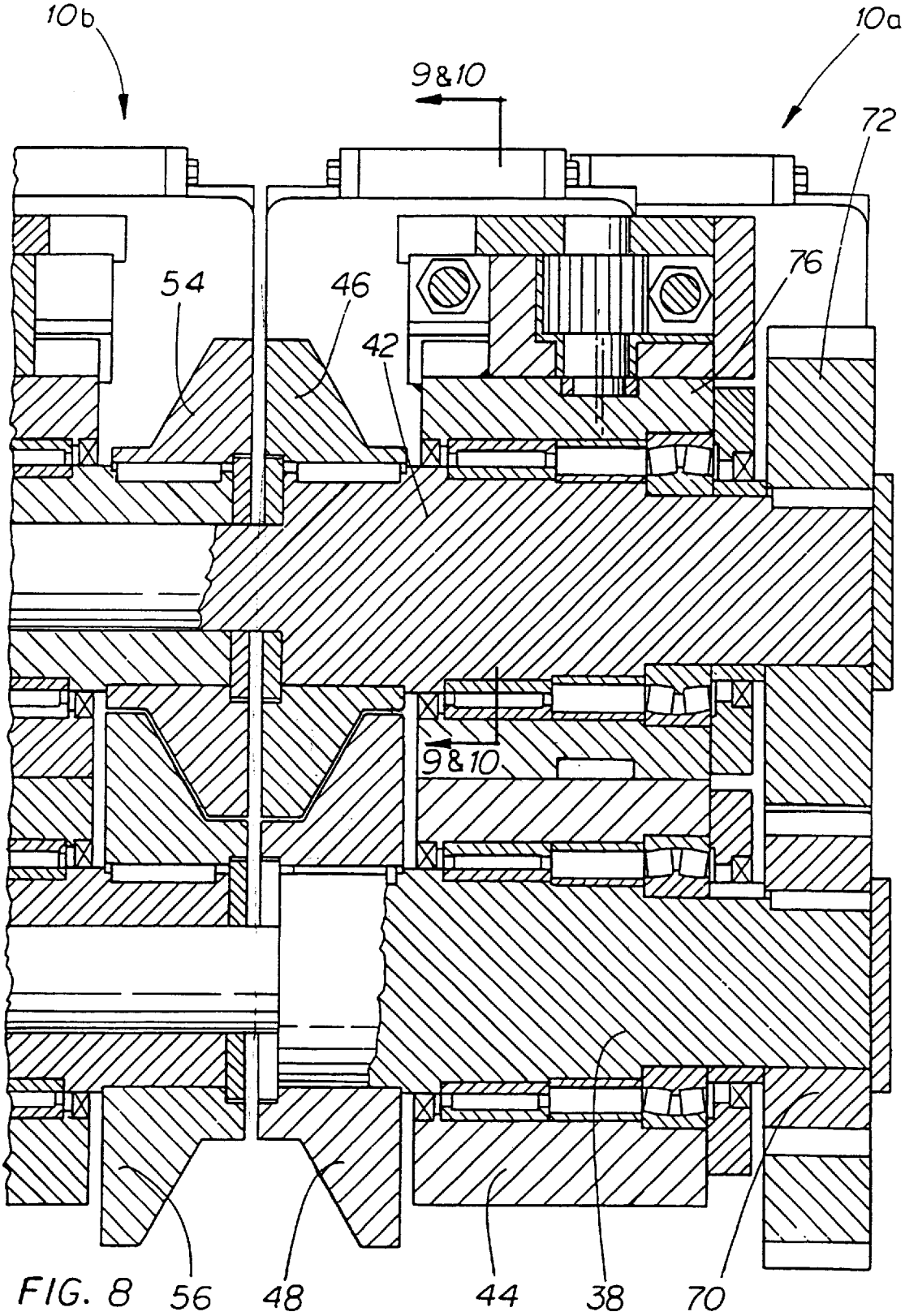
FIG. 8 is a section of one roller stand, sectioned along the line 8—8 of FIG. 2, and showing details of the upper die movement means.

However, referring to FIGS. 5, 6 and 7, it will be seen that the transverse movement means can be operated to withdraw the shafts 42 and 44 entirely from the sleeves, thereby leaving the vacant space between the free ends of the shaft and the sleeves.

This feature enables easy changeover of the dies if the dies must be changed. More importantly however, this feature permits the insertion of spacer rolls 84, between the free ends of the shafts and the sleeves. This could be achieved manually. However, in accordance with a feature of the invention, the sets of spacer rolls for each of the pairs of die stands supported on a lengthwise support table 86. The support table 86 is of rectangular tubular construction (FIG. 5) and along its upper surface it is provided with a plurality of spacer rolls support brackets 88 spaced apart from one another and defining generally downwardly directed three-sided recesses. Along the length of the brackets 88, there are provided retention springs 90 at spaced intervals.

Each set of spacer rolls 84 is provided with a central axial opening, which is designed to fit on the shaft 44 of the stands 10A, 12B, etc.

Figure 3:
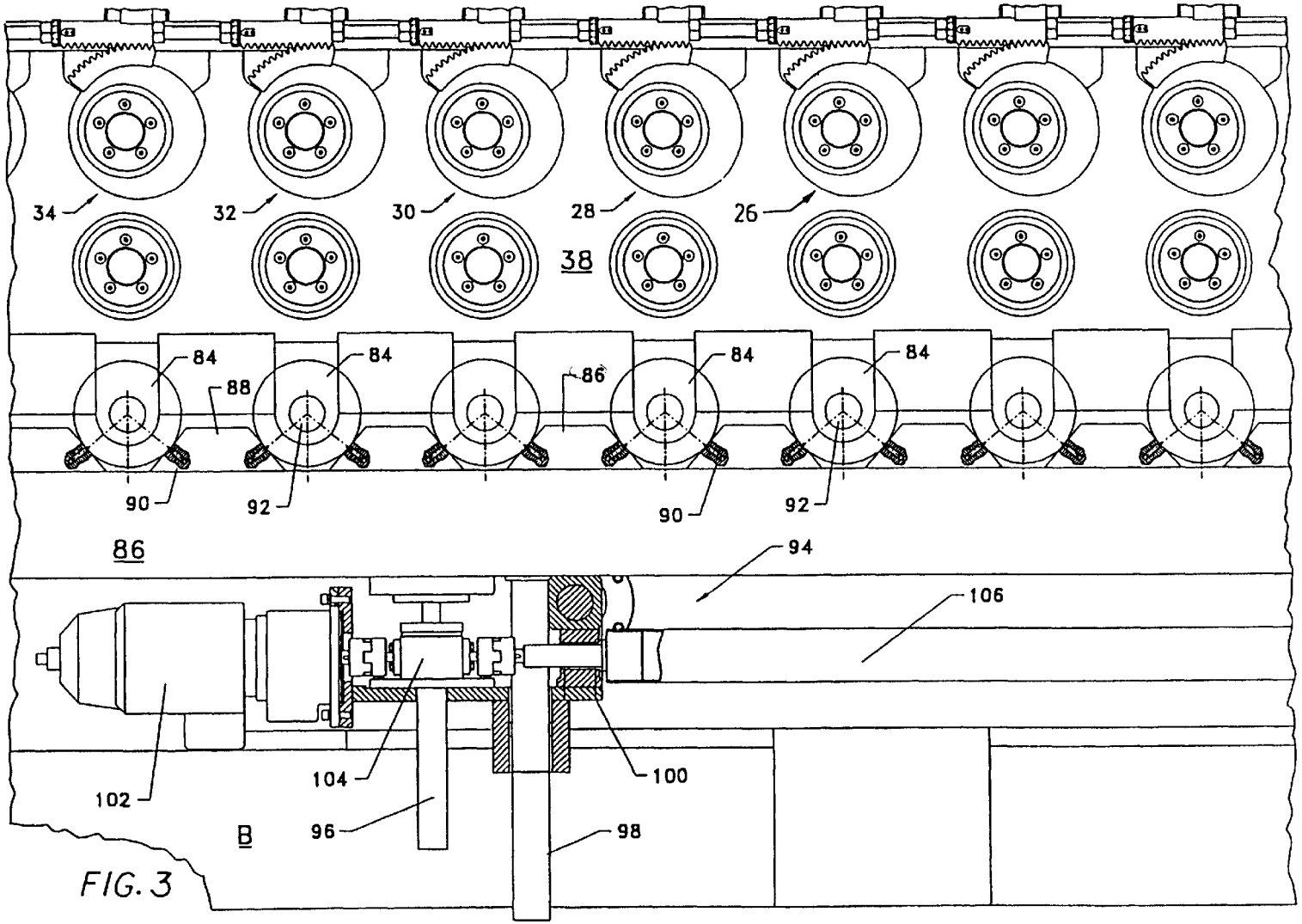
FIG. 3 is an enlarged side elevation of the roller apparatus of FIG. 1, partially cut away to illustrate the movable raise table and spacer rolls.

As shown in FIG. 3 a table raising movement means is indicated generally as 94, located beneath the table 86. FIG. 3 shows only the one table movement means. However there are two such movement means, one at each end of the table, so as to ensure that when the movement means are operated, the table is maintained level while it is raised or lowered.

Movement means comprises a raise shaft 96, and guide shaft 98. Both shafts run through a drive housing 100. A motor 102 drives a drive shaft 104, and a shaft extension 106 connects the drive from the motor 102 to the other of the table raise movement means (see FIG. 1). Other power operated means such as a pneumatic or a hydraulic cylinder could also be used.

Referring again to FIG. 5, it will also be appreciated that the table 86 is movable transversely as well as up and down in a vertical plane. The transverse movement is permitted by means of the transverse carriage 108 (FIG. 5), in response to movement of side plate 40.

Comparison of FIGS. 5, 6, and 7 will show that the entire table and raise mechanism has moved substantially to the right to accommodate the simultaneous closing movement of the two side plates 38 and 40, and the roller die stands. Note that in FIG. 7 the transverse carriage 108 is extending substantially to the right in a rectangular portion of the base B.

Figure 4:
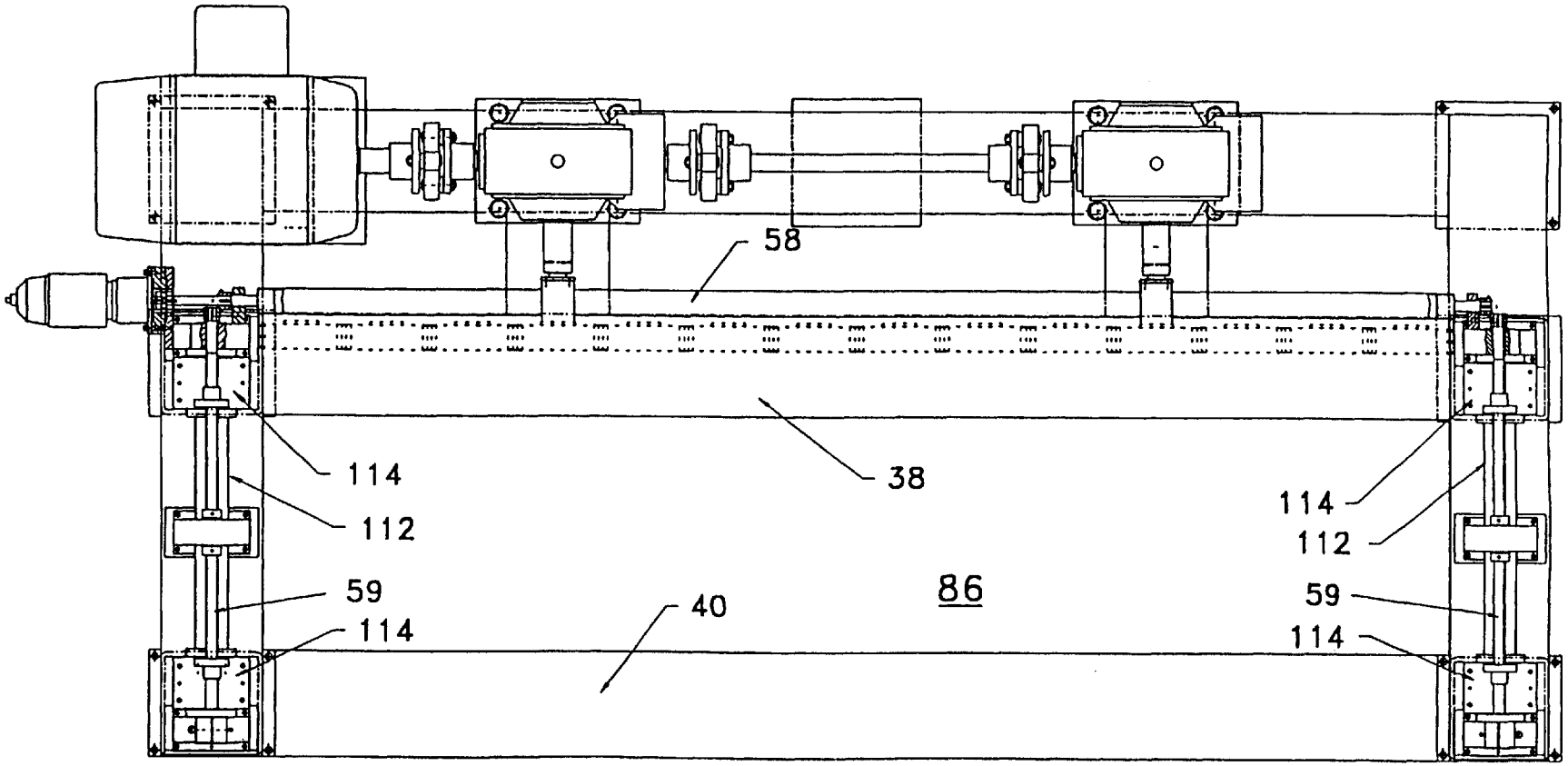
FIG. 4 is a top plan schematic view of the two side plates holding the roller stands, and the transverse movement mechanism.

As has already been explained that all of the stands 10A, 12A on one side and 10B, 12B on the other side are all formed as parts of respective continuous side plates 38 and 40 (FIGS. 1 and 4). At each end of each side plate that is to say the upstream end and the downstream end, there is provided a cross bearing tube of substantial width indicated as 112. The side plates 38 and 40, for each of the stands 10A, 12A, etc., and 10B, 12B, etc., are provided with bearing sleeves 114, adapted to ride on the tubes 112.

This provides a means for permitting movement of the entire set of stands 10A, etc., on the one side, and 10B, etc., on the other side, transversely towards and away from one another in unison. The space between the tube 112 at one end and tube 112 at the other end, is free open space, and permits the raising and lowering of table 86.

It will of course be appreciated that, while the illustrations of FIGS. 5, 6, and 7 illustrate the lower shaft 44 picking up all of the spacer rolls 84, it is perfectly possible that a particular application will not require all of the spacer rolls. Accordingly, all that is required in this case is simply to insert the shaft 44, (see FIGS. 6 and 7) part way into the stack of spacer rolls 84. The table 86 would then be lowered, leaving some of the spacer rolls on the shaft 44, and removing downwardly the rest of the spacer rolls, resting on table 86.

The die stands will then be closed up as in FIG. 7 and in fact the die stands would be closer together than they are shown in FIG. 7, since there would be fewer spacer rolls between the dies.

These operations can be controlled by the computer 64 so that the changeover from one width of web to another width of web would simply require a few instructions to be programmed into the computer, after which the die stands would be moved apart, and then moved partially or fully together, depending upon whether they were picking up all of the spacer rolls or only a selection of them.

Removal of the spacer rolls, or changing their number can be effected in the same way.

In this case the table 86 is raised until it is in contact with the spacer rolls 84. At this point, the side frames are then moved fully open, withdrawing the shaft 44 from the spacer rolls 84. This will then leave the spacer rolls 84 sitting freely on the racks 88 on the table 86. The table 86 will then be lowered, and the die stands can simply be closed again.

Adjustment of Die Clearance

As generally described above, the adjustment of the die clearances is achieved by moving, in this embodiment, the upper die relative to the lower die. In this embodiment the lower die remains unadjusted.

The adjustment of the upper die takes place in two planes that is to say along the axial direction of the shaft 42, with the die moving together with the shaft 42 in the axial direction, and secondly, the die is moved on an axis transverse to the axial direction of shaft 42, i.e. up and down.

By providing adjustments in both planes, it is possible to adjust for variations in web thickness even while the web is running through the roller dies.

The transverse (up and down) adjustments are best understood with reference to FIGS. 8, 9, 10, 11 and 14.

As explained, the lower die 48 remains unadjusted. It simply rotates on its shaft 44, which runs in bearings mounted directly in plate 38.

The same is also true of die 56, mounted on its sleeve in plate 40.

The two upper dies 46 in stand 10A and 54 in stand 10B however are mounted respectively on shaft 42, in stand 10B, and in sleeve 50 in stand 10B. Both shaft 42 and sleeve 50 are in turn carried in bearing sleeves indicated respectively as 76 and 80. The bearing sleeves in turn are received in openings formed in their respective plates 38 and 40, so that they can simply rotate.

In order however to provide for adjustment, by means of rotation of the bearing sleeves, the bearing sleeve 76 is provided with an offset shaft recess 120, containing both bearings, and the shaft 42. The axis of the shaft recess 120 is offset from the central axis of the sleeve 76 (see FIG. 10). Thus when the sleeve 76 rotates, the axis of the shaft 42 must move relative to the axis of the bearing sleeve 76.

Provided that bearing sleeve 76 is suitably located, so that its thinnest point and its widest point lie on a more or less horizontal access (FIG. 10) then movement of bearing sleeve 76 in one direction will cause shaft 42 to move upwardly and the rotation of the sleeve 76 in the other direction will cause shaft 42 to move downwardly.

Turning to stand 10B, it will be seen that shaft sleeve 50 which is mounted in the bearing sleeve 80, also has the same characteristics. That is to say the recess 122 in bearing sleeve 80 is offset with respect to the central axis of bearing sleeve 80 so that the central axis of the sleeve 50 is offset with respect to the central axis of the bearing housing 80.

Thus if the bearing housing 80 is rotated in one direction the shaft sleeve 50 will move upwardly, and if the bearing housing 80 is rotated in the opposite direction the shaft sleeve 50 will move downwardly.

In order to provide for rotational movement of the bearing housings 76 and 80 in unison, each bearing housing is provided with an annular semi gear segment 124, which is welded at a suitable position to the edge of the respective bearing housing 76 and 80.

Figure 9:
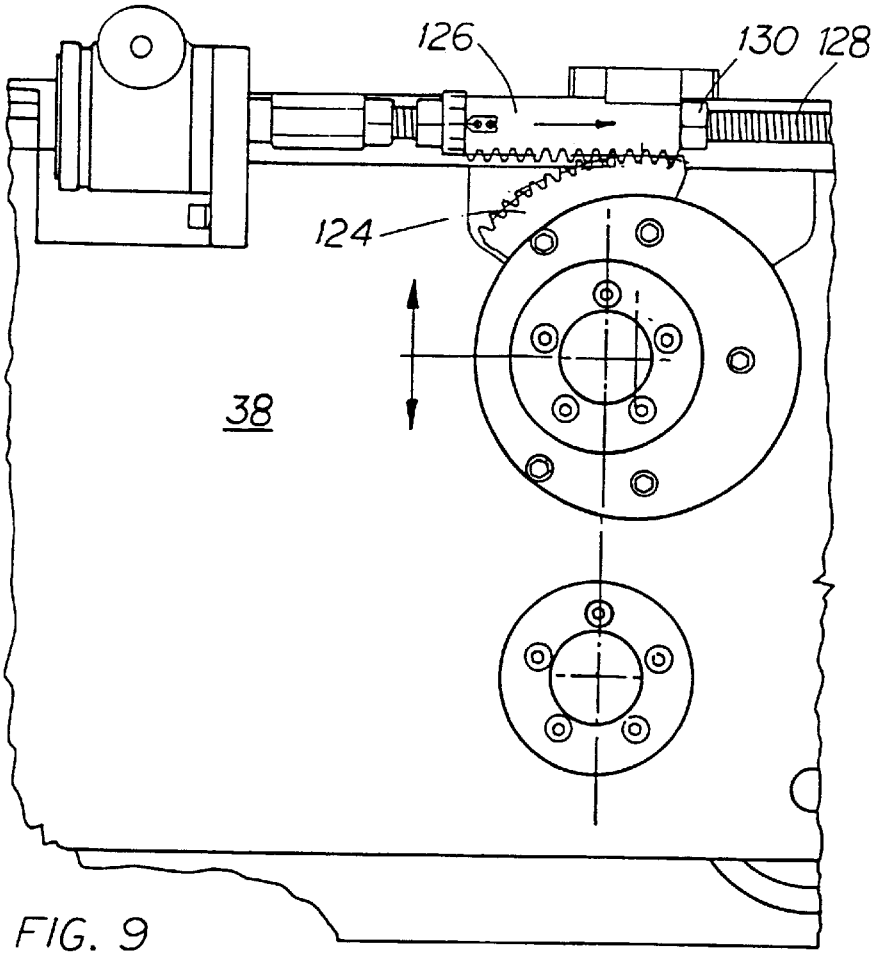
FIG. 9 is a section corresponding to a portion of FIG. 8 along line 9—9 of FIG. 8.
Figure 10:
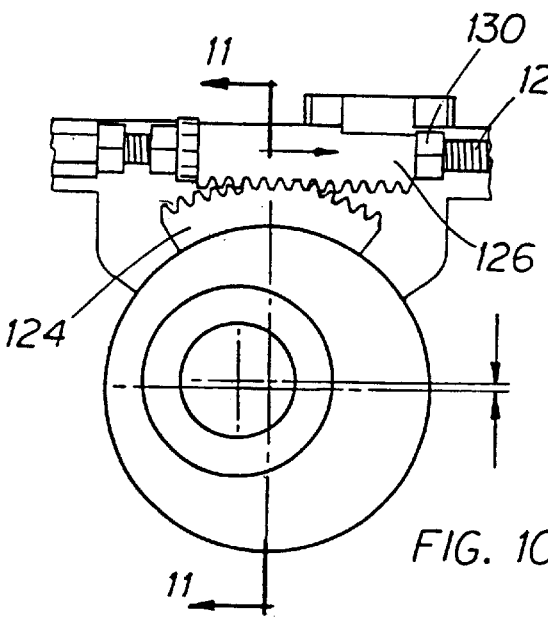
FIG. 10 is a section along the line 10—10 of FIG. 7 and showing movement.
Figure 11:
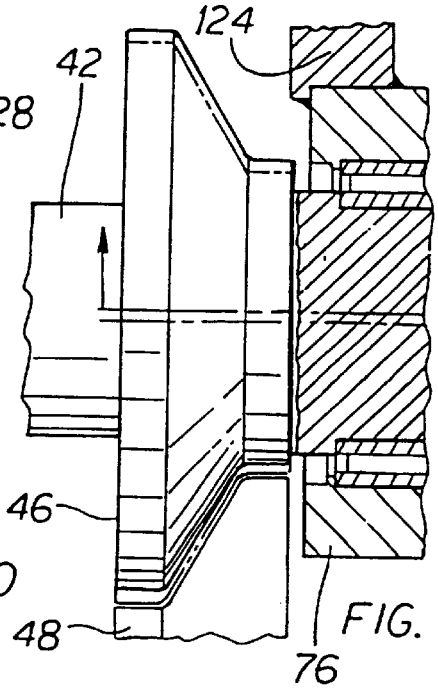
FIG. 11 is a section along the line 11—11 of FIG. 10, showing upward and downward movement of the upper die.
Figure 12:
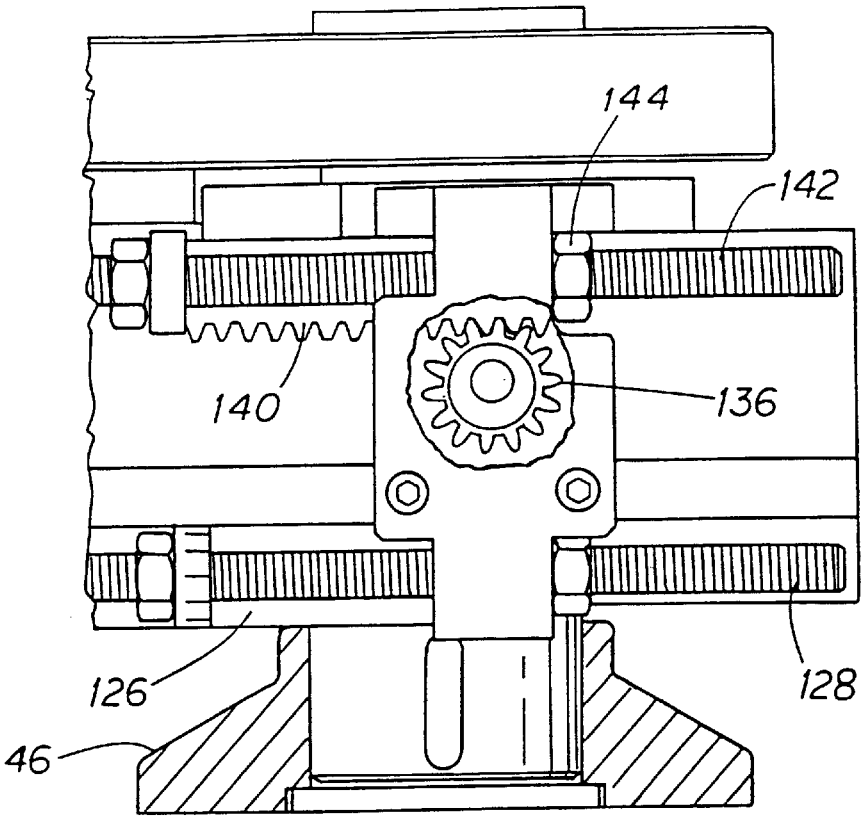
FIG. 12 is a top plan view partially cut away showing the axial movement mechanism for the upper die.
Figure 13:
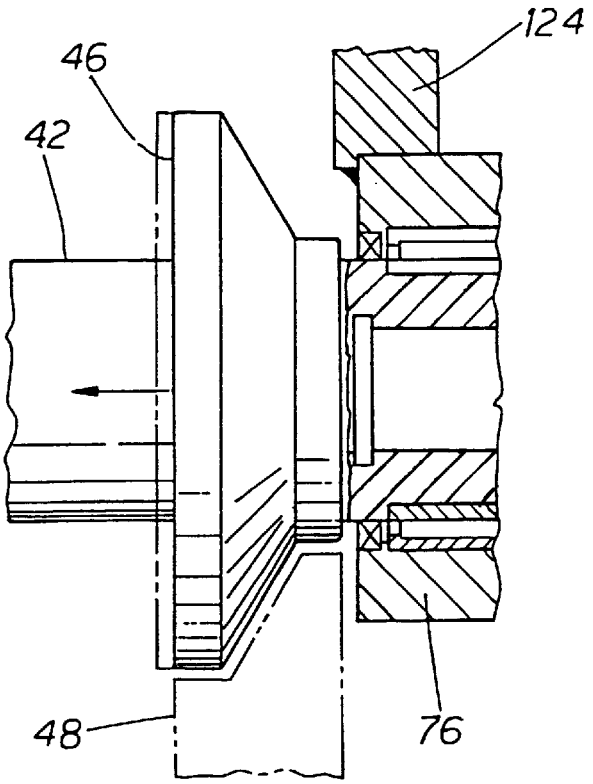
FIG. 13 is a section, corresponding to FIG. 11, but showing axial movement of the upper die relative to the lower die.
Figure 14:
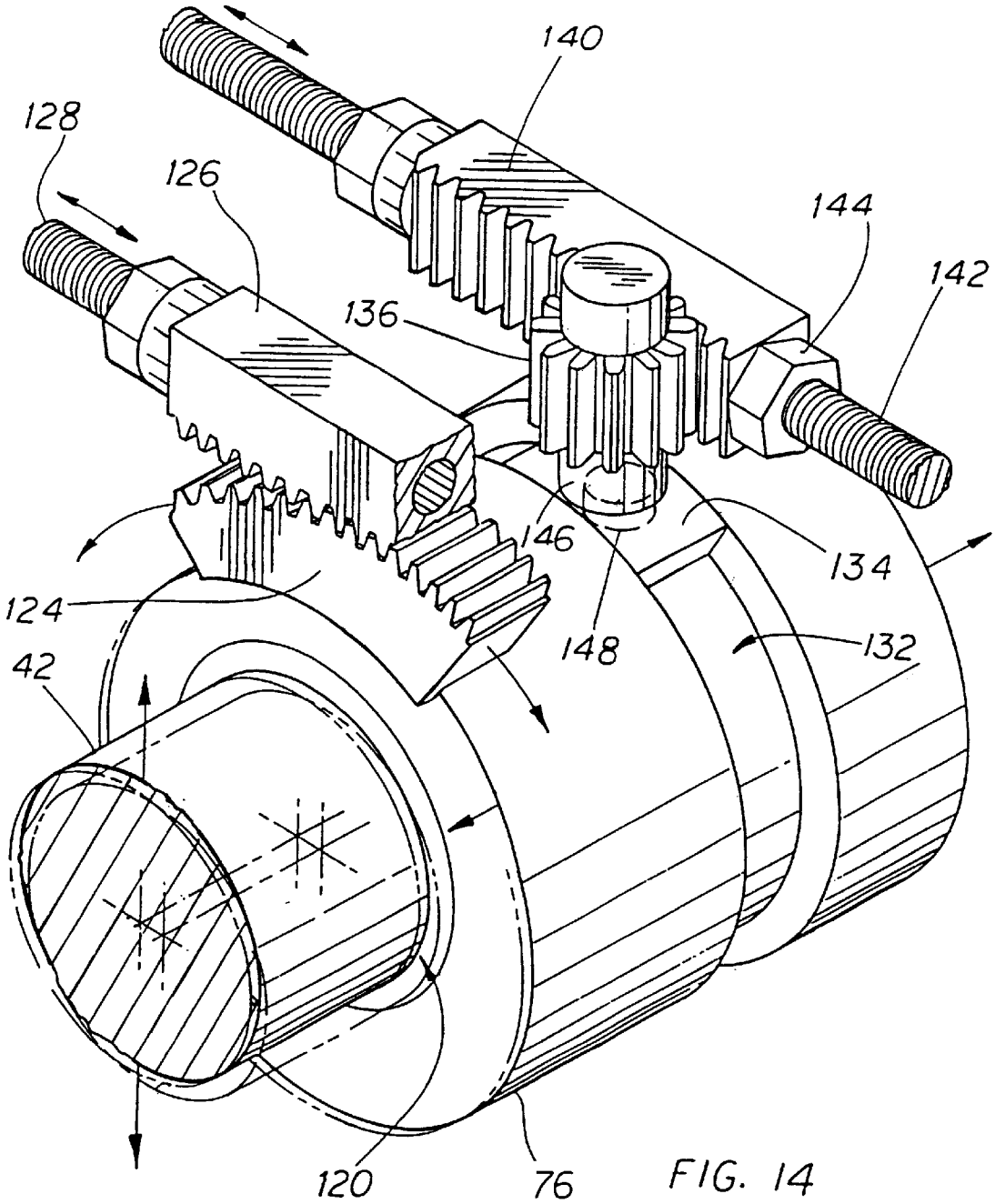
FIG. 14 is a perspective illustration of the upper die bearing housings, and the upward and downward movement mechanism, and the axial movement mechanism.

Two racks 126 are provided in stands 10A and 10B engaging the gear segment 125 (FIGS. 9 and 10). Each of the racks is mounted on to a respective push pull rod 128. The two push pull rods 128 are mounted so as to extend to the upper regions of respective stands 10A, 12B, etc., and 10B, 12B etc. The push pull rods 128 are threaded along their length, for convenience. Other adjustment means could be used other than the rack and gear segment illustrated.

Each of the racks 126 is secured to its respective push pull rod by means of locknuts 130. The push pull rods 128 are both operated simultaneously, by means of a transverse drive coupling shaft 132 (FIG. 2) and a drive motor 134.

Thus, by the operation of motor 134, all of the respective racks 126 can be operated so as to move their respective semi annular gear segments 124, thus moving simultaneously the bearing housings 76 and 80 in the stands 10A, 10B, etc.

Thus all of the upper dies will move simultaneously either upwardly or downwardly by the same increment.

As mentioned above, adjustment also takes place axially along the axis of the shaft, and shaft sleeves. This axial movement is best understood with reference to FIGS. 8, 12, 13 and 14.

Again, the lower dies 48, 56 remains unadjusted, in this embodiment.

The upper dies 46 and 54 are the dies that are adjusted. This is achieved by the same means in both stands 10A and 10B.

The bearing housing 76 and 80 are both rotatable in their openings in their plates 38 and 40, and they are both axially slidable, to a limited extent, relative to their plates 38 and 40. This axial movement is achieved by means of an annular groove 132, formed in each of bearing housings 76 and 80. A self lubricating anti wear block 134 rides in the groove 132. The block 134 has a central recess 136.

A spur gear 138, is secured in a cross member 140 fastened to the top of the respective plates 38 and 40. The spur gears 138 have a downward axial extension 146. At the free end of extension 146, there is located an offset stub 148. Stub 148 is received in the recess 136 in wear block 134.

It will thus be seen that by the operation of the racks 140, in response to the movement of the push pull rods 142, the spur gears 138 will rotate one way or the other. This will cause an orbital movement of the offset stub 148, the extension 146 and gear 138.

This orbital movement will thus force the respective bearing housing 76 and 80, to move axially one way or the other relative to their respective plates 38 and 40.

It will be appreciated that as a result of this movement there is a slight lateral displacement of the annular gear segments 124, relative to their respective racks 126. However, since the degree of movement is relatively slight, this will not cause any problem in operation.

The push pull rods 142 are again operated by a cross shaft 150, and motor 152 (FIG. 5), so that the push pull rods on all of stands 10A, 12A, and 10B, 12B etc., operate simultaneously.

It will thus be seen that during operation of the roll forming line, if the sensor 60 detects a change in the thickness of the web, it will send a signal to computer 64. Computer 64 will thereupon signal motors 134 and 152 to adjust the die clearances in two planes, to accommodate the different web thickness. This adjustment will of course be relatively minor, but will have the effect of maintaining the highest quality of the roll forming action on the web, which would otherwise not occur if the die clearances were not adjusted.

It will of course be appreciated that in the event of a changeover in the operation of the roll forming apparatus from one web to another, the web may have a thickness which is increased or decreased somewhat as compared with the previous web that was being processed.

These adjustments can, in the great majority of cases, be taken into account simply by programming the computer, so that it instructs the motors 134 and 152 to adjust the die clearance to suit the new web thickness.

In the event of an extreme change in web thickness it may of course be necessary to readjust the position of the racks on the push pull rods. This can readily be done simply by loosening off the locknuts, resetting the positions of the racks and locking up the locknuts to hold the racks in the new position.

Figure 15:
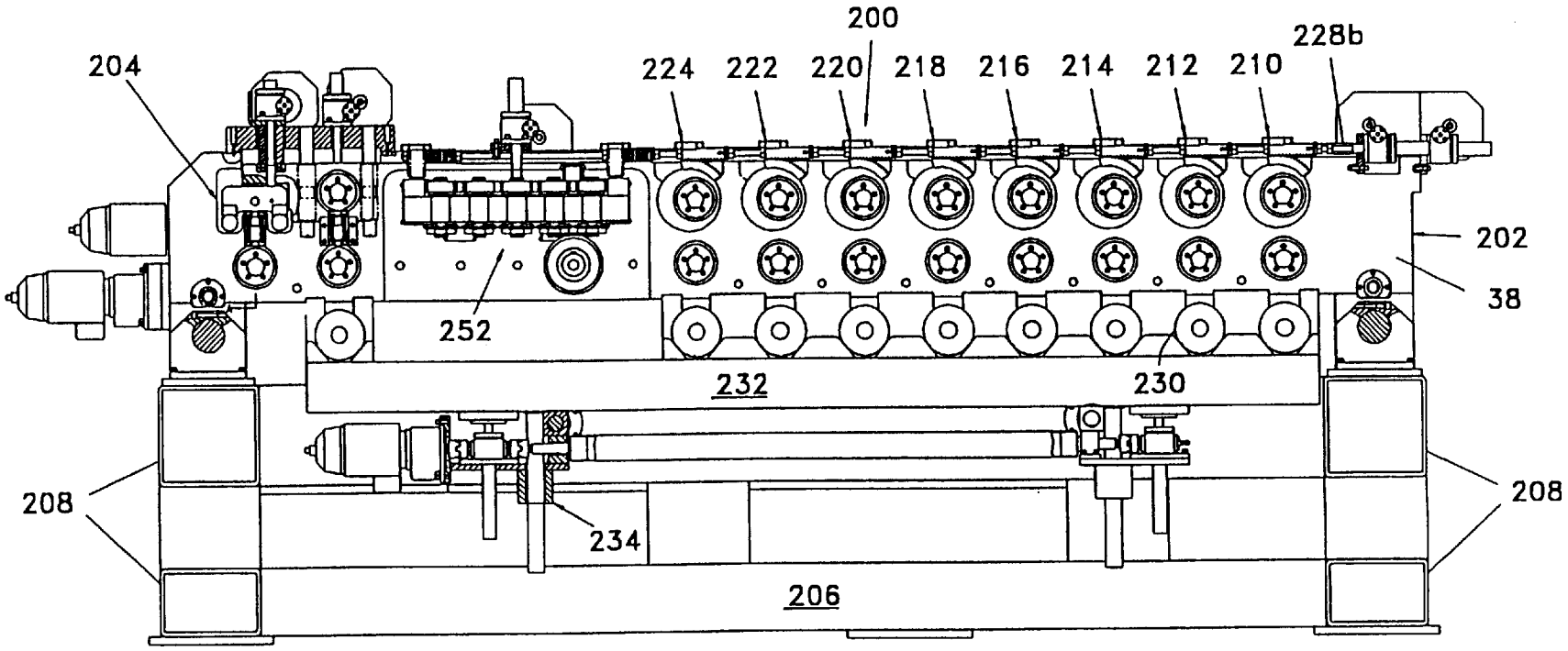
FIG. 15 is a side elevational view of an alternate embodiment of roll forming machine using certain of the features of the embodiment of FIGS. 1 through 14.
Figure 16:
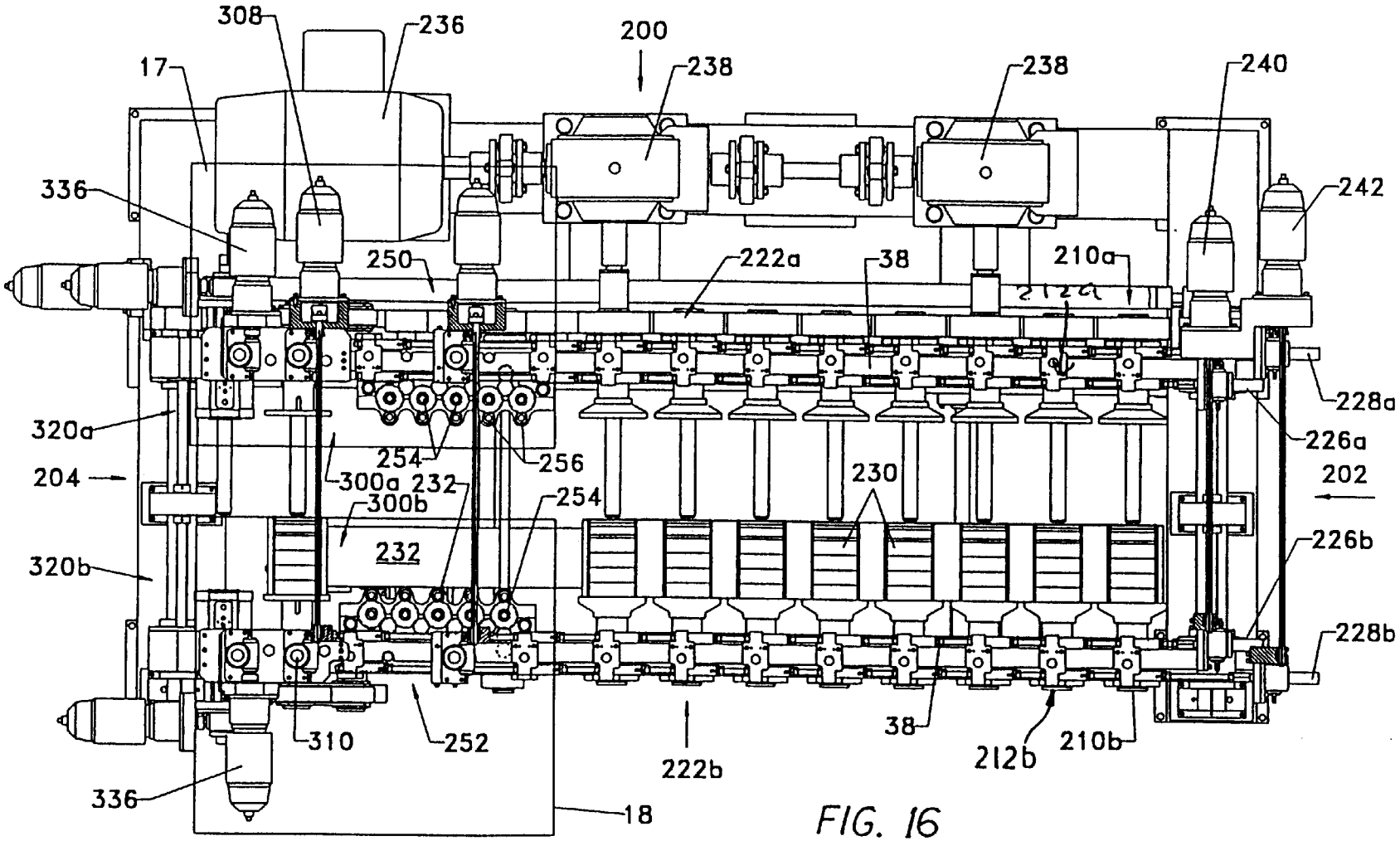
FIG. 16 is a top plan view of the embodiment of FIG. 15.
Figure 17:
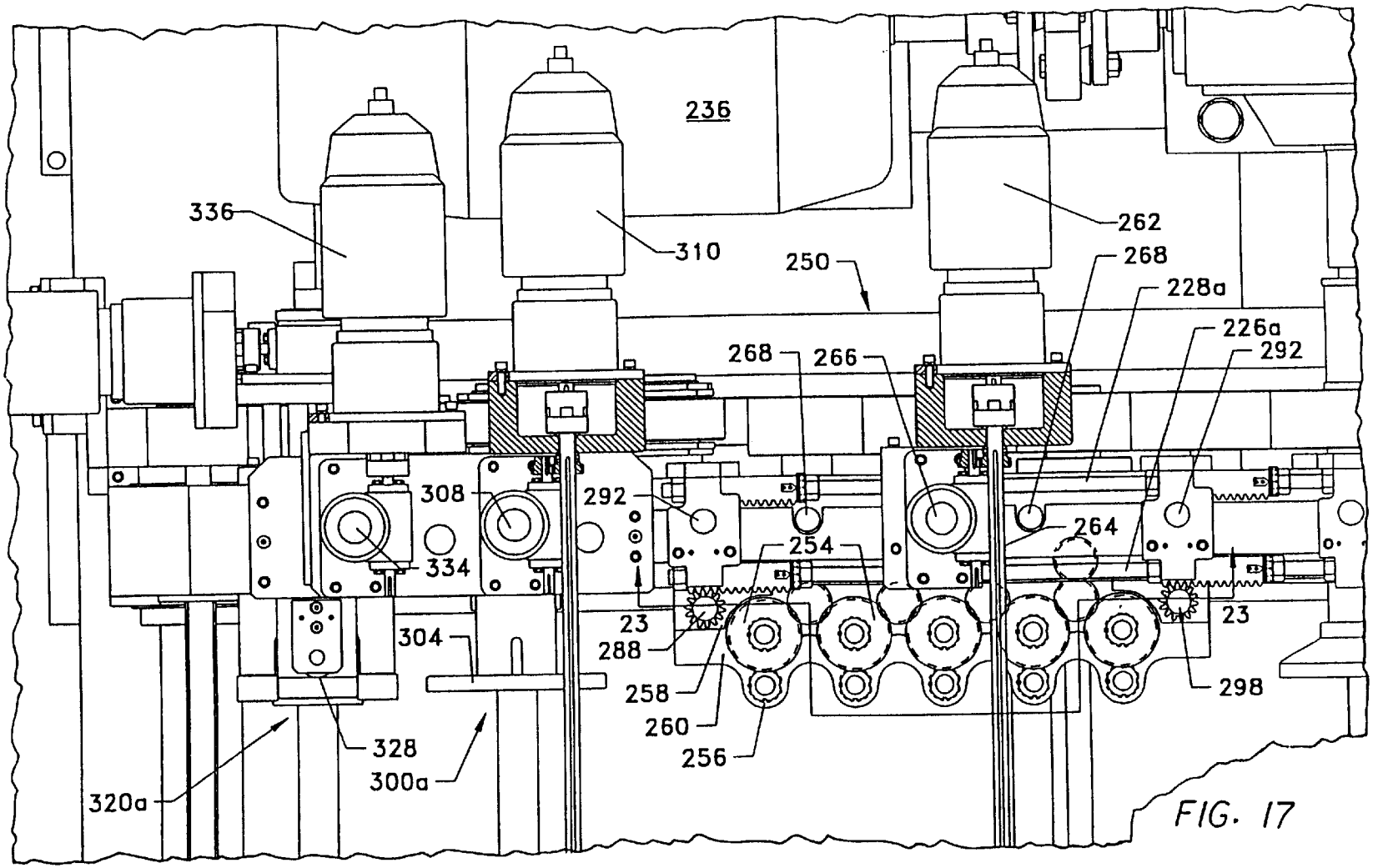
FIG. 17 is a greatly enlarged top plan view showing the area marked 17 on FIG. 16.
Figure 18:
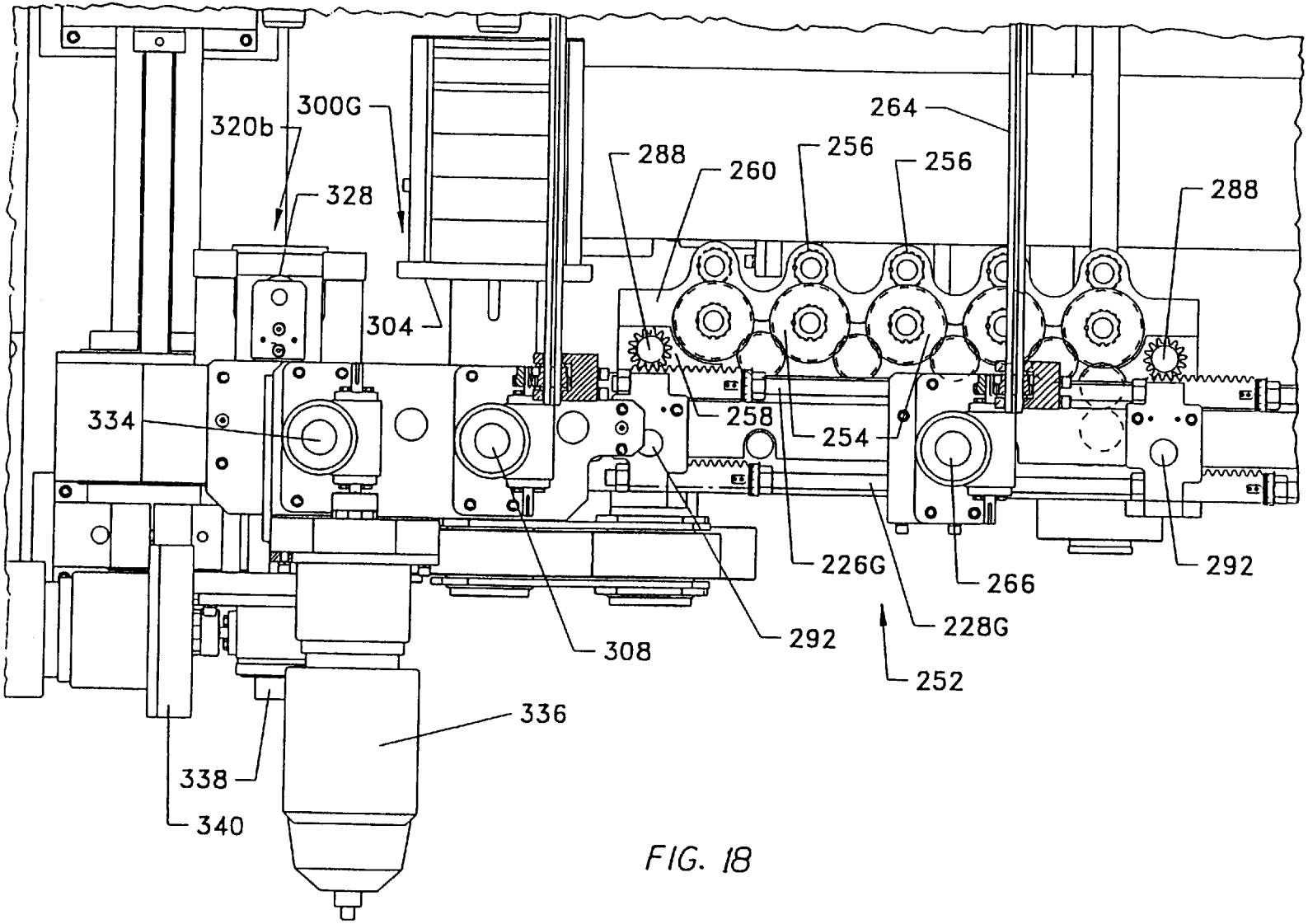
FIG. 18 is a top plan view greatly enlarged of the area marked 18 in FIG. 16.

In accordance with a further embodiment of the invention, illustrated in general in FIGS. 15 and 16, provision may be made for a somewhat different form of operation than in the FIGS. 1 through 14 embodiment.

In the FIGS. 1 through 14 embodiment, the C-section is formed by bending the two outer flanges of the C at the leading end of the machine, and then progressively forming the intermediate bends of the C-section, in downstream sets of rolls.

This however, placed certain restrictions on the size and shape of the C-section that could readily be formed in this way.

In accordance with the embodiment of FIGS. 15 and 16, the inner bends of the C-section are formed first by the initial sets of rolls, and the final in turned flanges of the C-section are formed last, downstream from the main rolls. This has certain advantages. It enables a greater range of flange sizes, and web depths, to be formed on a single machine. It also provides for easier adjustment.

The embodiments of FIGS. 15 and 16 also provide a finished C-section straightener, all to be described below, which can in fact be used with the embodiment of FIGS. 1 through 14 or 16 and 16.

Many of the features of FIGS. 1 through 14 and FIGS. 15 and 16 are common to both, and will therefore be described in somewhat less detail, since they have already been described in connection with FIGS. 1 through 14.

Referring now to FIG. 16 it will be seen that this embodiment of the invention comprises a roll forming apparatus indicated generally as 200, and having an upstream end 202 and a downstream end 204. A web of material passes from the upstream end to the downstream end during the process of being formed from a flat web into a C-section.

The apparatus 200 will also have an upstream web thickness measurement device similar to that shown in FIG. 1, for providing for continuous adjustment.

The entire apparatus, as before, is supported on a base made up of a frame work of rectangular beams 206, connected to rectangular cross members 208.

As before, there are a plurality of roller die stands indicated as 210, 212, 214, 216, 218, 220, 222 and 224. As shown in FIG. 16, in each case each of the stands comprise respective right and left hand die stands indicated by the suffix a–b.

Also, as in the previous embodiment, each of the die stands comprises pairs of upper and lower dies, which mesh with one another to provide the formations desired.

As before, the upper dies are moveable relative to the lower dies by means of push pull rods 226 and 228, the two rods being respectively referenced a and b (see FIG. 16) on opposite sides of the apparatus.

The operation of the push pull rods to procure the upward and downward movement, and lateral movement, of the upper die is as already described, and consequently the apparatus is not described in detail again for the sake of simplicity.

Similarly, as in the FIGS. 1 through 14 embodiment the die stands 210A and 210B, etc., are moveable away from one another and together, to provide for varying spacings between the stands and also, to permit varying numbers of spacer rolls to be introduced there between. The spacer rolls indicated as 230 are carried an a spacer roll table 232 operated by means of the raise mechanism 234 (see FIG. 15). The spacer rolls, table and raise mechanism all operate in the same way, as is already described in the embodiment of FIGS. 1 through 14.

As before, the roller die stands are all driven by a common drive motor 236 driving through transmissions 238.

The push pull rods 226 are operated by means of motor 240 and the push pull rods 228 are operated by means of the motor 242.

As mentioned above, this embodiment of the invention provides for the formation of the edge flanges of the C-section downstream from the main roller die stands. The edge flange forming die stands are indicated generally in FIGS. 15 and 16 as 250 and 252. Each of the edge forming die stands 250 and 252 consists of, in this case, five pairs of outer and inner edge forming dies on each side, indicated as 254 and 256.

As will be seen from FIGS. 17 through 24, each pair of edge forming dies 254 and 256 consists of outer dies 254 and inner dies 256, the outer dies being of much larger diameter than the inner dies for reasons to be described below.

Each set of dies outer 254 is mounted on respective common mounting frames 258 and each set of inner dies 256 is mounted on sub-frames 260. Sub-frames 260 are mounted on mounting frames 258 and are moveable relative thereto as described below. All of the dies 254, and 256 can be moved as a group towards and away from the other set, to accommodate workpieces of different widths, or to form C-sections of different dimensions by movement of the two mounting frames 258—258.

Thus the two mounting frames 258—258 carrying the two groups of dies 254 and 256 can be moved towards and away from one another by transverse movement means (not shown) similar to FIGS. 1–14, and moving all of the dies transversely, simultaneously.

The apparatus also provides for upward and downward adjusting movement of the mounting frames 258—258 holding the two groups of dies 254 and 256. These upward and downward adjustment movements are procured by means of motor 262 operating through shaft 264 and gear drives 266, the lower ends of which are connected directly to the mounting frames 258 and 258 respectively. Guide posts 268 guide such vertical movement.

In this way, the positioning of the two groups of horizontal dies can be adjusted up and down, so as to accommodate the manufacture of C-sections of different shapes, i.e., having deeper web sections or shallower sections.

Figure 20:
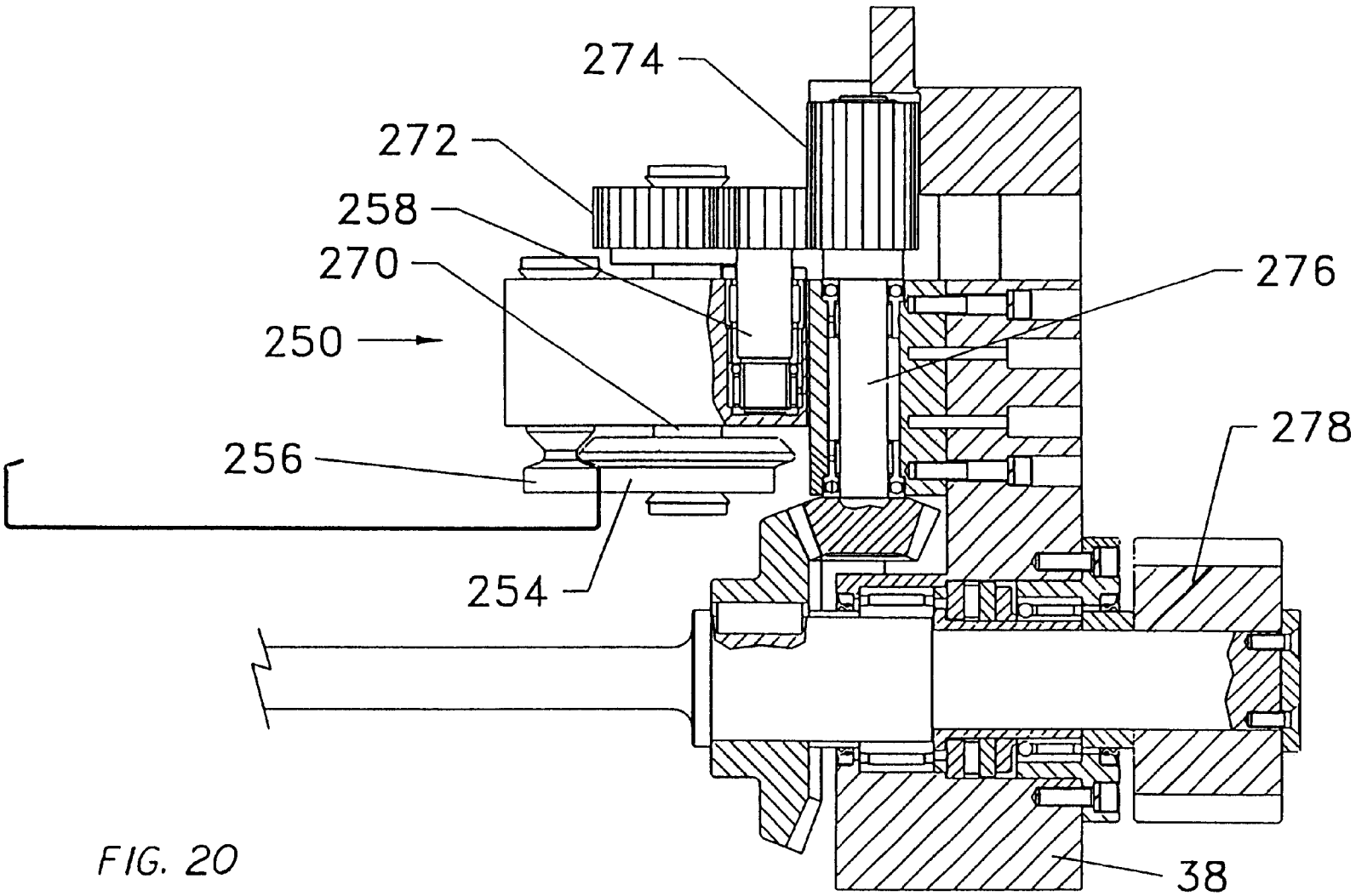
FIG. 20 is a section along the line 20—20 of FIG. 19.

FIG. 20 shows that each inner die 254, is mounted on a drive shaft 270, having a driven gear 272, connected by idler gears 272A. One of gears 272 meshes with an elongated drive gear 274. The reason for the elongated drive gear 274 is to permit the upward and downward movement already described, performed by moving the framework 258 upwardly or downwardly, to move all of the pairs of dies in unison.

Gear 274 is mounted on shaft 276 connected to the main drive train 278.

The outer dies 254 are not in themselves adjustable, other than as already explained.

Figure 21:
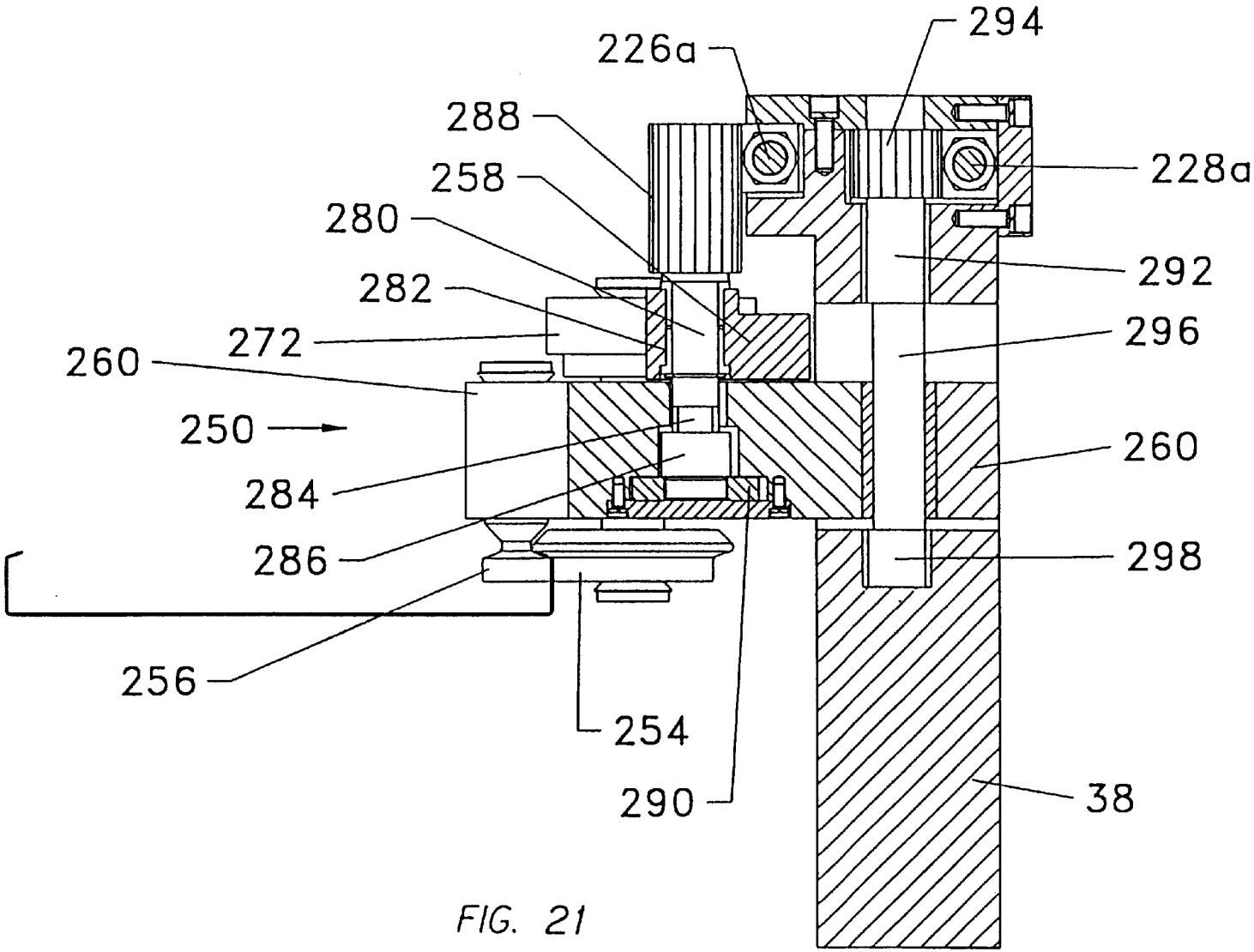
FIG. 21 is a section along the line 21—21 of FIG. 19.
Figure 22:
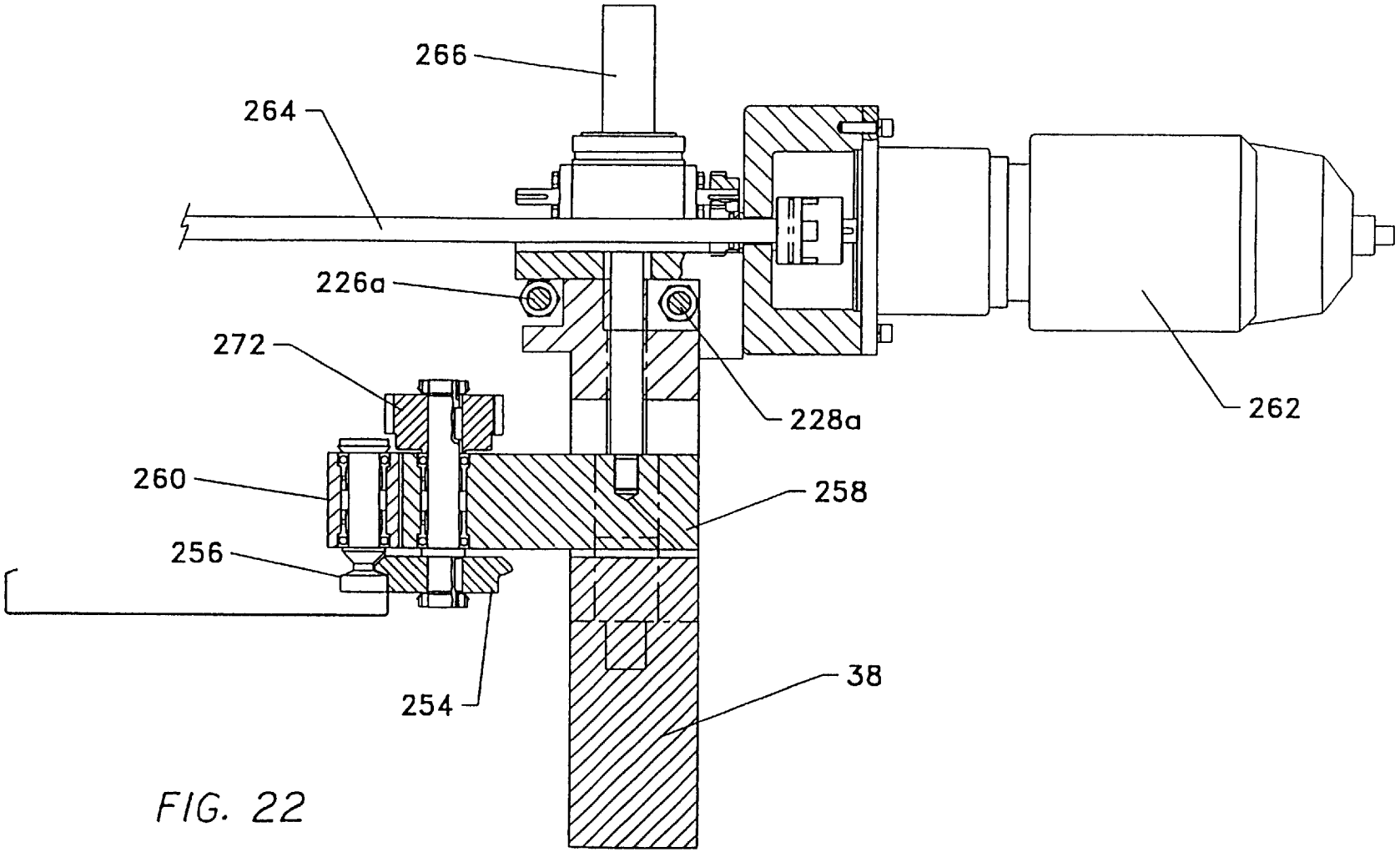
FIG. 22 is a section along the line 22—22 of FIG. 19.
Figure 23:
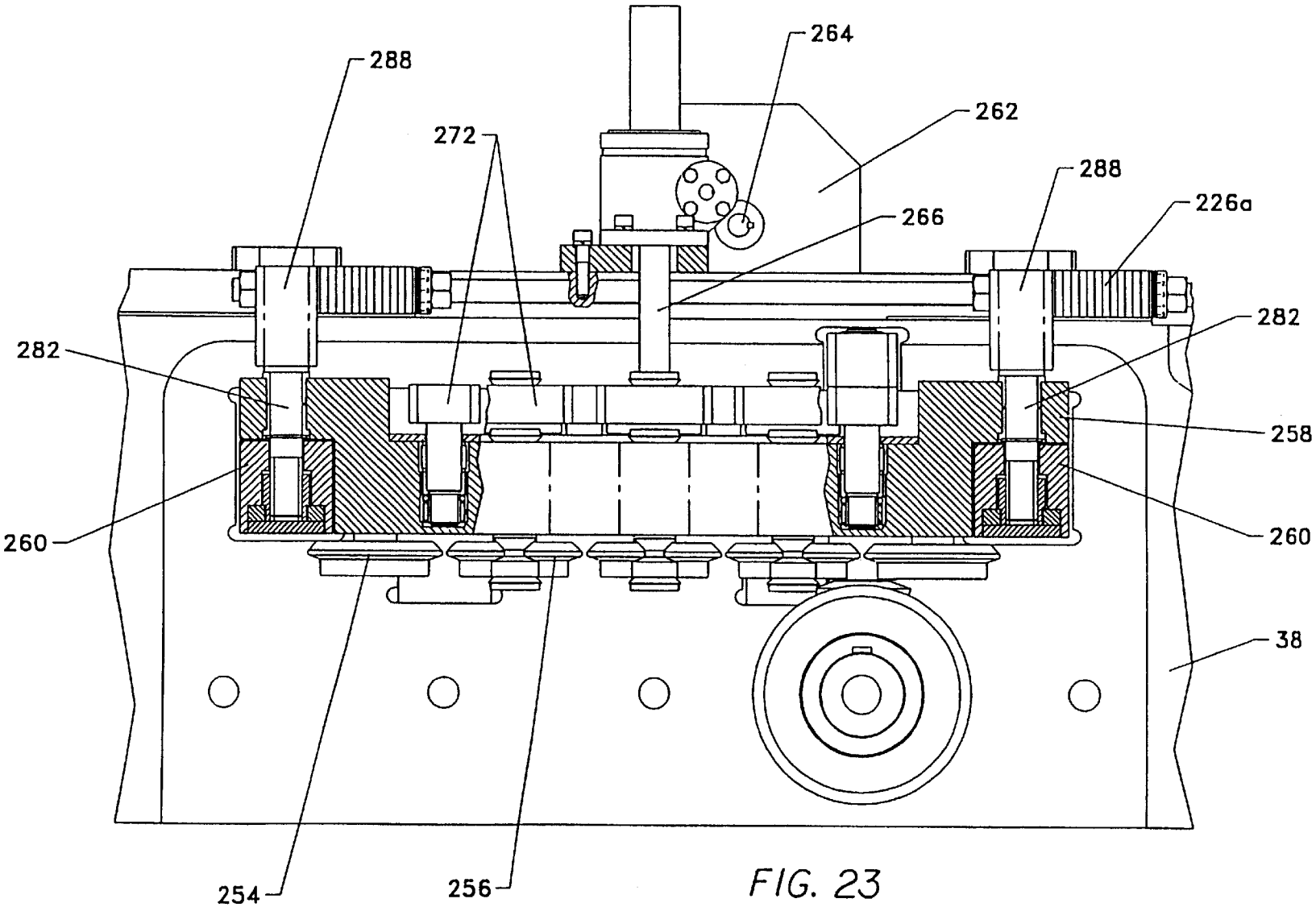
FIG. 23 is a section along the line 23—23 of FIG. 19.
Figure 24:
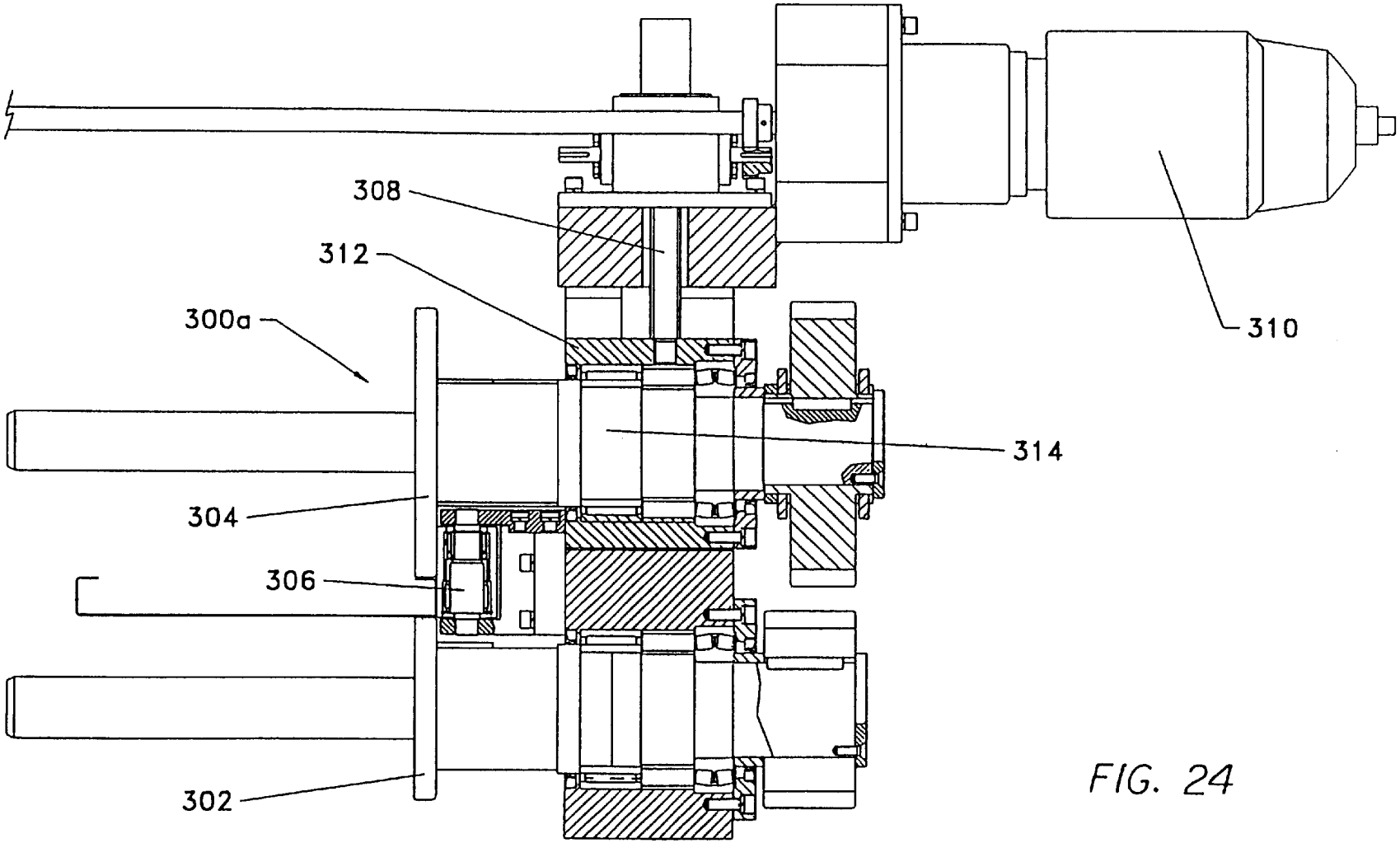
FIG. 24 is a section along the line 24—24 of FIG. 19.

The adjustment of the outer dies relative to the inner dies, in the pairs of the horizontal dies, is best understood with reference to FIGS. 21, 22 and 23.

Adjustment of the clearance between the outer dies 254 and the inner dies 256 is achieved by providing for adjusting movement of the outer dies as a group, in a vertical plane, and also in a transverse plane. Sub frames 260 are mounted on mounting frames 258 in such a way that they can be moved both vertically and transversely.

Vertical adjustment for the inner dies comprise shafts 280 on which the sub-frame 260 is mounted at each end. The shafts 280 are provided within sleeves 282. Jack screws 284 engage threaded members 286. Shafts 280 are operated by means of the push pull rods 226A and 226B, engaging elongated gears 288 on the upper ends of shafts 280. Members 286 are secured to captive plates 290 secured within either end of sub-frame 260 (FIGS. 21 and 22).

Rotation of shafts 280 will thus raise, or lower, sub-frames 260 relative to frames 258.

The transverse adjustment of the inner dies relative to the outer dies for clearance adjustment, is also achieved by means of movement of sub-frames 260 relative to frames 258 transversely.

Shafts 292 have gears 294 which engage push pull rods 228A and 228B. Shafts 292 are connected to eccentric shafts 296 which extend down through sub-frames 260 and into side frames 38 Shafts 296 at their lower ends have bosses 296, coaxial with shafts 292. Thus rotation of shafts 292 will cause eccentric orbital movement of shafts 296, causing sub-frames 260 to move transversely relative to frames 258.

The apparatus of FIGS. 15 and 16 further provides an end finishing operation, by means of two pairs of end finishing roll assemblies 300A and 300B, on opposite sides of the apparatus. The end finishing roll assemblies have lower dies 302 and upper dies 305 and intermediate side dies 306. In this way, it is possible for the three dies to engage all three outer surfaces of the C-section and provide final finishing and squaring step.

Inward and outward movement of the two die assemblies is provided by the main transverse movement mechanism already described above (see FIGS. 1–14).

The lower die 302 in each of the finishing die assemblies 300 will remain fixed as to height, and is not adjustable. The side dies 306 are simply likewise fixed, relative to the lower dies 302, so that they simply adjust inwardly and outwardly, with the inward or outward movement of the entire finishing die assemblies.

The upper dies 304 of each finishing die assembly are moveable upwardly and downwardly, to take into account different dimensions of different C-sections being formed. This is achieved by means of the jack screws 308 operated through suitable transmissions by motors 310. The lower ends of the jack screws are secured by the bearing housing 312 carrying shaft 314 for the upper dies 304.

Operation of the jack screws will thus cause the entire bearing housing 312 to either move upwardly or downwardly.

Finally, in this embodiment, provision is made for straightening the C-section as it exits from the finish rolls.

It is well known that when forming C-sections, they may have a tendency to warp, which implies either that the section will bend upwardly or downwardly, or sideways.

In order to overcome this tendency, there are provided straightening assemblies 320A and 320B which are located just downstream, at the exit of the apparatus. This is best understood with reference to FIGS. 19 and 25. The straightening assembly comprises a fixed lower roll 322, which is moveable along a sleeve with the side roll, which is located along the pass line of the lowermost web of the C-section. Two, leading and trailing, straightening rolls 324 and 326 are mounted above the lower roll and spaced apart with respect thereto upstream and downstream.

In addition, side rolls 328 are provided for engaging the side portions of the C-section.

As in the case of the rest of the rolls, the straightening rolls are mounted as left and right hand sets of rolls on opposite sides of the apparatus and will move towards and away from one another in conjunction with and in unison with the movement towards and away from one another and all of the rest of the dies in the manner described above.

Figure 19:
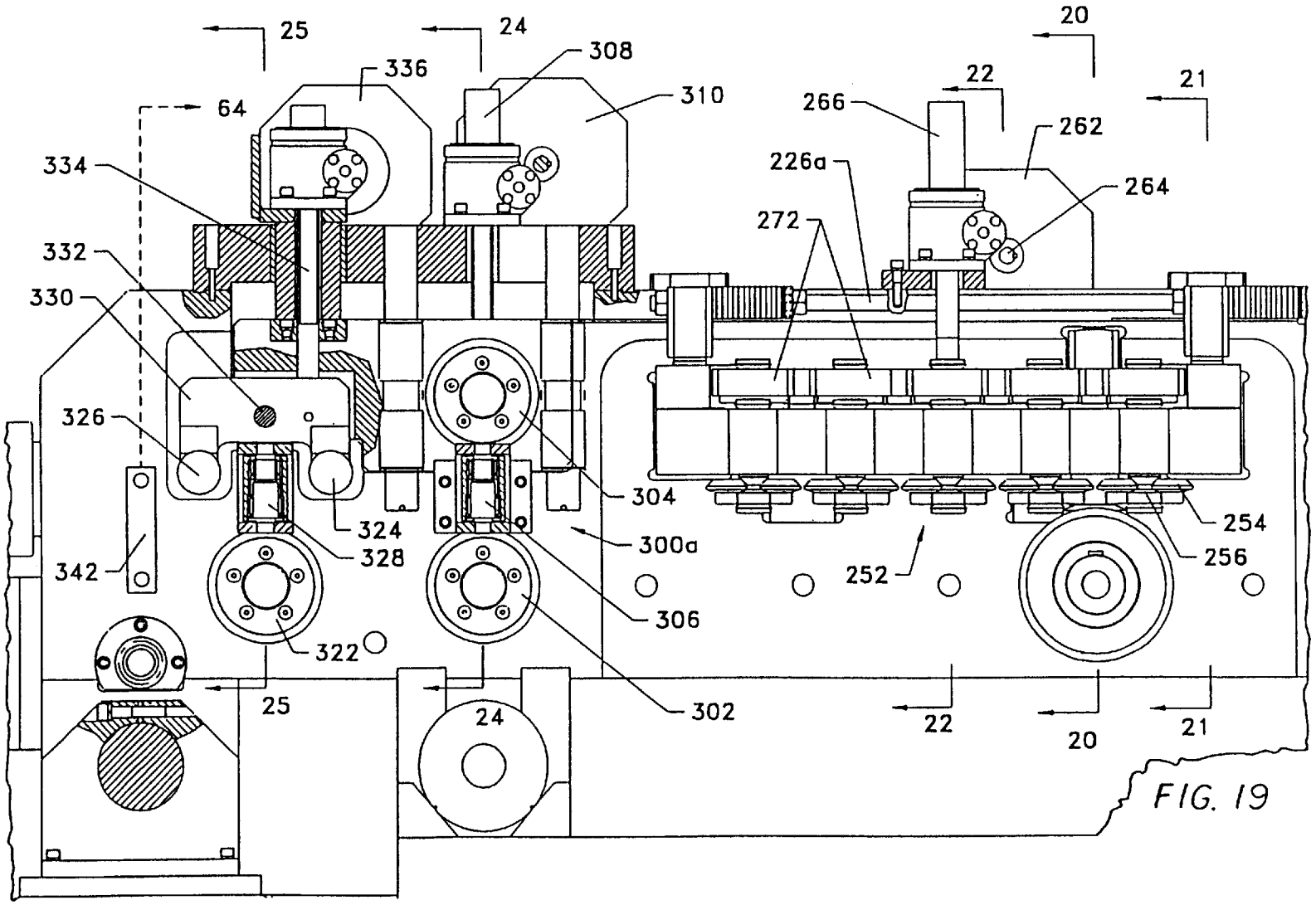
FIG. 19 is a side elevation of area marked 18 in FIG. 16.

The lower roll 322 and side roll 328 in and out together. The two upper rolls are mounted on a generally inverted U-shaped yoke 330, which is pivotally mounted on the axle 332 (FIG. 19).

The yoke can thus tilt about the axle, bringing one of the rolls downwardly and the other roll upwardly and vice versa.

Figure 25:
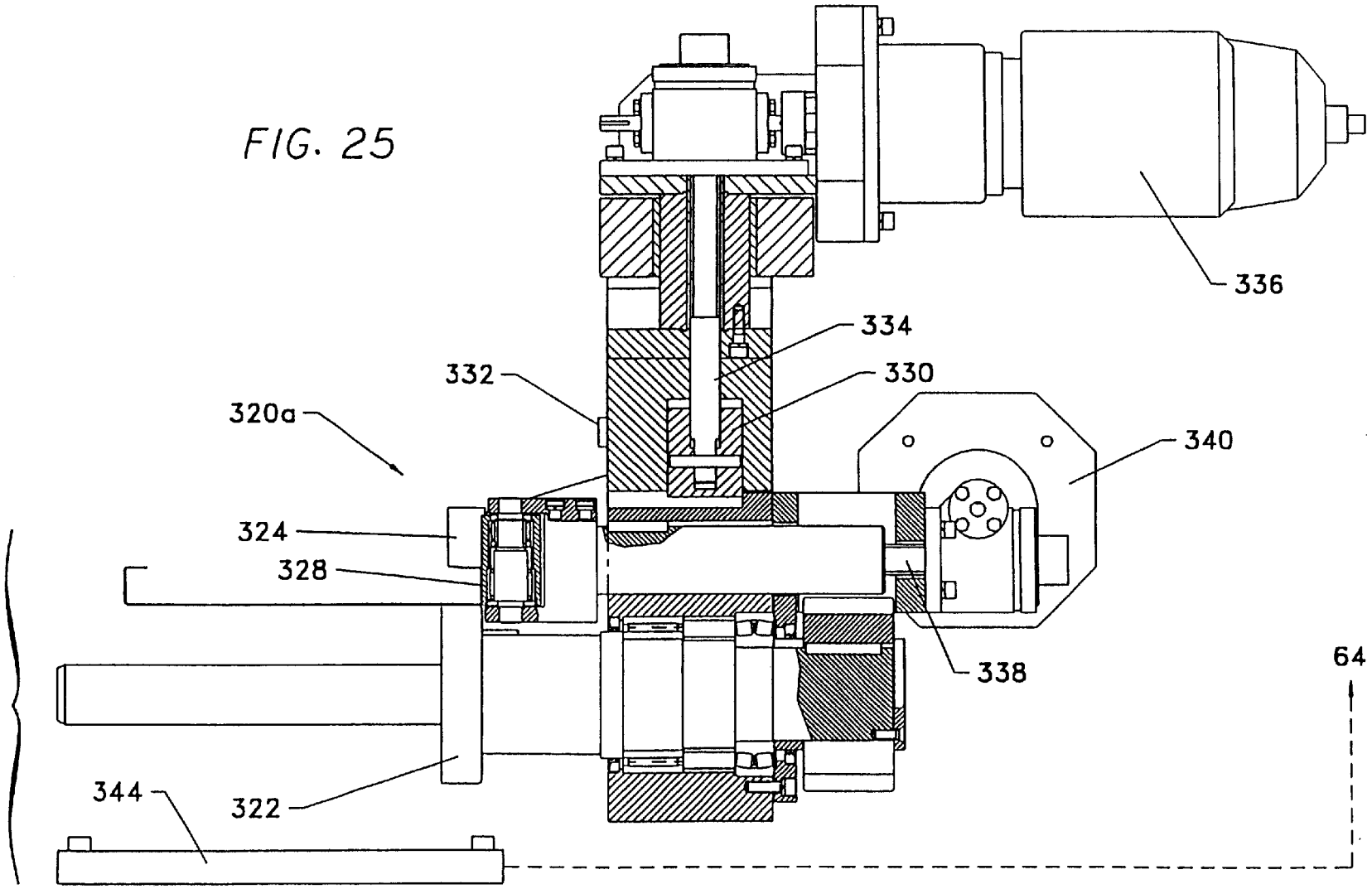
FIG. 25 is a section along the line 25—25 of FIG. 17.
Figure 26:
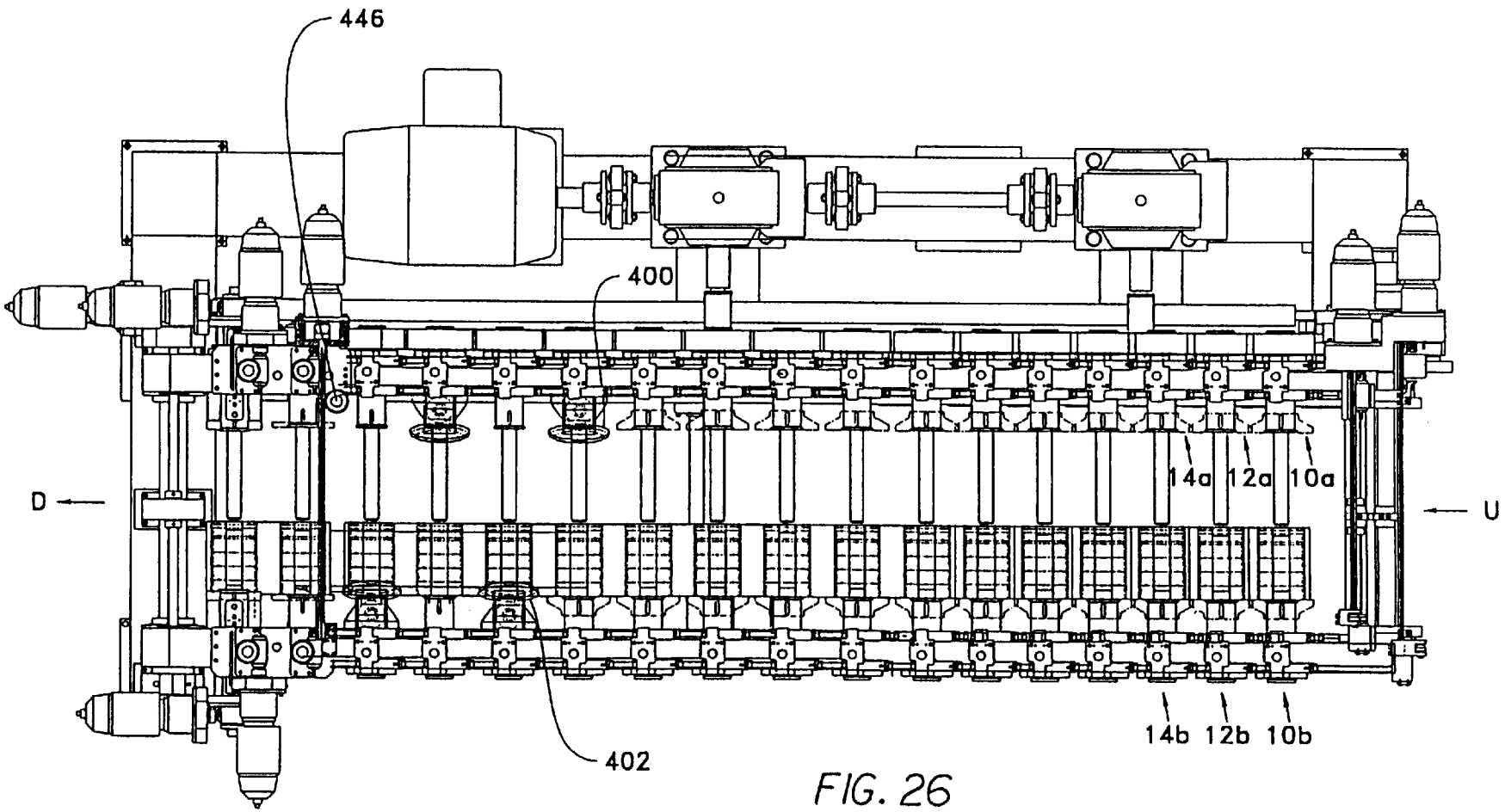
FIG. 26 is a top plan view of a roller die apparatus illustrating a further embodiment of the invention.

Connected to one end of the yoke 330 is a jack screw 334 which is operated by motor 336 (FIG. 25).

Operation of the motor will thus cause the one end of the yoke to either tilt upwardly or downwardly.

Thus if the C-section is tending to warp up, the jack screw 334 will be raised, thereby causing the trailing die 326 to move downwardly, and thus correcting the upward warp of the C-section.

If the C-section is warping downwardly then the jack screw 334 is operated in the opposite way to depress the leading die 324.

The side rolls are also operable from side to side in order to correct any sideways warping. This is achieved by means of the jack screws 338, operated by motors 340. Operation of the jack screw 338 in one direction will cause the side roll 328 to move in one direction and operation of the jack screw in reverse will move the roll in the other direction.

Thus, by operation of the motors 340—340 on opposite sides, it is possible to move the two side rolls 328 and the two bottom driven rolls, one on each side of the C-section, either to the left or to the right, thus straightening any sideways warping.

Warp sensors, such as optical sensors 342 (FIG. 19) and 344 (FIG. 25) are connected to computer 64 and would cause appropriate signals to be sent to motors 336 and 340.

Figure 27:
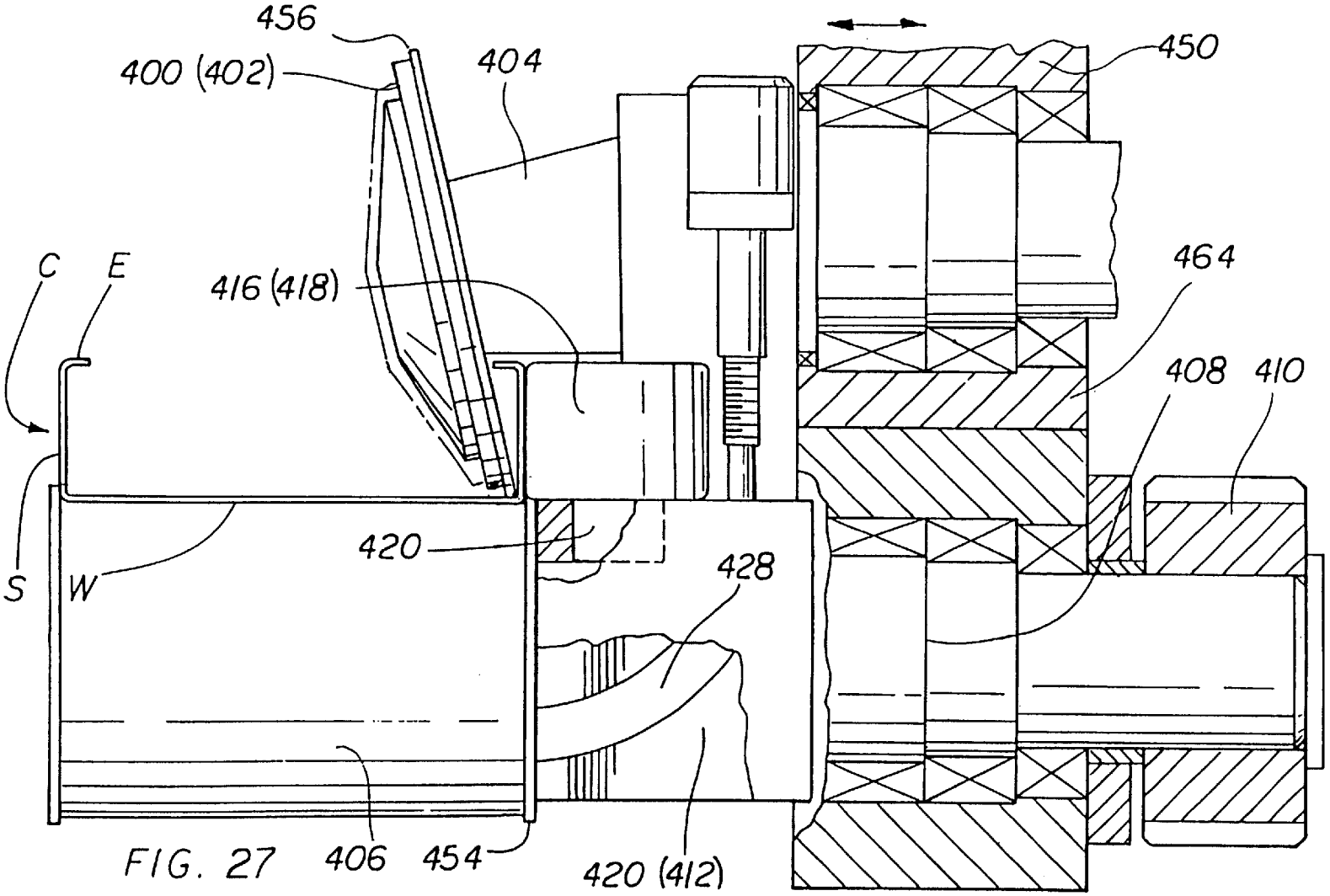
FIG. 27 is an enlarged section along the line 27—27 of FIG. 26, showing one side of the upper angled corner forming dies and side control rolls of the apparatus, and the C-section web, and showing transverse adjustment movement in phantom.

A further embodiment of the invention is illustrated in FIGS. 26 to 30. In this embodiment the workpiece that is intended to be produced is shown in the form of a C-section of rectangular shape indicated generally as C (FIG. 27). It has a generally planar web W, side flanges S, and edge flanges E. The edge flanges, in this embodiment, make a right-angle with the side flanges and the side flanges, in this embodiment, make right-angles with the web.

As the web workpiece passes from the upstream end U down through the stations 10A, 10B, 12A, 12B, etc., the edge flanges E are formed first. At subsequent stations, the side flanges are progressively bent up from the web. This bending takes place progressively, at angles typically of 10 to 20 degrees for each set of roller dies.

When the side flanges S reach angles of about 70 to 80 degrees relative to the web W, the edge flanges E will begin to interfere with the upper roller dies, in each pair of dies so that the side flanges S cannot bend in any further.

In order to complete the last bends of the side flange S from 80 to 90 degrees relative to the web, the invention provides sets of upper angled corner forming rolls or dies 400 to 402, spaced apart from one another along the length of the apparatus for reasons to be described below, and staggered alternately from side to side of the apparatus towards the downstream end D.

The purpose for this is to allow the roller die stands to be moved close together, for forming a workpiece which is relatively narrow. If the pairs of angled corner dies 400 and 402 were registering with one another, instead of being staggered or offset, then it would not be possible to bring them as close together as might be desired to make a narrow web.

As shown in FIG. 27, the upper angled dies 400 and 402 are mounted on angled axle shafts 404. There is no drive mechanism shown, in this embodiment of the invention, since the friction of the workpiece will be sufficient to drive the angled dies 400 and 402. However if required, the upper dies could of course be driven by suitable angled, or universal drives.

The angled rolls or dies 400 and 402 co-operate with respective lower dies 406 which engage the under surface of the web W. The lower dies 406 are driven by any suitable mechanism such as shaft 408 and gear 410. The angled dies can also be driven, through any suitable means such as angle drives of a type well known in the art, and requiring no description.

Because the angle rolls 400 and 402 are angled, and are of substantial diameter, they are able to reach around the in turned edge flanges E, an reach into the corners defined between the web W and the side flanges S. In this way a full 90 degree bend at this point or even greater angle if required is made possible to make the bend of an angle greater than 90 degrees if desired.

As already noted, the angle dies are staggered offset in pairs, so that even when the opposite roller die stands are brought close together for a narrow workpiece, as in the case of the universal and adjustable roller die line described above, the angle dies do not interfere with one another, and consequently this enables great flexibility in use since the apparatus can be used with relatively narrow web workpieces.

The roller die stands are of adjustable design, of the type described above, in which the roller die stands are mounted in continuous solid mounting plates 412 and 414, with the plates being moveable and adjustable towards and away from one another so as to readily accommodate workpieces of different widths as described above.

Figure 28:
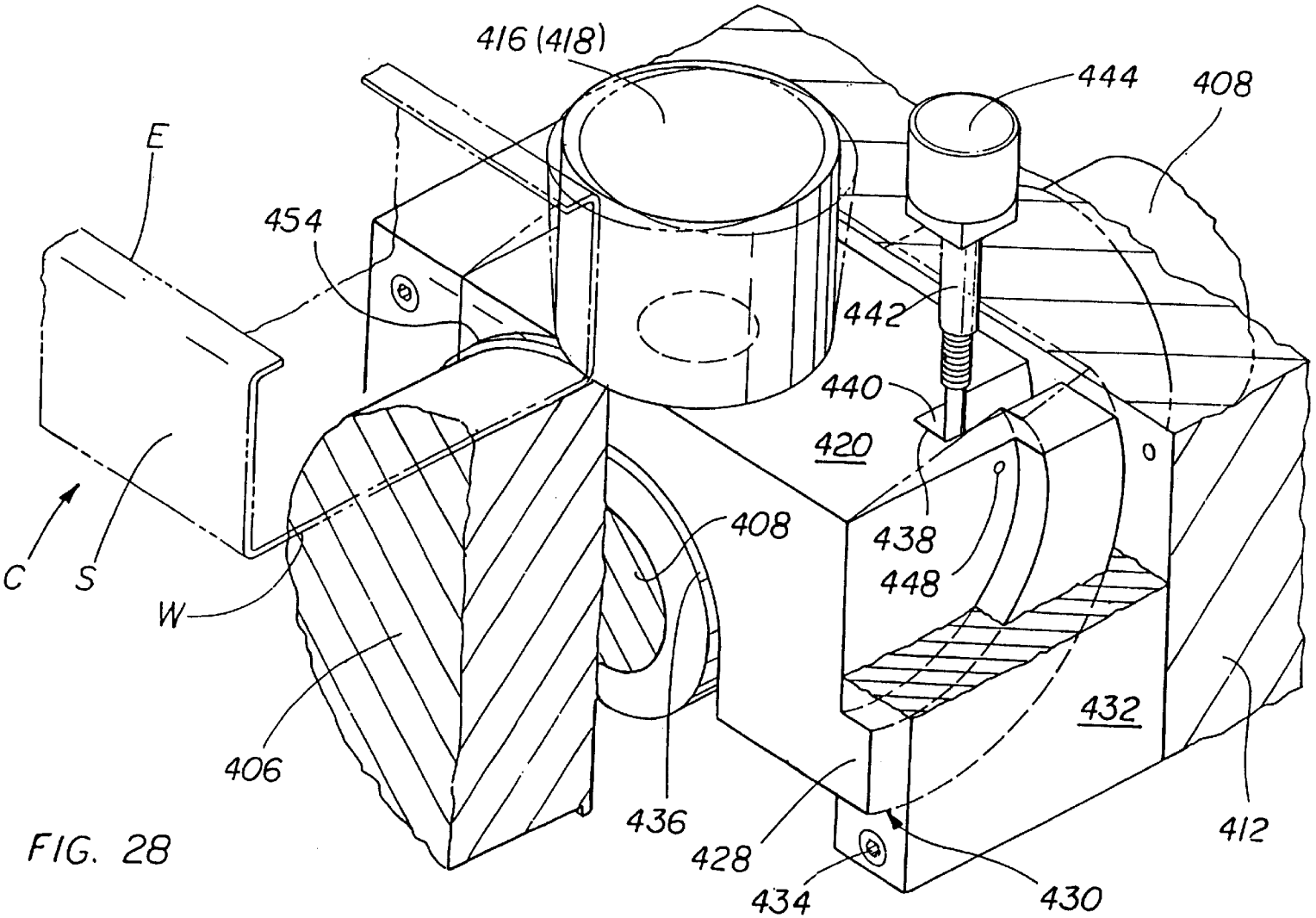
FIG. 28 is a perspective illustration of the mounting apparatus upon which the side control rolls are mounted.
Figure 29:
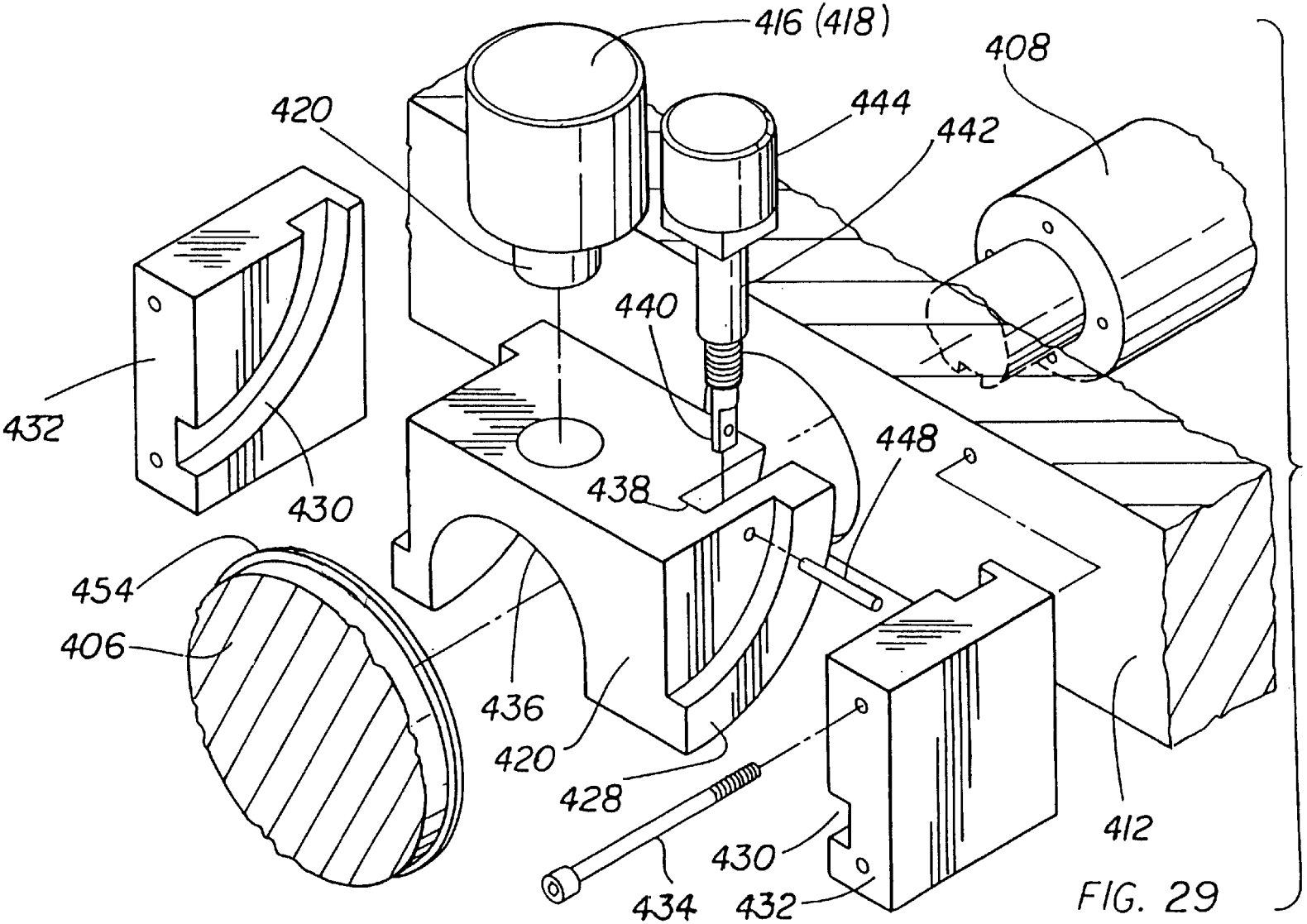
FIG. 29 is an exploded perspective corresponding to FIG. 28.
Figure 30:
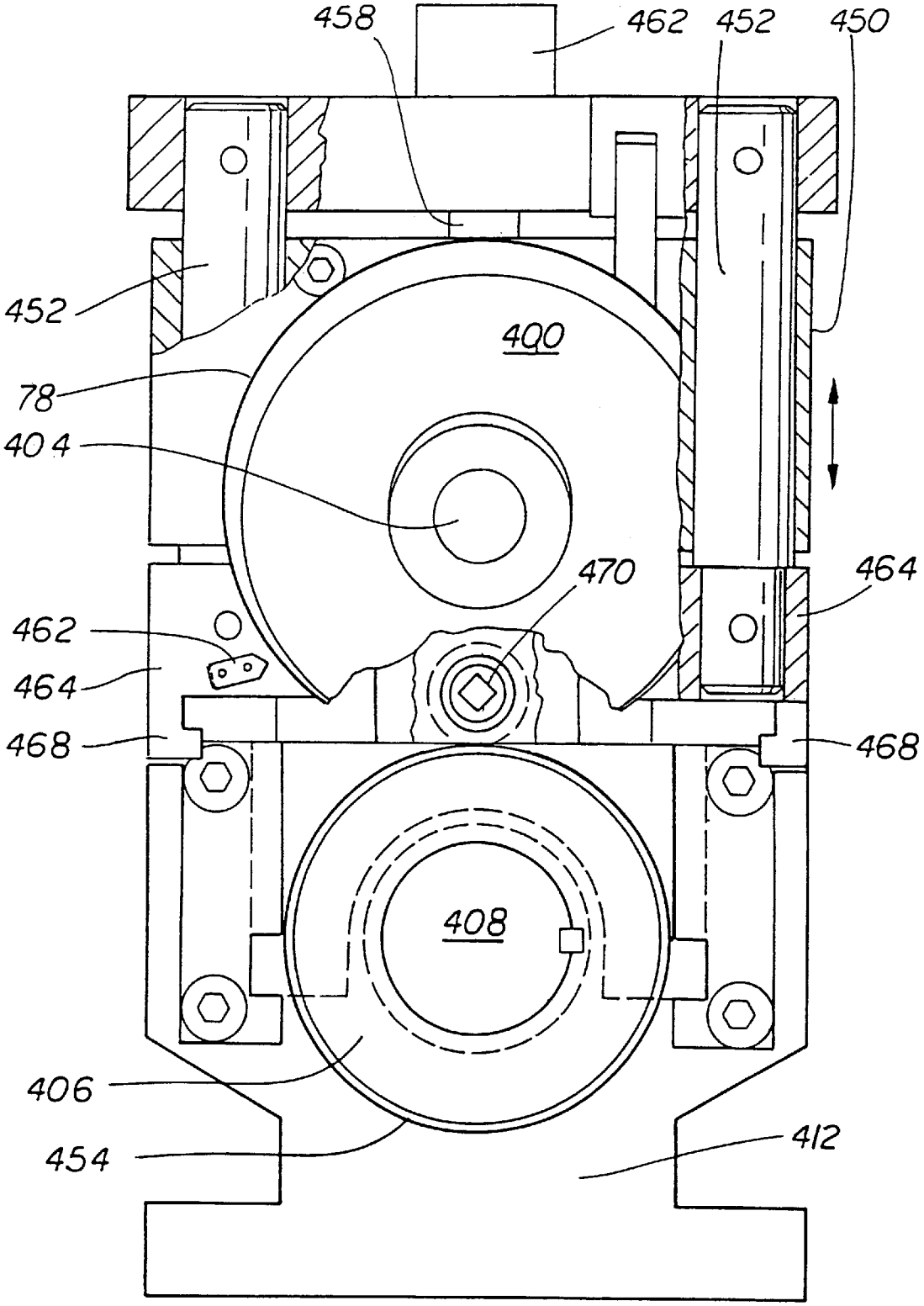
FIG. 30 is a front elevational view of one of the angled upper dies, showing the adjustable mounting and showing vertical adjustment movement in phantom.

In order to hold the precise angle of bend between the workpiece W and the side edges S on each side, a plurality of side edge rolls 416, 418, etc., are provided. The side edge rolls 416 and 418 are freely rotatably mounted on axle shafts 420. As best shown in FIGS. 28 and 29, the axle shafts 420 of the rolls 416 and 418 are mounted in tilting mounting blocks 422. Mounting blocks 422 are formed with arcuate segments 428 on either side thereof. Segments 428 are received within arcuate grooves 430, formed in cheek blocks 432. Cheek blocks 432 are adapted to be secured by bolts 434 to main mounting plates 412–414 of the apparatus.

The mounting blocks 422 are formed with an arch shaped channel 436 there through, to receive the lower die shaft 408.

The mounting blocks 422 are provided with slotted recesses 438. The recesses 438 are designed to receive the lower ends 440 of jack screws 442. Jack screws 442 can be operated by means of electrical motor 444.

In this way, operation of the motors 444 in one direction will cause tilting of the blocks upwardly, and operation of the motors 444 downwardly. This will in turn cause inward and outward tilting of the side dies 416 and 418 (see FIG. 28).

By means of a suitable angle sensor 446 (FIG. 26), the angle of the side flange S relative to the web W can be detected, and any variation can be instantaneously fed back to the motors 444 which will in turn correct the tilt of the side rolls 416 and 418, thus correcting the angle of the side flanges.

The lower ends 440 of jack screws 442 are pivotally secured in slots 438 by means of axle pins 448.

In certain cases it may be desirable to provide for adjustment of the upper corner forming angled dies 400, 402, to allow for changes in the thickness of the web material for example. Such adjustment will be particularly useful when the invention is used in conjunction with the universal type of roll forming line described above (FIGS. 1 and 2), in which all of the roller stands can be continuously adjusted to provide greater or lesser clearance between the dies to accommodate changes in the thickness of the workpiece. Thus the corner forming dies may be mounted on moveable mounting bodies 450. Mounting bodies 450 are mounted on parallel posts 452 extending vertically upward from the plates 412–414.

The lower dies 406 are preferably formed so as to extend the full width of the web of the workpiece and are shaped at each end shaped with a narrow angular rim 454 extending outwardly form the main body of the die 406. The upper die is also formed with a complementary ridge 456. The ridge and the rim cooperate together to lock the corner of the workpiece between the rim and the ridge and thus form a precision shaped angular bend, usually of 90 degrees, at this point.

A screw adjustment 458 (FIG. 30) is provided which can be operated to cause mounting bodies 450 to slide upwardly or downwardly on posts 452. A dial 460 enables a visual check of the setting of the bodies 450. A motor 462 can be provided for operating screw 458. The motor can be connected to the main control console controlling all of the roller die stands (not shown), enabling the entire line to be automatically adjusted on a continuous basis to accommodate changes in web thickness.

In order to adjust the upper dies transversely, the posts or columns 452 are mounted in bases 464, held by rails 468 and 468. The bases can thus be slid transversely to and from. An adjustment screw 470 is provided, which can also be motor driven if desired, by means not shown. Operation of screw 470 will cause transverse sliding movement of base 464 thus adjusting the upper die inwardly or outwardly, as shown in phantom in FIG. 28, relative to the lower die and relative to the side rolls, to allow for variations in web thickness.

A further embodiment of the invention is illustrated in FIGS. 31 to 54.

Figure 31:
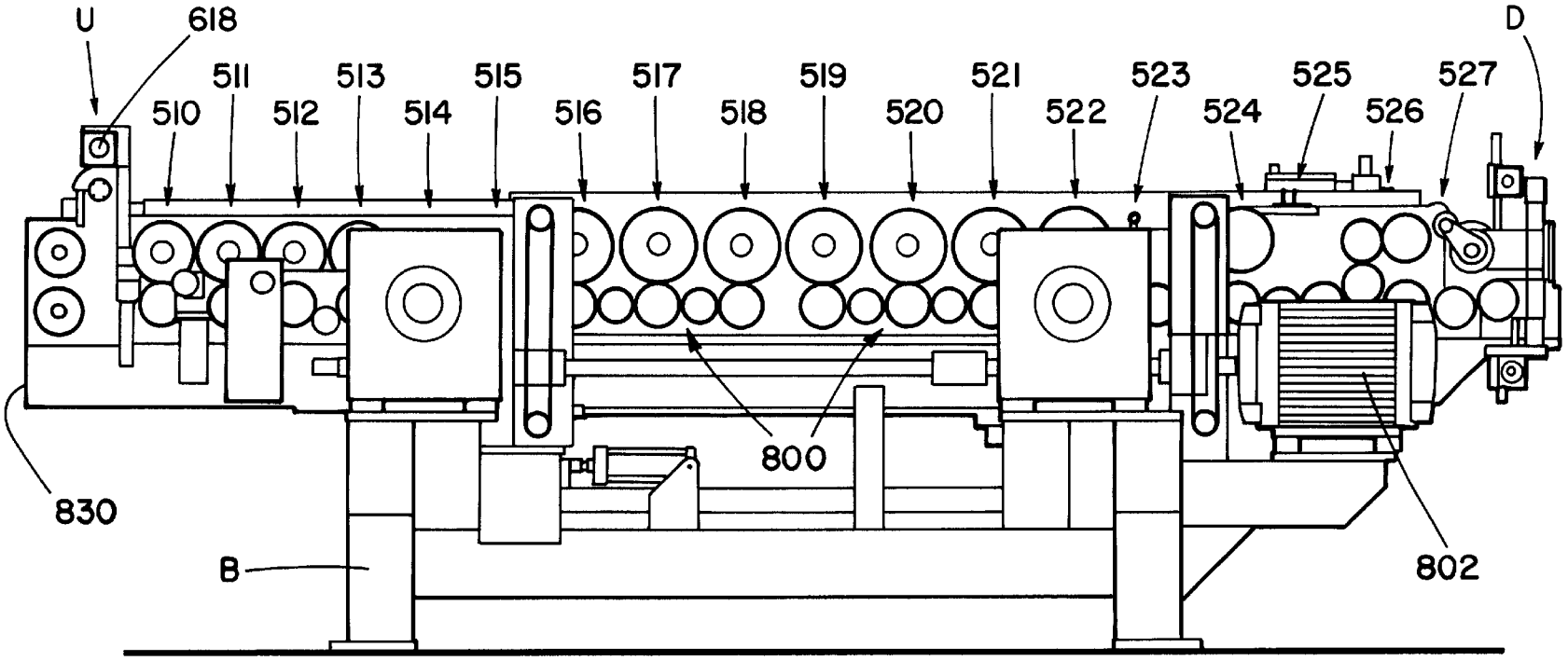
FIG. 31 is a side elevation of a further embodiment of a roller die apparatus for working a web of sheet material illustrating a plurality of roller die stands at spaced apart intervals along the path of the sheet material and controls shown schematically with respective groups of dies indicated as Group 1, 2, 3, 4 and 5.
Figure 32:
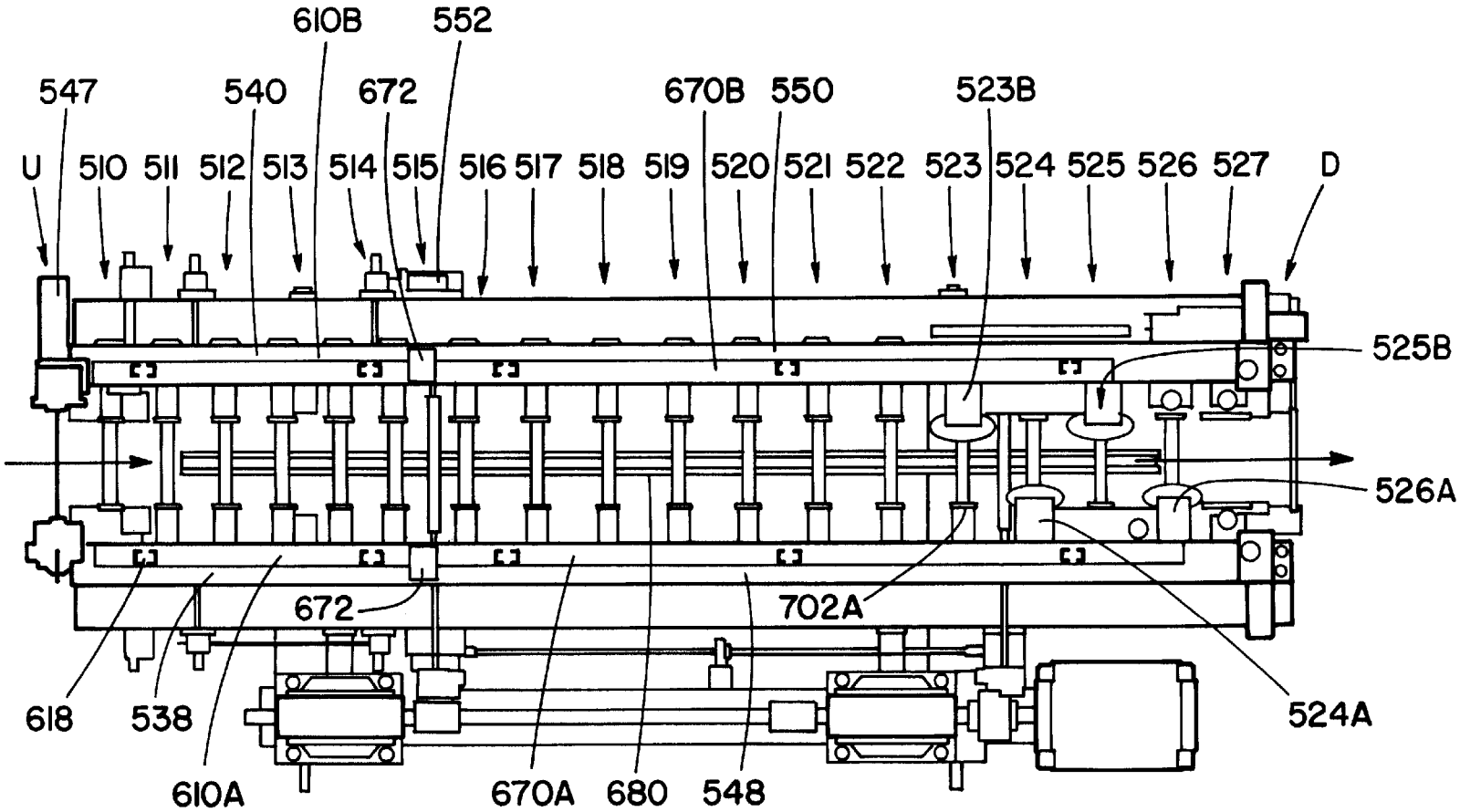
FIG. 32 is a top plan of part of FIG. 31.
Figure 33:
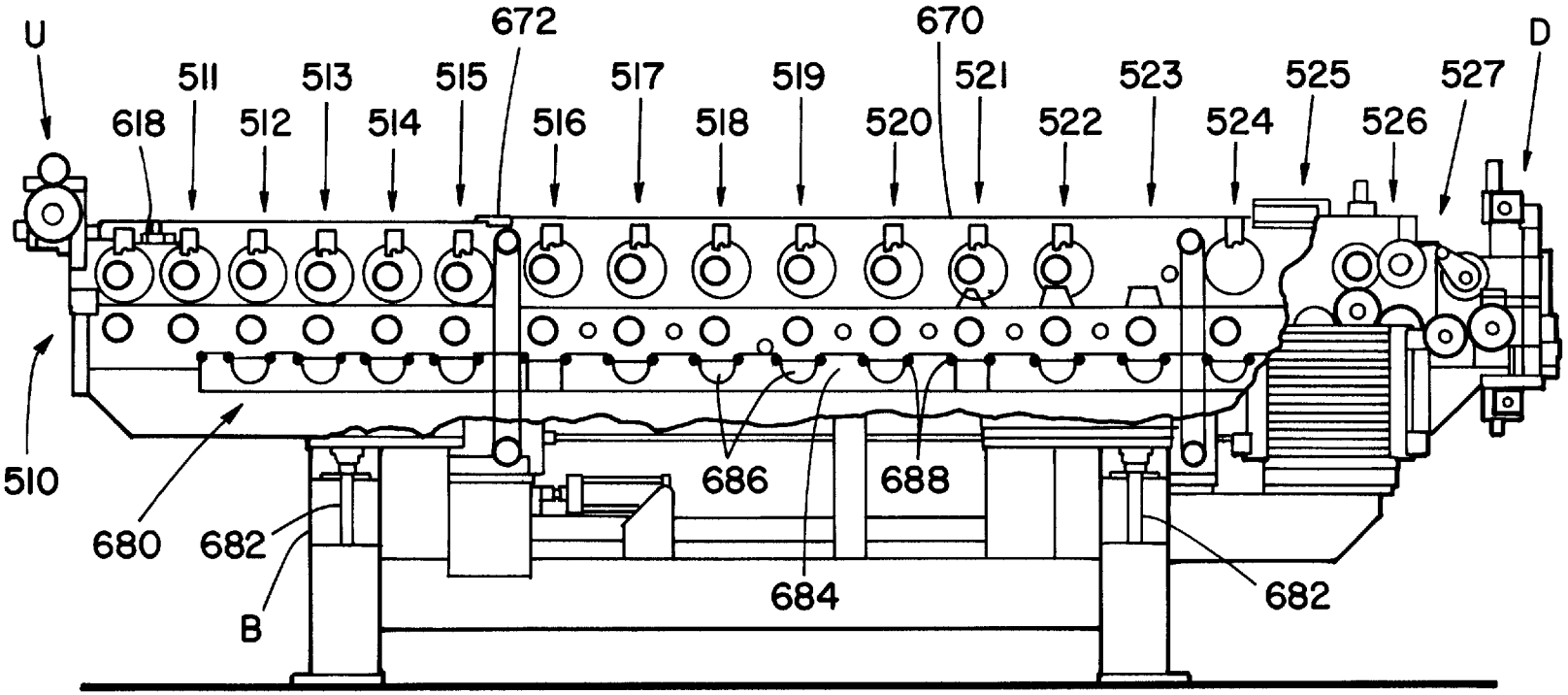
FIG. 33 is a sectional side elevation, along lines 33—33 of FIG. 32 of the roller apparatus of FIG. 31.
Figure 53:
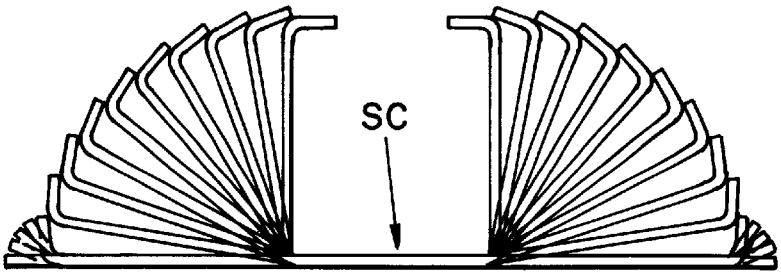
FIG. 53 is a schematic view similar to FIG. 51, showing the progressive bends involved in making a C section member, and, FIG. 54 is an enlarged cut away perspective of the sliding mechanism connecting the control bars together for movement in unison.

The roll forming apparatus which is shown here for the purposes of illustrating this further embodiment of the invention, comprises a base indicated generally as B, defining an upstream end U, and a downstream end D, and the web sheet metal passes from left to right, in FIGS. 31, 32 and 33 from the upstream end U, to the downstream end D, continuously, while being progressively roll formed. Generally the apparatus described may be used for the formation of two different sections, namely a U-section SU (FIG. 52), and a C-section SC (FIG. 53). These Figures illustrate the sequence of progressive bends which are formed as the web passes from one die station to the next.

These two sections are commonly used in construction, and m ay be required to be formed from webs of greater or lesser thickness, depending upon their application, and may be required to be formed with greater or lesser widths and flange dimensions. The apparatus to described enables a wide range of sizes of these various sections to be formed on a single machine, using one single set of dies. Clearly the apparatus can also be used to form webs of other shapes, but in that case some changes in the dies will normally be made to permit this.

Roll forming of the web is performed progressively at a series of roller die stands indicated generally as 510, 511, 512, 513, 514, 515, 516, 517, 518, 519, 520, 521, 522, 523, 524, 525, 526, and 527. The stands are mounted on the base B, in a manner to be described at spaced apart intervals, along the path of the web W. The roller die stands are mounted in five groups. Group 1 is the lead in or pinch roll section where the flat web is gripped and driven along the path of the rest of the rolls. Groups 2 and 3 are forming dies, which function to form the progressive bends in the web. Groups 4 and 5 perform finishing and straightening actions.

Stands 510 forms Group 1.

Stands 511, 512, 513, 514, and, 515 are form Group 2.

Stands 516, 517, 518, 519, 520, 521, and 522 form Group 3.

Stands 523, 524, 525, 526, and 527 form Groups 4 and 5.

Figure 34:
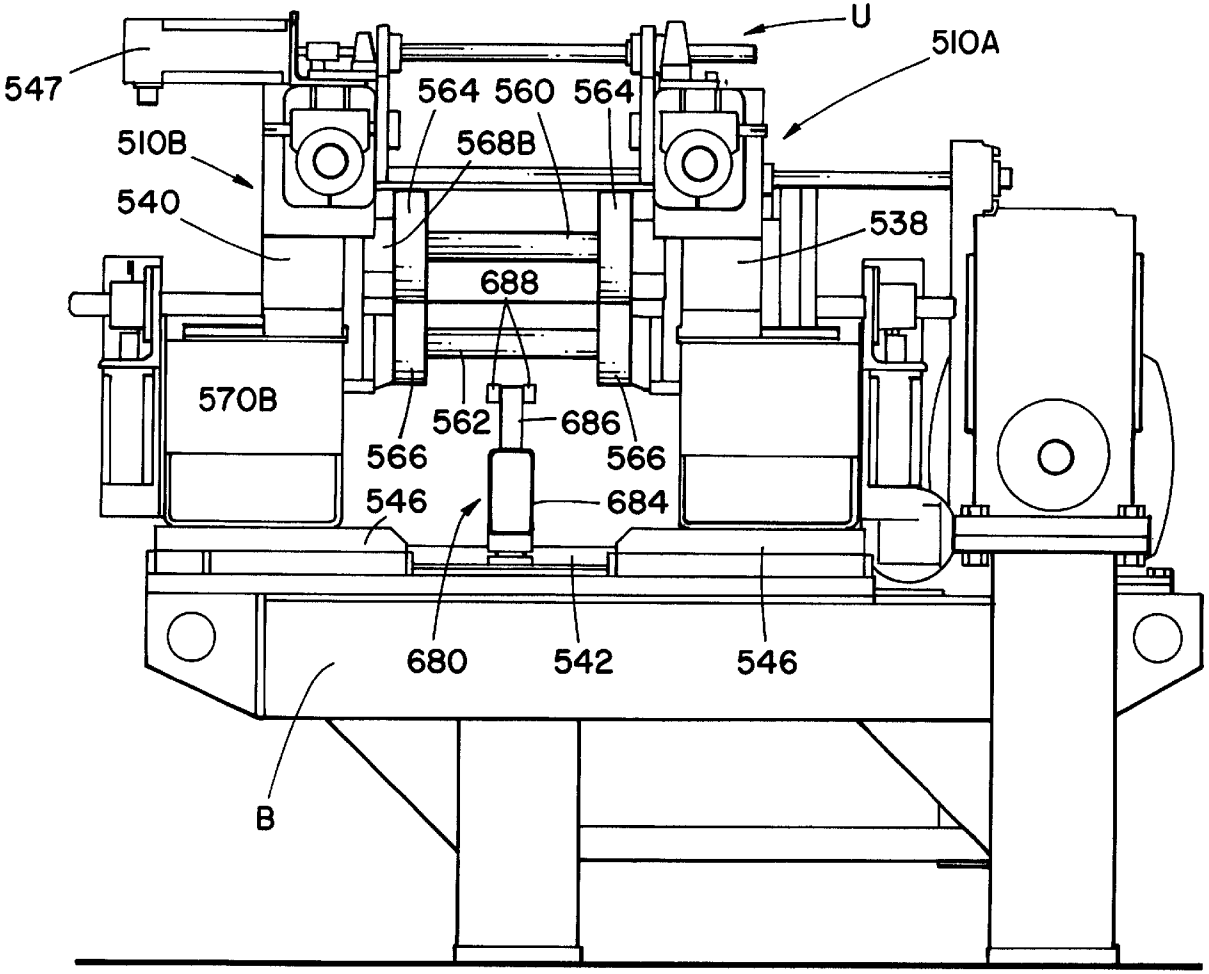
FIG. 34 is a front end view of the roller stands, and the transverse movement mechanism.

Each pair of stands is designated as 510A, 51GB, 511A and 511B, etc (FIG. 34).

The stands 510A and 510B, forming Group 1 and stands 511 to 515 forming Group 2 are mounted on respective continuous side plates 538 and 540, (FIG. 32), the lower edges of which are slidably mounted on base B on a transverse upstream guide rail 542 (FIG. 4) and downstream guide rail (not shown), and guide shoes (not shown). Transverse power drive means 546 operates to move the plates 538 and 540 together or apart.

In this way the plates 538 and 540 can be slid towards and away from one another, to accommodate webs of varying widths.

Groups 3, 4, and 5 of the stands are mounted on side plates 548 and 550, which are separate from side plates 538 and 540 and can be moved towards and away from one another as described below. Plates 548 and 550 can be slid towards and away from one another independently of plates 538 and 540, on respective guide rails and guide shoes (not shown) similar to guide rail 542. Transverse power drive means 552 drive plates 548 and 550 towards or away from one another.

Groups 1 and 2 of the die stands can thus be moved towards and away from one another, independently of the movement of Groups 3, 4 and 5.

The invention will now be described with reference to these separate groups of die stands.

Group 1

Figure 35:
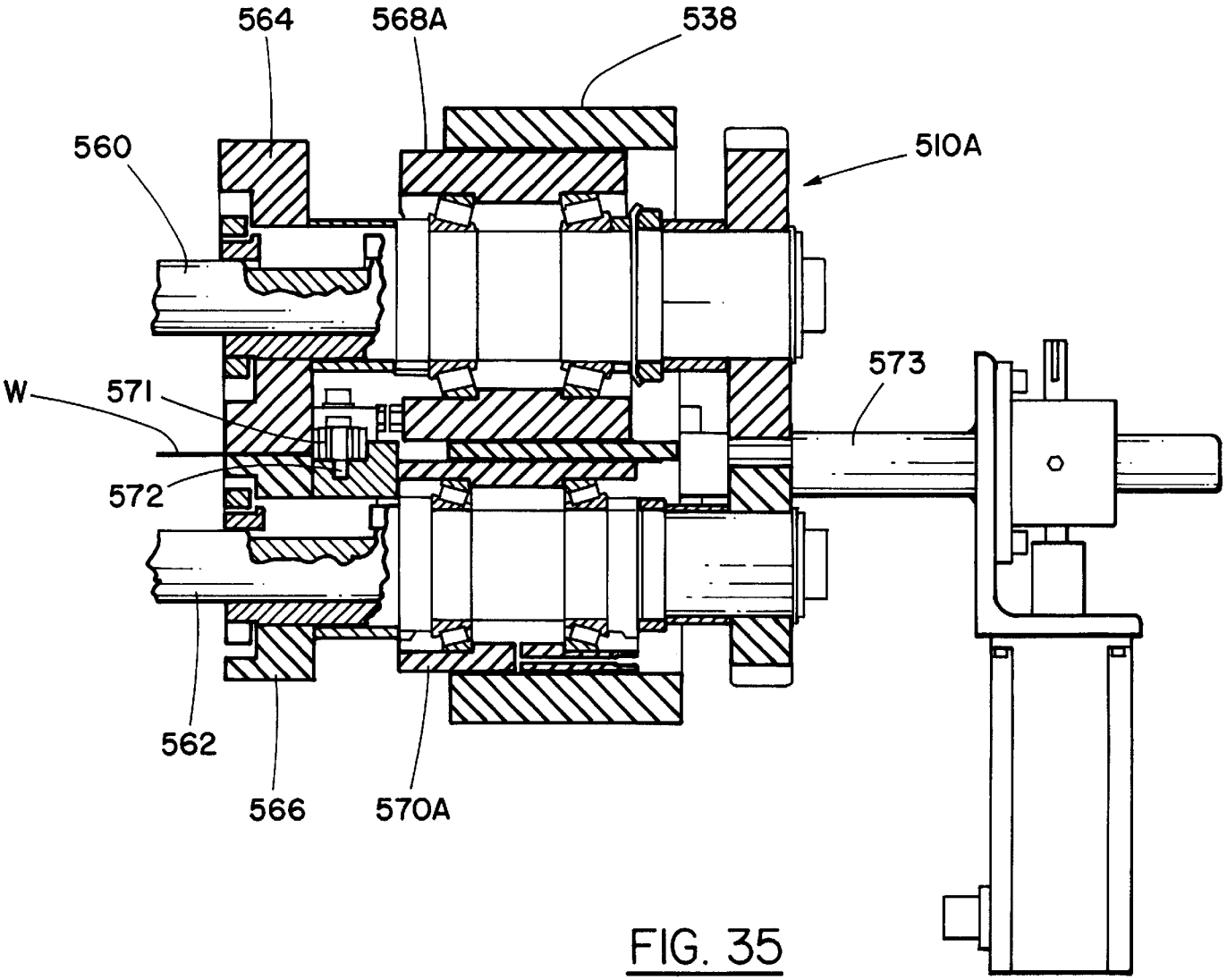
FIG. 35 is a cross section of initial upstream pinch rolls forming Group 1 of the roller die apparatus of FIG. 31 at the line 34—34.
Figure 36:
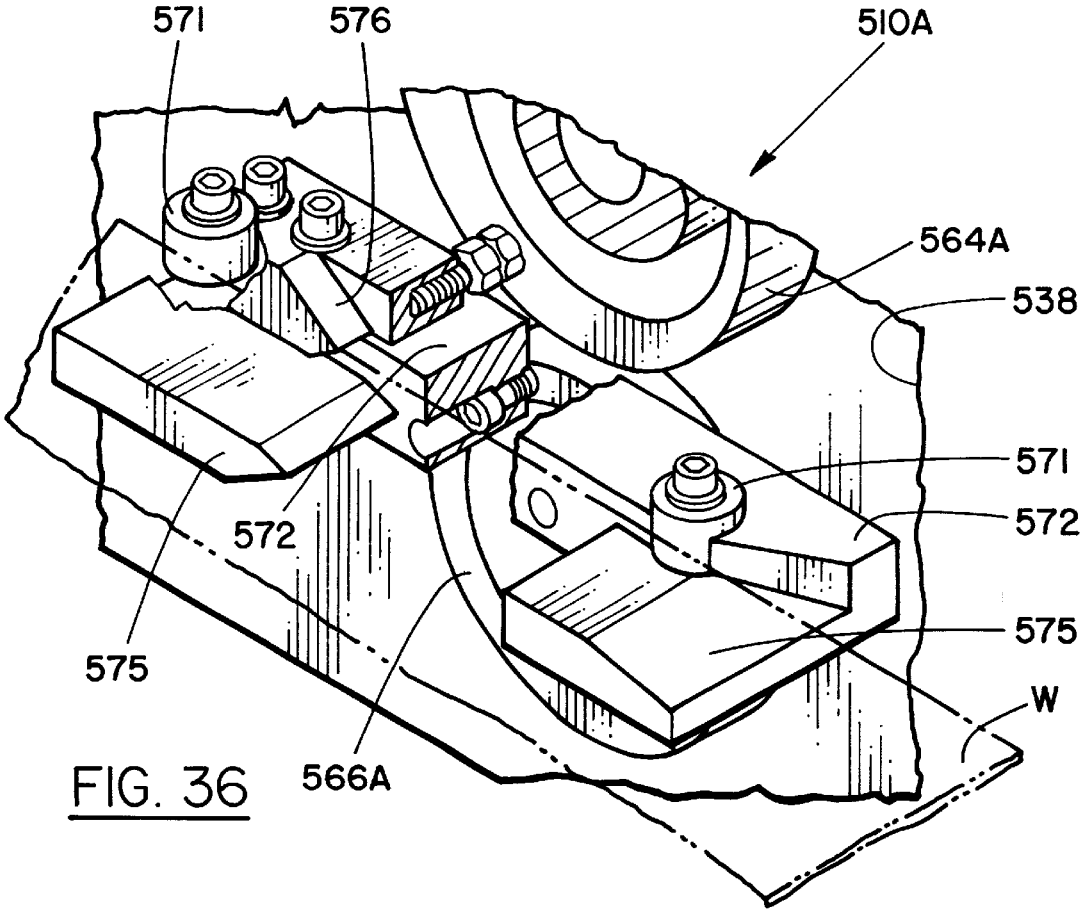
FIG. 36 is a cut away perspective of a portion of the pinch rolls of FIG. 34.
Figure 37:
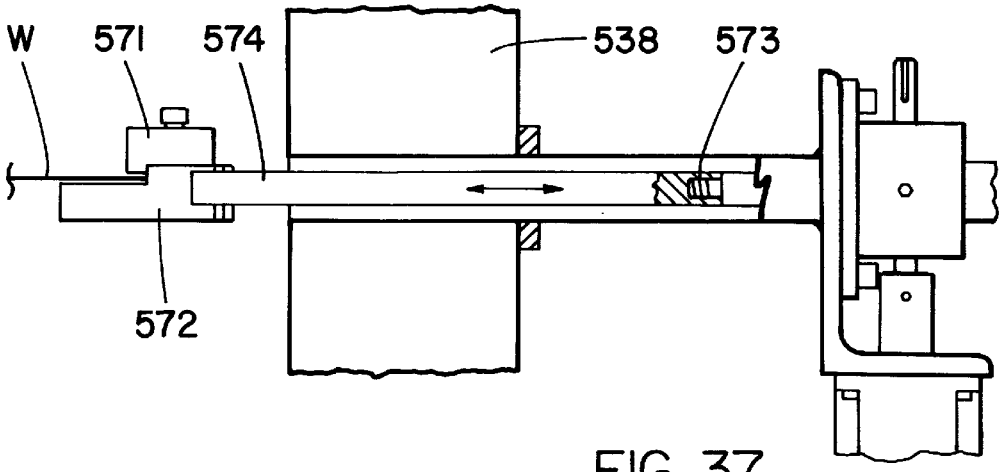
FIG. 37 is a cross section of a portion of the pinch roll mechanism of FIG. 34.

The stands 510A, 510B, of Group 1 (FIGS. 34, 35, 36, and 37 ) consist of upper and lower transverse drive shafts 560 and 562. Upper and lower dies 564 and 566 are mounted on their respective shafts, and the shafts are mounted in slidable upper and lower bearing sleeves 568, 570. The sleeves are slidably supported in plates 538 and 540 and support the shafts for upper and lower dies 564 and 566. Shafts 560 and 562 slide telescopically in the sleeves 568B and 570B, in plate 540 and are fastened in sleeves 568A and 570A in plate 538 (FIG. 35). Suitable drive gears (described below) drive shafts 560 and 562 in their sleeves, so that the upper and lower dies in stands 510A and 510B are driven in unison. The first dies 564, 566 form pinch rolls and are of cylindrical shape in profile, so as to simply grip the upper and lower surfaces of the sides of the web where it enters the machine and ensure a positive feed of the web towards the downstream dies. In order to assist in this function edge guide rolls 571 are mounted on blocks 572 (FIG. 35) and rotate on vertical axes. The edge guide rolls contact the side surfaces of the upper dies 564, and are driven by frictional contact with dies 564. In this way a positive edge guide function on the side edges of the web is achieved by the guide rolls 571 which are frictionally driven at the same speed as the pinch roll dies 564, 566 themselves.

Upper and lower bearing sleeves 568A and B and 570A and B are mounted in shaft openings in plate 538 which permit transverse sliding of the sleeves and shafts for reasons to be described below.

The upper and lower sleeves 568 and 570 are coupled to blocks 572 which are connected to respective jack screws 573 (FIG. 37) by rods 574 and can be slid inwardly and outwardly relative to their plates 538 and 540, by means of jack screws 573.

Blocks 572 are further provided with lower guide wedges 575 and upper guide wedges 576 which ride below and above the edges of the web as it passes through the pinch rolls.

Pinch rolls 564A and B, 566A and B can thus be moved inwardly together, by moving plates 538 and 540 together, and can also be moved inwardly and outwardly independent of plates 538 and 540 by jack screws 573 and blocks 572.

This is of importance when changing over from fabricating a U section to fabricating a C section, or vice versa, for reasons which will be described below.

Group 2

The die stands in Group 2, namely stands 511, 512, 513, 514 and 515 (FIGS. 38, 39, 40) are different from stands 510A, 510B but are of an identical design to one another, except for the shaping of the dies themselves which will vary progressively from one stand to the next in known manner. In stands 511 to 515, lower die drive shafts 580 are supported by suitable bearings directly in side plate 538 . These drive shafts are driven by a suitable gear train described below, and support lower forming dies 582A. Telescoping driven shafts 584 extend from drive shafts 580 to driven hubs (not shown) rotatably mounted in side plates 540, and driven shafts 584 extend completely through these driven hubs. Lower forming dies 582 are supported on such driven hubs. In this way the lower forming dies of all of stands 511 to 515 are driven in unison. Upper dies 586 A,B in each of stands 511 to 515, are carried on upper shafts 588. Eccentric bearing sleeves 590A which carry upper shafts 588 are both slidably and rotatably mounted in plate 538. Sleeves 590A define shaft openings 592 which are offset (FIG. 38) from the central axis of the sleeves 590A for reasons described below. Upper die shafts 588 are driven by a gear train connected to the lower shafts to be described below. Telescopic driven upper shafts 594 are received in die shafts 588A and extend through die hubs (not shown) mounted in plate 540 for carrying upper dies 586B. These hubs are mounted in eccentric sleeves (not shown), mounted in plate 540, which are similar to sleeves 590 A mounted in plate 538. Upper dies 586 A are carried on shafts and upper dies 586B (FIG. 33) are supported on hubs (not shown), and dies 586A and B are thus driven in unison.

In accordance with the present invention, as explained above, there is provided means for adjusting at least one of the upper and the lower dies relative to the other, so as to adjust the vertical clearance between the dies, to match the thickness or gauge of the web material as closely as possible. Such adjustments in accordance with the invention can be made while the web is actually running through the dies, thus compensating for variations in the thickness of the web along its length, all of which will be described below. In this embodiment of the invention, it will be seen that it is the upper dies that are all adjustable relative to the lower dies which are on fixed axes. However it will be appreciated that the lower dies could be made adjustable and the upper dies remain fixed if that was thought to be desirable.

As explained above each of the upper shaft sleeves 590 have eccentric shaft openings 592 for receiving die shafts 588A and the driven hubs (not shown) in plate 540. Each sleeve 590 is supported in a respective opening in respective plates 538 and 540.

Figure 38:
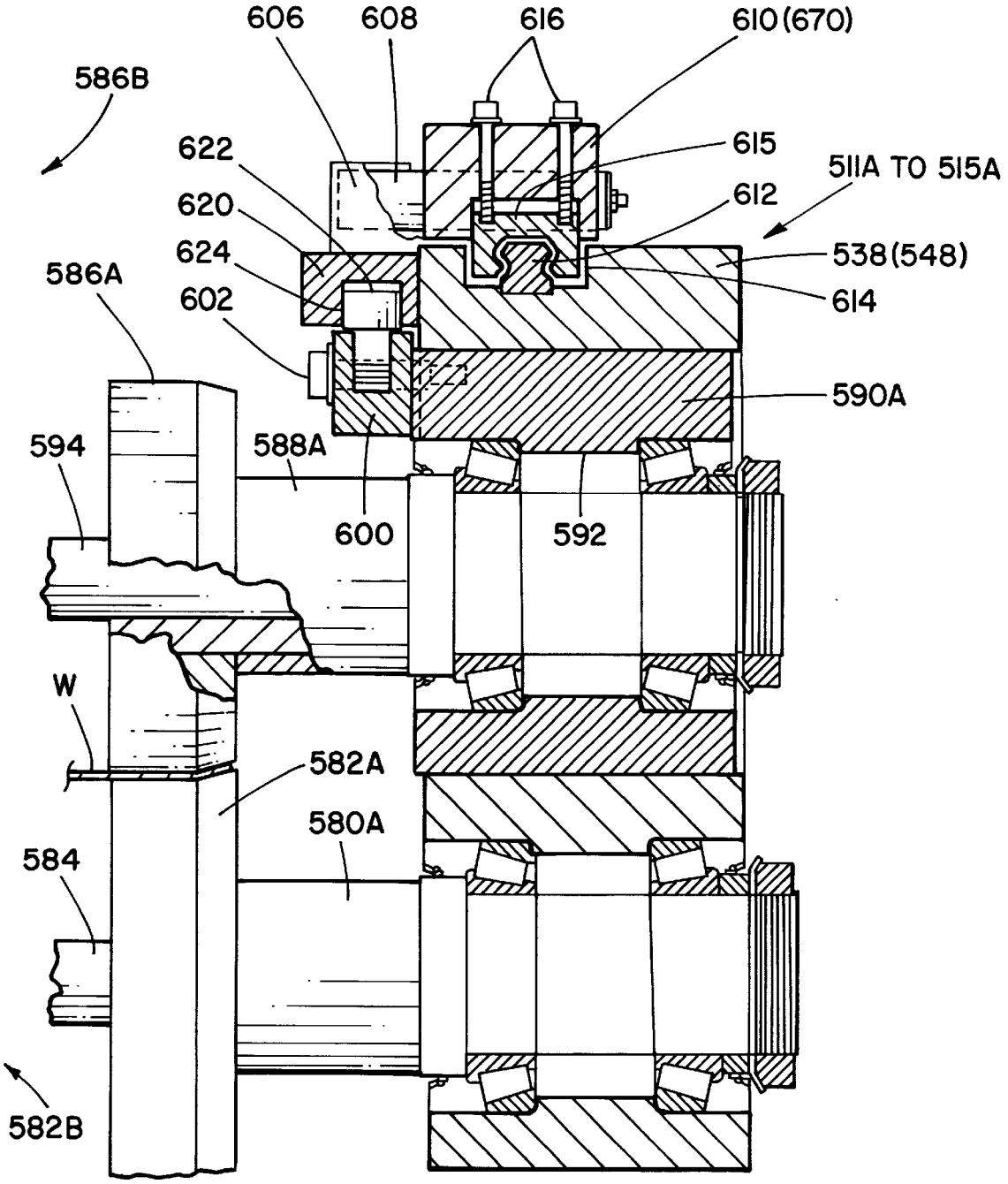
FIG. 38 is a cross section of one roller stand of Groups 2 or 3, sectioned along the line 37—37 of FIG. 32, and showing details of the upper die movement means.
Figure 39:
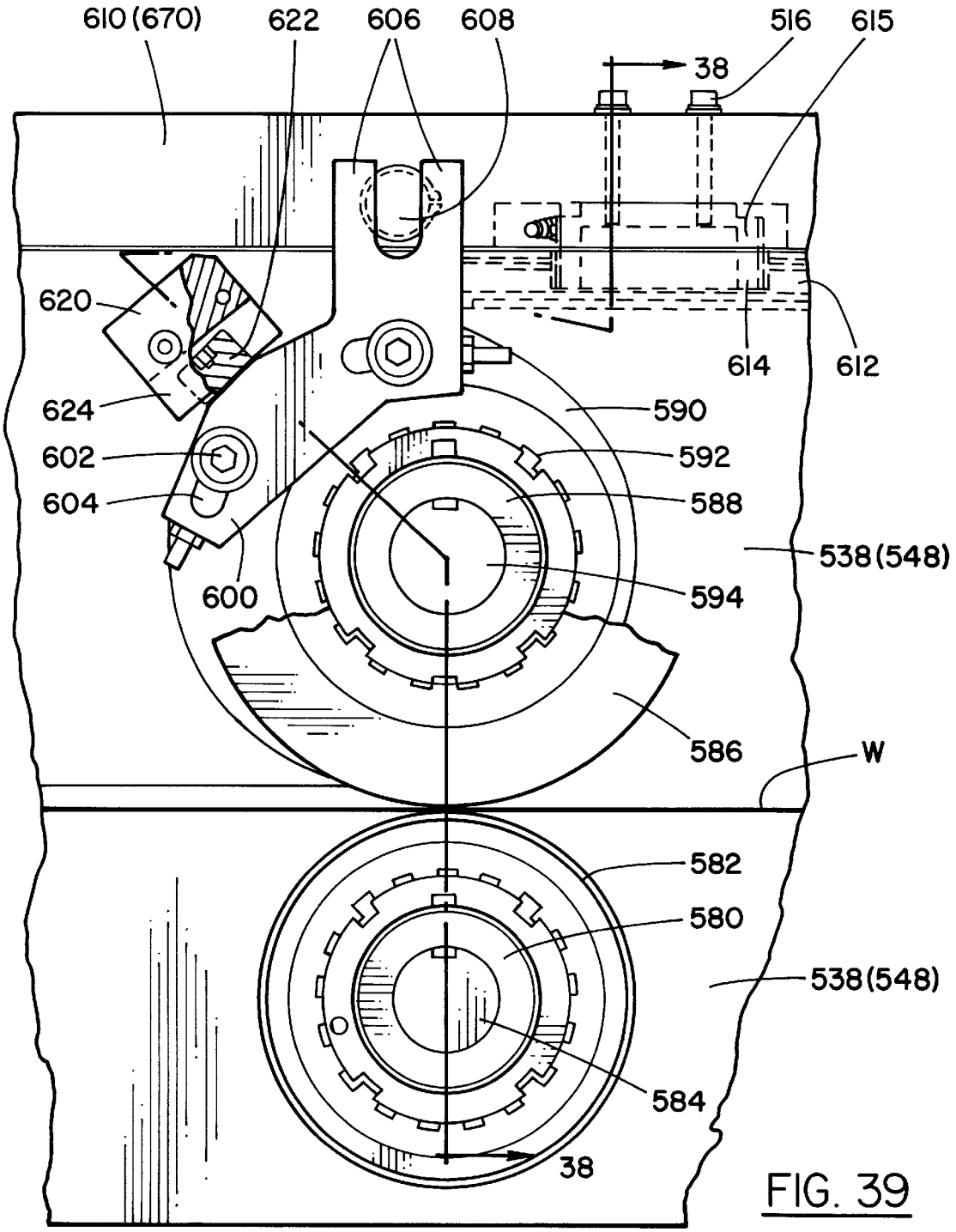
FIG. 39 is a section corresponding to a portion of FIG. 37 along line 38—38 of FIG. 37.
Figure 40:
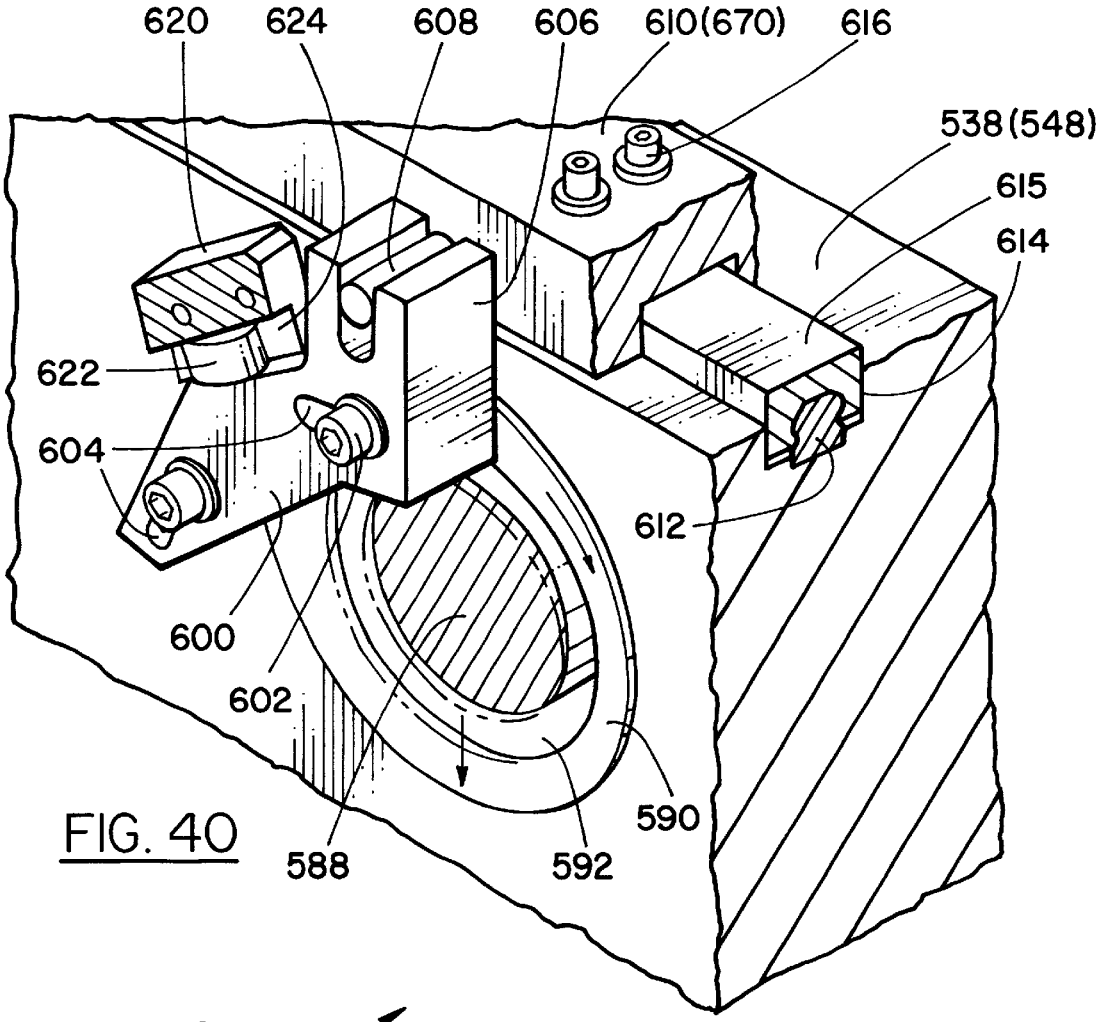
FIG. 40 is a cut away perspective of the adjustment mechanism of FIG. 36 and showing movement of the upper die.
Figure 41:
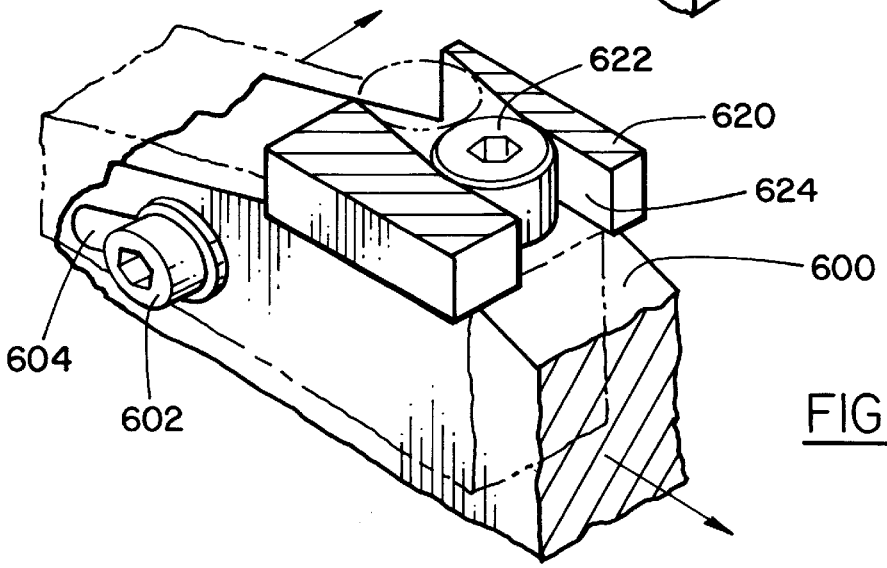
FIG. 41 is a cut away perspective showing further details of the adjustment mechanism of FIG. 39, showing further movement of the upper die to procure movement on a diagonal axis.

Sleeves 590 are able to rotate in their plates 538 and 540, in a manner to be described below, and thus cause upward and downward semi arcuate movement of upper die shafts 588 and their dies 586. The sleeves 590 are also adjustable axially, ie. inwardly and outwardly, this produces what is in the end an adjustment of the upper dies along diagonal axes relative to the web to accommodate minor variations in the web thickness as it passes both through the horizontally opposed faces of each die pair, as well as through the angularly opposed faces of the die pair. The mechanism by which this adjustment is achieved is best seen in FIGS. 38, 39, 40, and 41. Referring to FIG. 39 each sleeve 590 is connected to a semi arcuate control body 600. Two bolts 602 pass through arcuate slots 604 in body 600 and are bolted into the sleeve 590. Control body 600 is formed with a pair of upwardly directed guides 606 which define a U shaped slot. An adjustment pin 608 is received in the U shaped slot of guides 606. Pin 608 extends sideways from an adjustment bar 610 which extends along the top of plate 538. The identical structure is provided for the opposite sleeve (not shown) which is mounted in plate 540. An identical bar 610B extends along the top of plate 540.

Pins 608 are located at spaced intervals along bar 610 at spacings corresponding to the locations of sleeves 590 . Adjustment bar 610 is guided at intervals along plate 538 by rails 612 located in channels 614 formed in the top of plate 538. Slide shoes 615 engage rails 612 and bolts 616 secure shoes 615 to bar 610. A suitable power mechanism 618 (FIGS. 32 and 33) at one end of bar 610 pushes or pulls it to provide the adjusting movement. As the bar moves it will force pin 608 located between guides 606 to rotate body 600 through a small angular extent, an arc of one or two degrees in most cases being sufficient. This will in turn force the rotation of sleeve 590 through the same arc. Since the sleeve 590 carries the die shaft 588 off centre in an eccentric manner shaft 588 will swing upwardly or downwardly a fractional amount, which will be sufficient to adjust for the variations in thickness of the web. This explains the adjustment transverse to the shaft axis. Adjustment along the shaft axis is also provided. This is produced by the block 620 secured to plate 538 and the cooperating roller 622 bolted to body 600. Block 620 is formed with a generally diagonal slot 624 (FIG. 41), which receives roller 622. When body 600 is moved by pin 608 so as to produce the small angular adjustment, it also causes roller 622 to move along slot 624. The axis of slot 624 is angled along a diagonal axis so that roller 624 must move along that angled axis. This will cause body 600 to move towards or away from plate 538. Sleeve 590 to which body 600 is attached will thus be forced to slide into or out of plate 538. Again, the actual degree of movement is slight, but it is sufficient to produce the adjustment in die clearance required to accommodate variations in the web thickness. Movement of the body 600 caused by roller 602 and slot 604 will cause guides 606 to slide outwardly or inwardly relative to pin 608 but again the degree of movement will be slight. It will thus be seen that by this mechanism movement of the single control bar 610 will cause simultaneous movement of sleeve 590 both transverse to its axis and also axially along its axis. These two degrees of movement will translate into movement of the upper dies 586 along diagonal axes relative to the lower dies 582. The bolts 602 can be loosened, and the body 600 can be adjusted by sliding the slots 604 relative to the bolts which can then be tightened once more. This enables the machine to be set up prior to operation to the optimum die clearance for a particular thickness of web.

Group 3

The third group of die stands consists, in this embodiment of stands 516 to 522. It will of course be appreciated that the number of stands in each group will depend on the purposes for which the machine is designed, and the numbers shown here are purely by way of example, and without limitation. As mentioned above stands 516 to 522 are supported on side support plates 548 and 550 which are separate from plates 538 and 540 and can thus be adjusted separately as required. Plates 548 and 550 are slidably mounted on transverse rails (not shown) which are supported on base B. By suitable power operated means, described below, the side plates 548 and 550 can be slid towards or away from one another, so as to accommodate webs of various different widths, or to form sections having various different dimensions. For example when forming a U section member only two bends are required in the web. Stands 511 to 515 (Group 2), on plates 538, 540, can thus be moved apart so that their dies do not contact the web. The forming of the U section would thus start at stand 516. On the other hand, when forming a C section four bends must be formed. In this case stands 511 to 515 (Group 2) will form the two outer bends in the web. Stands 516 to 522 will form the two inner bends. Compare the U section bends in FIG. 52 with the C section bends shown in FIG. 53. Each of stands 516A, 516B and 517A, 517B etc are of identical construction to one another, apart from the actual dies carried by the stands, which will have profiles which vary progressively in known manner so as to form the web in a progressive continuous fashion, as is well known in the art. Each of die stands 516A and B, to 522A and B are adjustable relative to one another in the same way as the die stands 511 and 515 are adjustable (FIGS. 38, 39, 40 and 41). For the sake of simplicity therefore reference will be made to FIGS. 38, 39, 40 and 41, and the parts of die stands 511 to 515, which are common to stands 516 to 522, will be given the same reference numbers, for the sake of simplicity. Thus each of stands 516A etc, have lower die drive shafts 580, carrying lower dies 582A. Shafts 580 are mounted directly in plates 548, in suitable bearings, and are driven by a suitable gear drive to be described below. In plate 550 lower die hubs (not shown) are mounted directly in plate 550, in suitable bearings, and carry lower dies 582B. Driven shafts 584 slide telescopically into shafts 580, and extend completely through the hubs in plate 550, for reasons to be described. In this way lower dies 582A and B (FIG. 38) are driven in unison.

Upper die 586A is mounted on upper die drive shafts 588 mounted in eccentric sleeves 590A. Sleeves 590A have openings to receive shafts 588 which are offset from the central axes of sleeves 590A, for reasons to be described. Sleeves 590A are both rotatable in plate 548, and are also capable of axial sliding relative to plate 548, for the purpose of adjusting die clearances as will be described below. In plate 550 the die hubs (not shown) are rotatably mounted in sleeves 590B (FIG. 33) similar to sleeves 590A in plate 548 (FIG. 38). Shafts 588 and their hubs carry upper dies 586A and B. Sleeves 590B have hub openings (not shown) which are offset relative to the central axes of their hubs in the same way as in sleeves 590A. Sleeves 590B are rotatable in plate 550, and are also slidable axially relative to plate 550, for the purposes of adjusting the die clearances in a manner to be described below. Upper die drive shafts 588 and their hubs are connected by driven shafts 594 which are telescopically received in drive shafts 588 and which extend completely through their hubs (not shown), for reasons to be described. It will be understood that the Group 3 die stands 516 to 522 can be brought towards one another or away from one another by sliding movement of plates 548 and 550. This movement is independent of similar movement of die stands 510 to 515 which is achieved by moving plates 538 and 540 towards and away from one another. However all of the upper dies in stands 516 to 522 are adjustable relative to their lower dies, in the same way as the upper dies in stands 511 to 515 described above, so as to allow for variations in web thickness during passage of the web through the dies.

This means that by adjusting plates 538 and 540 and plates 548 and 550 towards or away from one another, various different web formations can be made on the one machine with one set of dies, on webs of varying width. For example a U-section can be made by simply spreading plates 538 and 540 apart, and allowing the web to pass directly to die stands 516 to 522. Suitable adjustments will be made in the positioning of pinch rolls 564 and 566 so as to ensure that they grip the edges of the web for positive guidance.

Where it desired to form a C-section, then plates 538 and 540 (Group 2) are positioned a first distance apart so that their dies in stands 511 to 515 form the edge flange bends of the C-section. Plates 548 and 550 (Group 3) will be brought closer together than plates 538 and 540 so that their dies in stands 516 to 522 are located inside the edge flanges and form the bends at inside of the C-section. Plates 548 and 550 may be moved by any suitable transverse power movement mechanism (not shown) similar to mechanism 542, 546 and 550, (FIG. 34).

In addition all of the upper dies at stands 516 to 522 have clearance adjustment mechanisms similar to those described for stands 511 to 515, and shown in FIGS. 38, 39, 40 and 41. Accordingly these further adjustment mechanisms will not be described again since they are fully described above.

There is however one significant difference to be noted. Since plates 538,540 (Group 2) move towards or away from one another independently of plates 548, 550 (Group 3) and vice versa, it is necessary to provide for second control bars 670A, B (FIG. 33) on each side of the apparatus, for plates 548 and 550, which control bars are identical to bars 610A, B described above (FIGS. 38, 39 and 40). Control bars 670 extend along to tops of plates 548, 550 and are guided by guides and shoes (not shown) in the same fashion as bars 610A, B (FIG. 38). Control bars 670 have identical pins 608 extending therefrom which perform the same purpose of moving the adjustment mechanisms of the upper dies, as has been described above.

Figure 54:
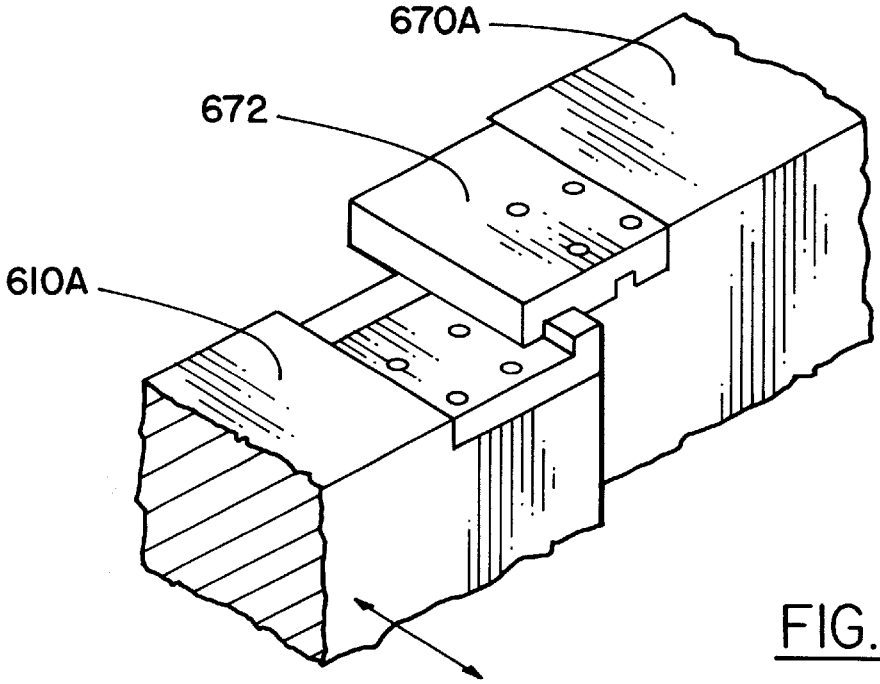

However, it is desirable that both bars 610 and bars 670 shall be moved simultaneously by the same power adjustment mechanism 618 described above. This will ensure that the same die clearance adjustment movement is made for all dies stands 511 to 522 simultaneously. In order to achieve this bars 610 and 670 are linked together by slidable links 672 (FIG. 54). The links enable one of bars 610 and 670 to move transversely relative to the other, by providing a transverse sliding connection between them (FIG. 54).

In order to provide support for the web where it extends between the die stands, a web support table 680 (FIG. 33) is provided which extends the entire length of the machine. Table 680 is vertically moveably mounted on power columns 682 by means of which it can be raised and lowered. Table 680 is formed with two upstanding plate portions 684–684, which are spaced apart from one another, but which are sufficiently close that they can be moved up and positioned between right and left hand sets of dies.

The upper edges of plate portions 684, are formed with semi circular recesses 686 which are located so as to fit around the dies shafts and hubs without interfering. Between the recesses 686 there are located a plurality of small web carrying rollers 688, which are free running. By raising the table to the appropriate height the rollers 688 can be brought into contact with the underside of the web where it extends between adjacent die stands, and will provide support for the web to prevent it from sagging or bending between the die stands.

Group 4

The fourth group of die s tan ds comprise the stands 523, 524, 525, and 526. The dies in this group function to force the corners of the web section into a rigid angle, usually although not invariably a right angle. It will be appreciated that where the section is a simple U-section (FIG. 52) this function may not be difficult to achieve.

Figure 42:
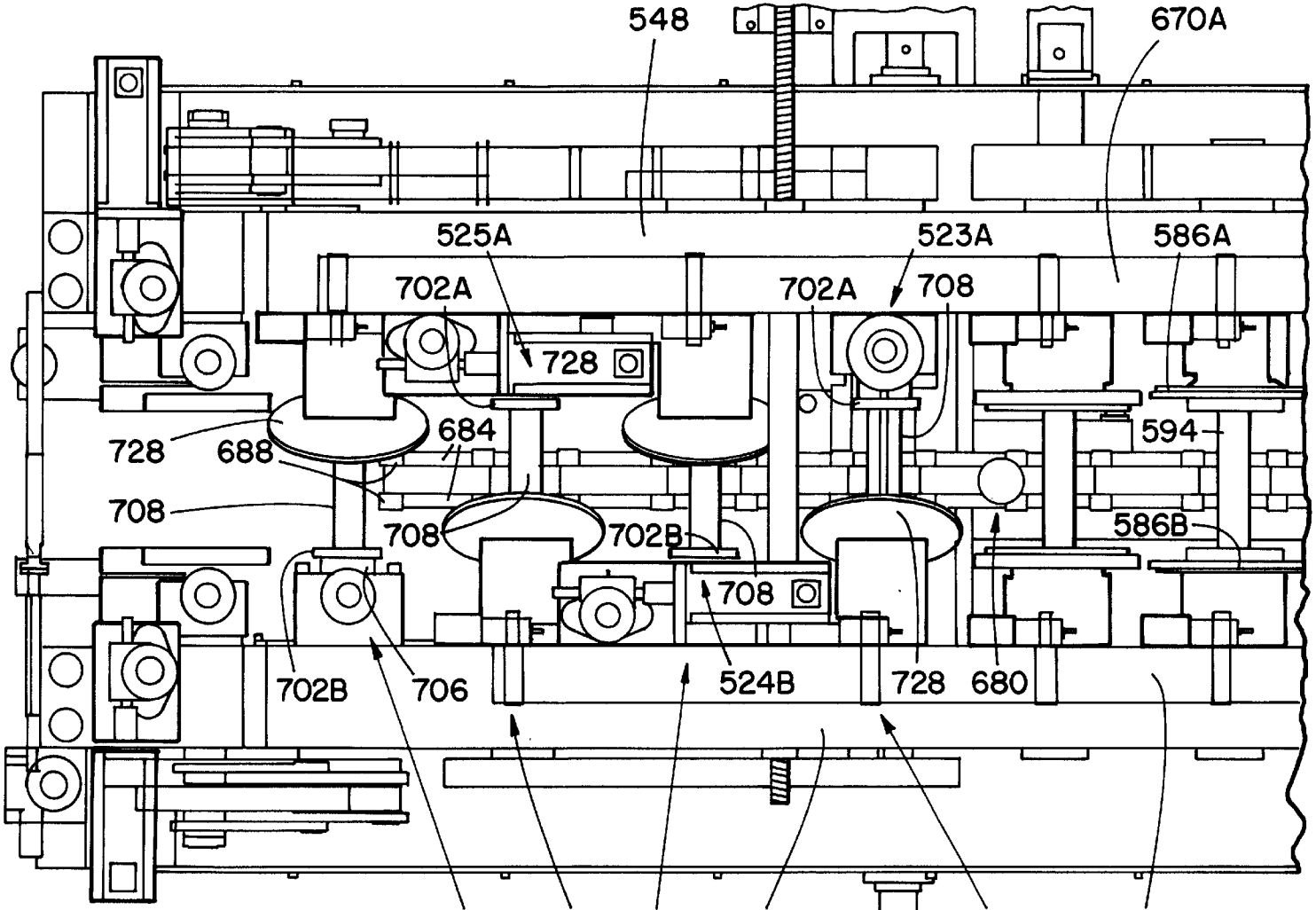
FIG. 42 is a top plan view partially cut away showing the diagonal corner forming upper dies of Group 4.

However where the section is a C-section (FIG. 53), then the final precision working of the inside corners, becomes more difficult. FIG. 42 illustrates four stands of corner forming roll s (described below) but without illustrating the web.

Figure 43:
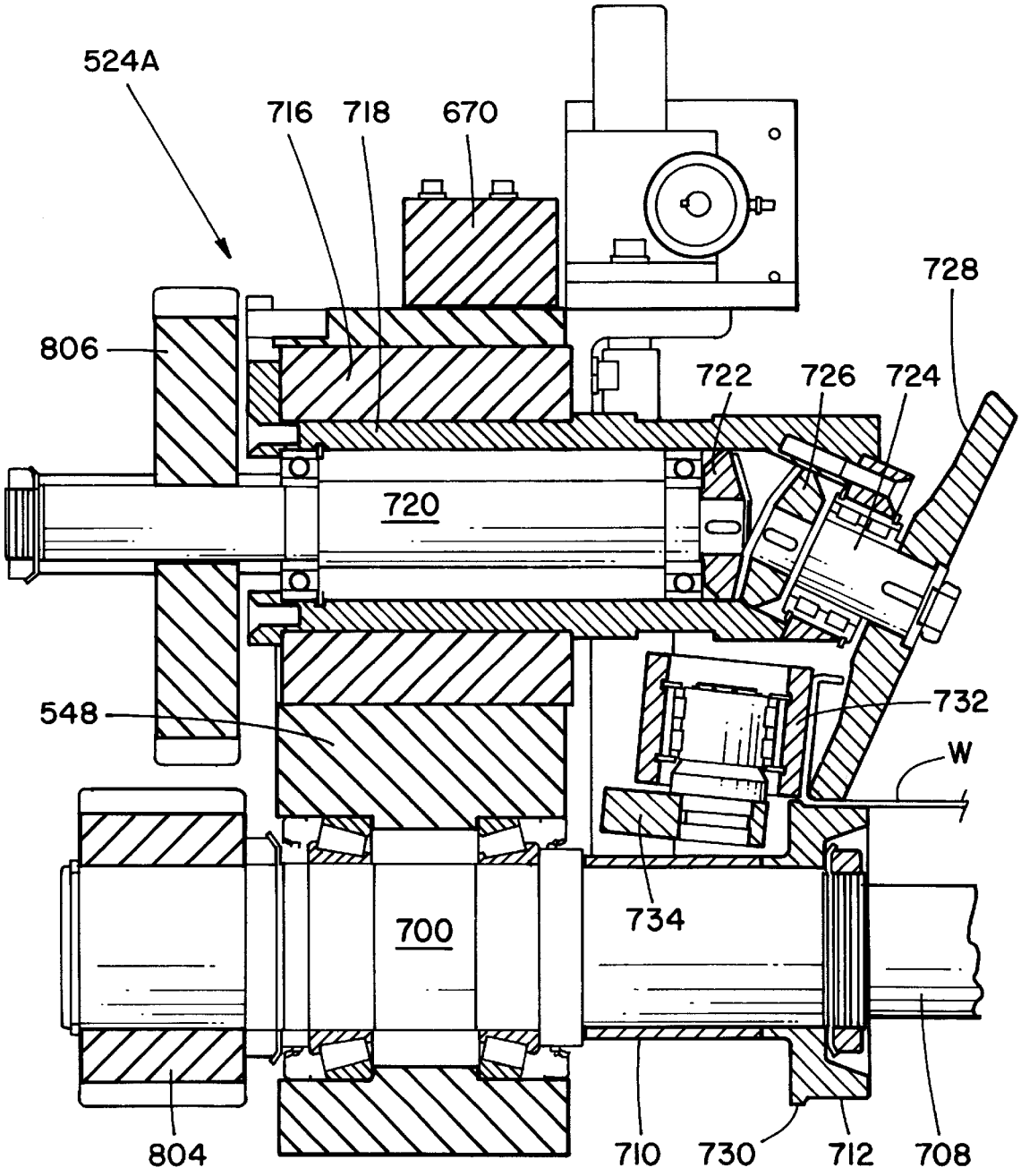
FIG. 43 is a section along line 42—42 of FIG. 41, of the upper diagonal corner forming dies.
Figure 44:
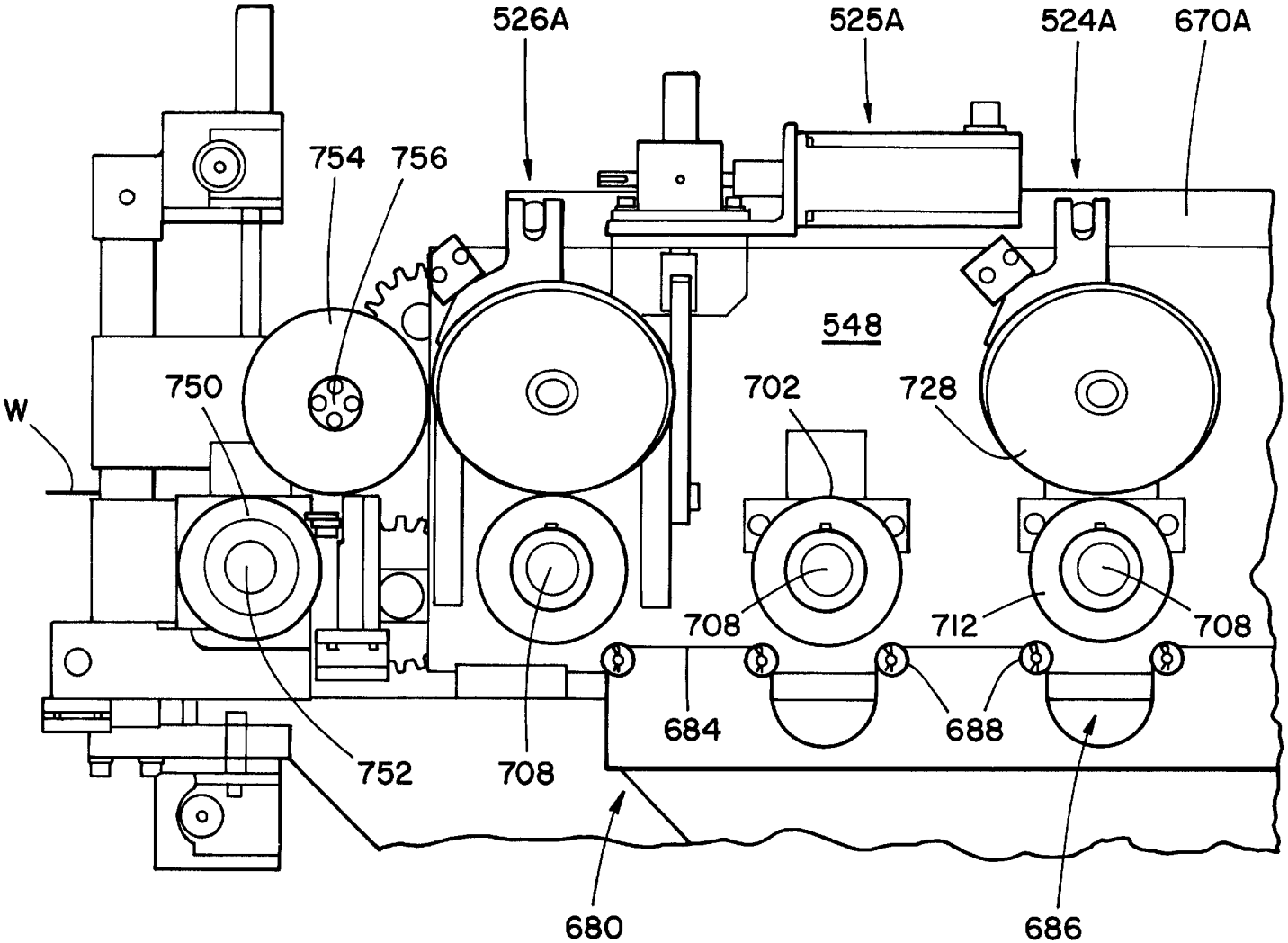
FIG. 44 is a side elevational view of the diagonal corner forming dies and the warp correcting mechanism and dies.
Figure 45:
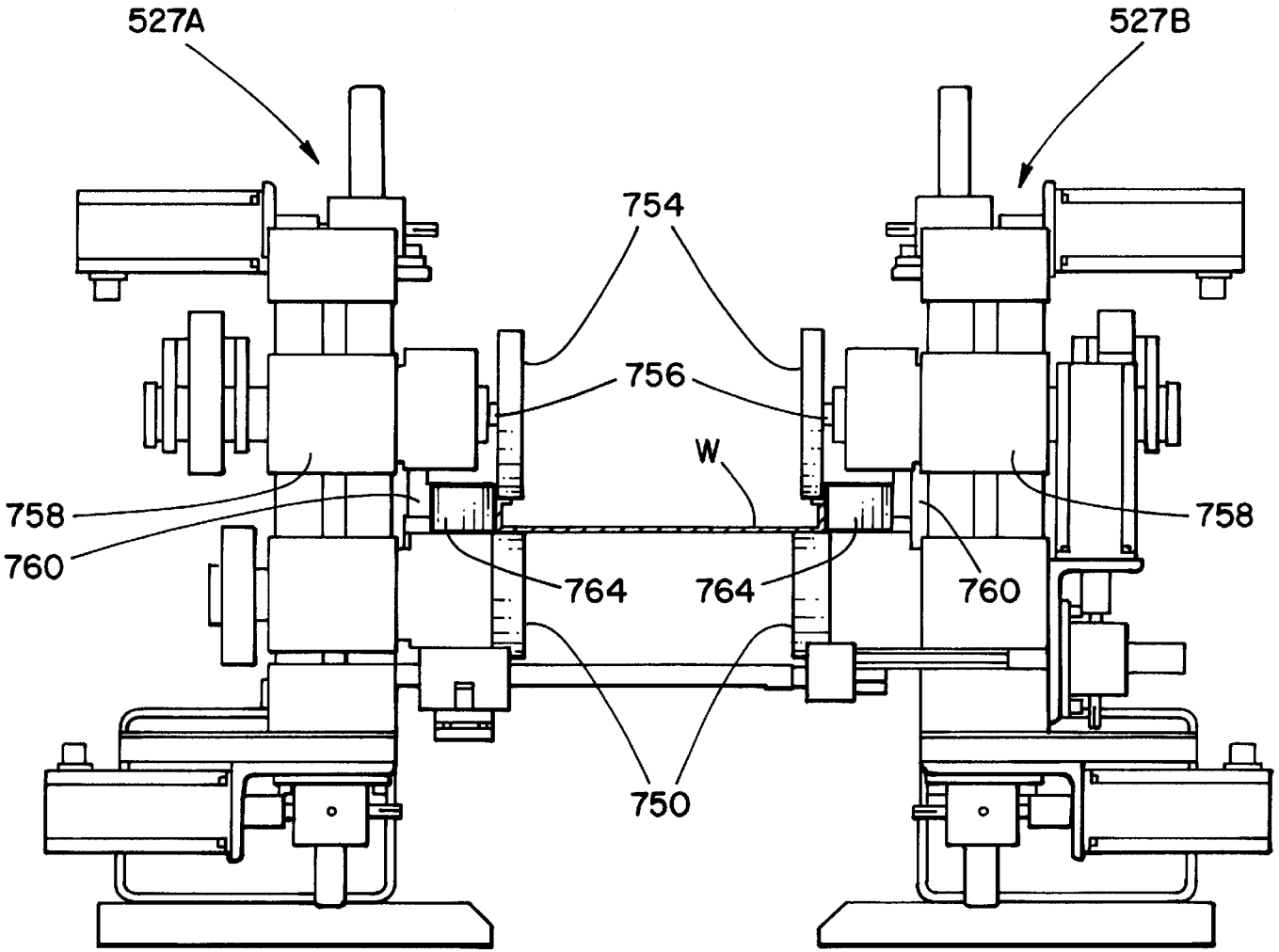
FIG. 45 is an end view of the warp correcting mechanism of the invention of Group 5, showing both sides of the machine.

FIG. 43 illustrates one of the corner forming rolls in section with a C section web shown in the process of being worked.

Each of stands 523 to 526 has a lower shaft 700 (FIGS. 43 and 44) which is mounted in suitable bearings directly in respective plates 548, 550. Suitable drive gears to be described below drive all of lower shafts 700. In stands 523A and 525A, on plate 548, there are lower dies 702A (FIG. 42) mounted on shafts 700, but no corresponding upper dies, on that side of the machine. On stands 524B and 526B, on plate 550, there are lower dies 702B mounted hubs 706, but no upper dies, on that side of the machine. Driven shafts 708 extend telescopically from shafts 700 and pass through hubs 706, so that the lower dies are driven in unison.

In stands 523B, 524A, 525B and 526A, there are hubs 710 carrying lower dies 712 (FIG. 43). Driven shafts 708 extend telescopically from shafts 700 across the machine through hubs 71 0 and thus the lower dies on both sides of each stand are driven in unison.

In stands 523B, 524A, 525B, and 526A there a re upper die sleeves 716 (FIG. 43) rotatably and slidably mounted in respective plates 548 and 550. Within the sleeves there are secured drive housings 718, located on axes which are eccentric to the centres of sleeves 716. Within housings 718 there are rotatable stub shafts 720 mounted in suitable bearings. On the inboard ends of shafts 720 there are crown gears 722. Angled die shafts 724 are carried in the inboard ends of housings 718. Gears 726 on shafts 724 mesh with gears 722. Angled corner forming upper dies 728 are mounted on shafts 724 and are oriented so that they can reach around the already formed edge flanges of a C section workpiece, and fit into the lower corner of the C section and firmly force it into the desired corner configuration.

Lower dies 712 are formed with an annular lip 730 (FIG. 43) to act as an abutment against which the upper angled die can press the corner of the workpiece (FIG. 43) and form the corner more securely. For additional hold free running edge rolls 732 are mounted on blocks 734. Rolls 732 engage the outer side surface of the C section or U section to ensure that the corner is formed correctly in the workpiece. The upper angled corner dies 728 are thus adjustable upwardly and downwardly by rotation of sleeves 716, in the same manner as are the upper dies on the die stands 511 to 522 described above. Control rod bars 670A, B (FIG. 42) are connected to sleeves 716 by mechanism similar to that already described for stands 511 to 522. The same mechanism also produces axial movement of sleeves in plates 548 and 550 in the same way.

Group 5

Die stands 527 form Group 5 (FIG. 44) and function to correct any tendency for the workpiece to warp as it leaves the dies .

For this purpose lower rolls 750 are secured on shafts 752 (FIGS. 44, 45, 46 and 47).

Rolls 750 are located so as to engage to underside of the workpiece and hold it secure. Lower shafts 752 are driven by gear means described below.

Figure 46:
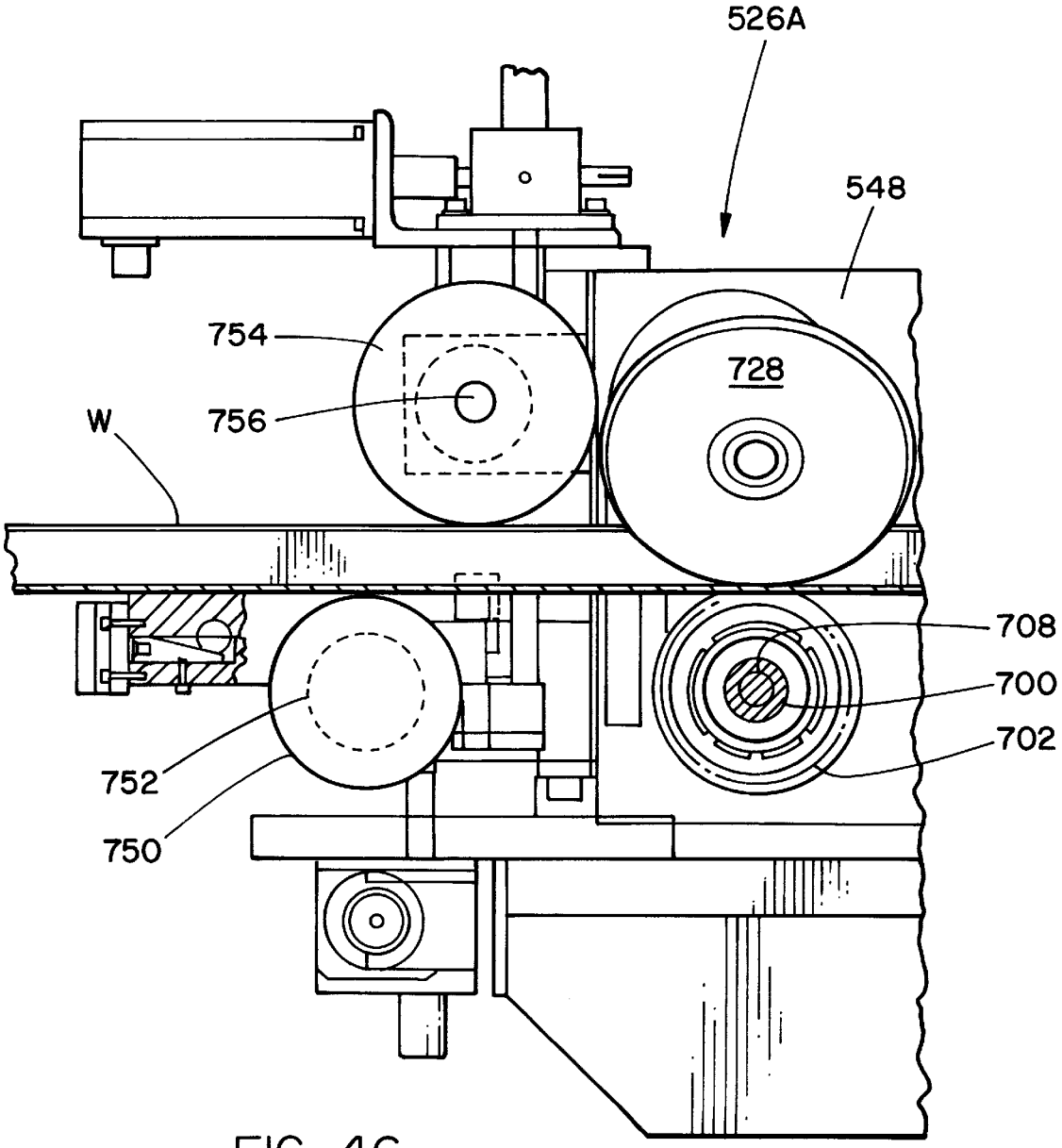
FIG. 46 is a side elevation of the warp correcting mechanism of Group 5.
Figure 47:
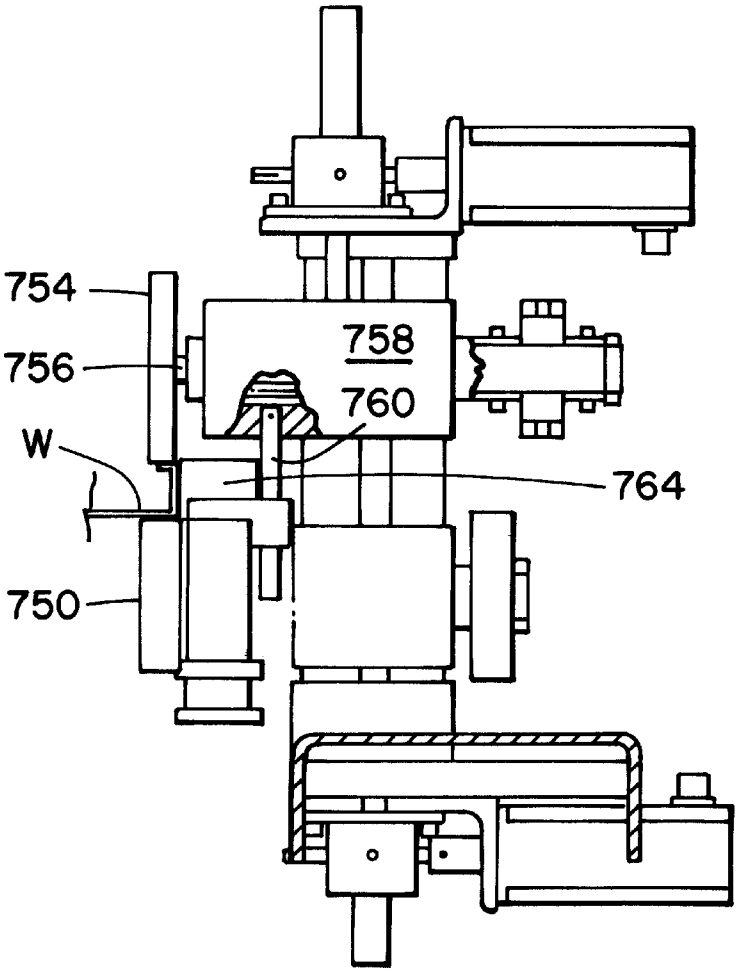
FIG. 47 is an end view of one side of the same mechanism as FIG. 44 showing the warp correcting mechanism forming a C section member.
Figure 48:
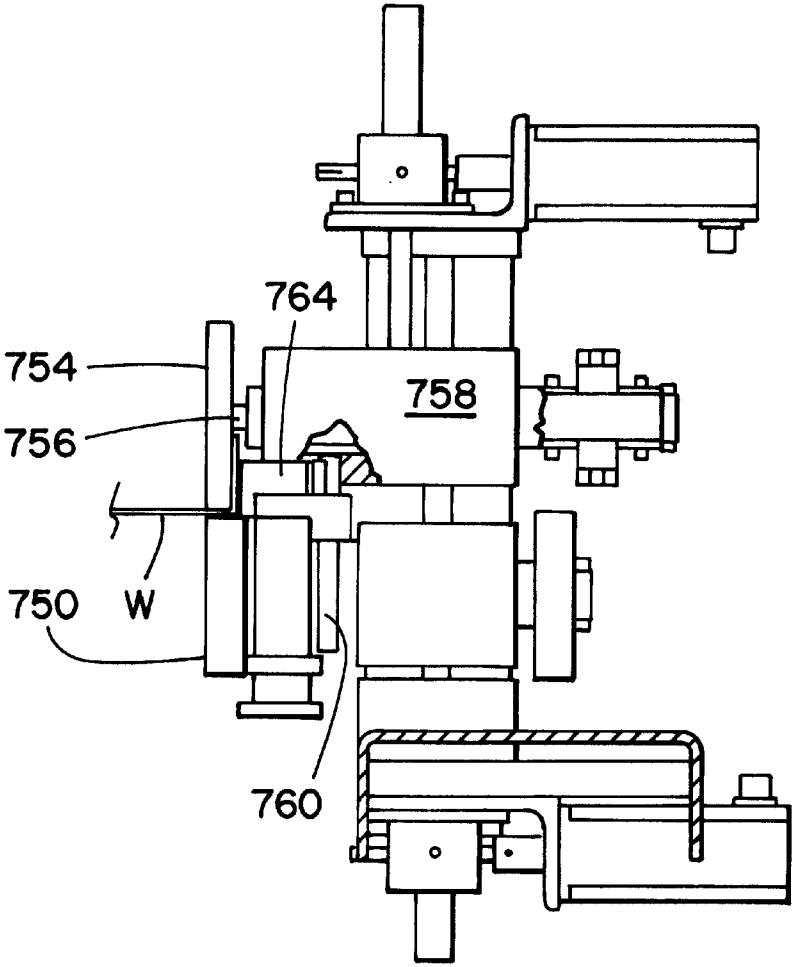
FIG. 48 is an end view of the warp correcting mechanism of the invention, forming a U section member.
Figure 49:
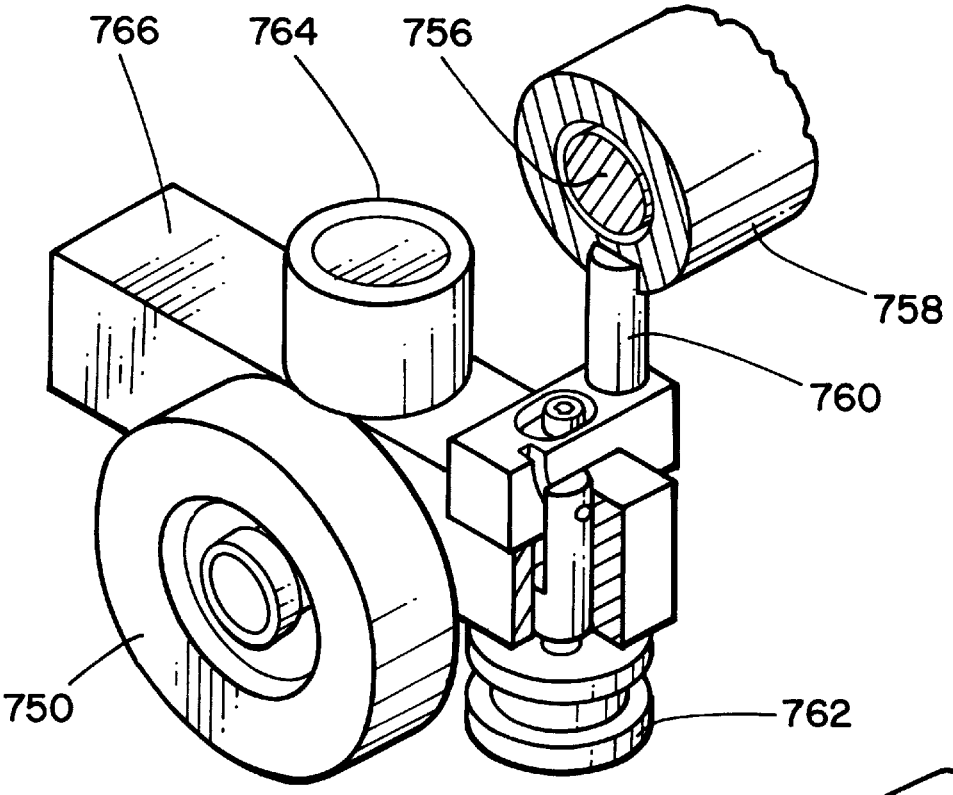
FIG. 49 is a cut away perspective view of a portion of the warp correcting mechanism, in one position.
Figure 50:
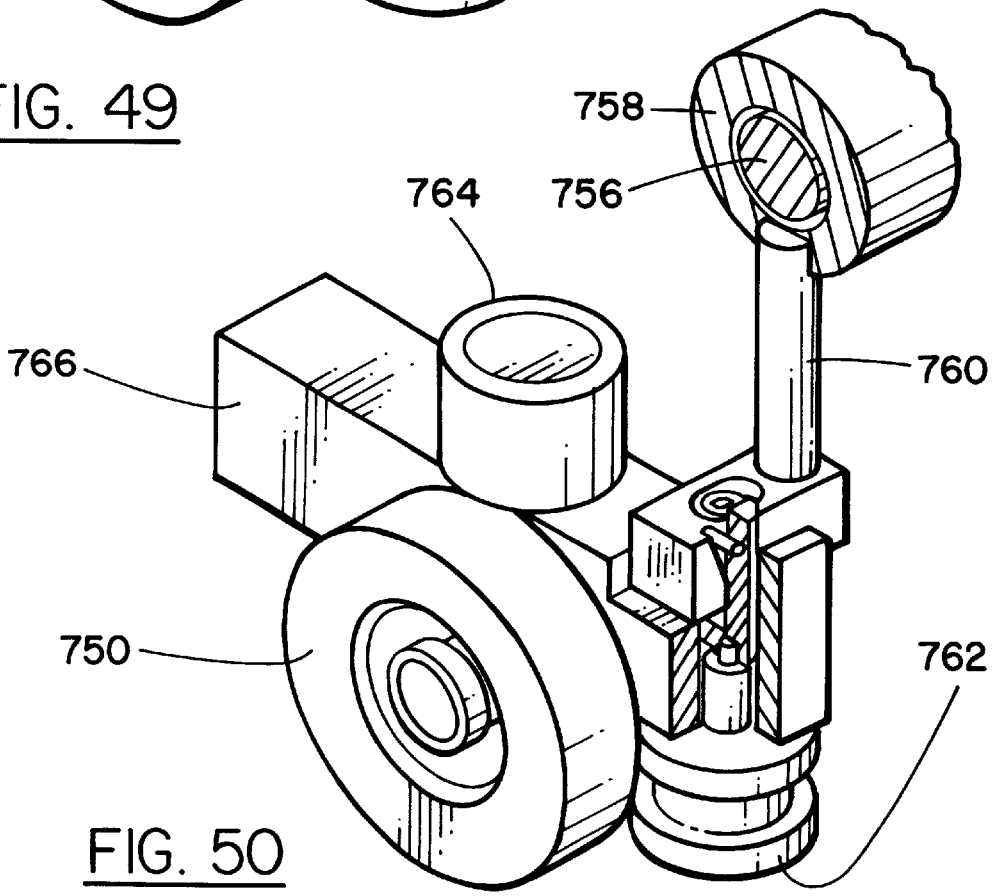
FIG. 50 is a cut away perspective corresponding to FIG. 48 showing the parts in another position.

Upper correcting rolls 754 are moveably mounted on shafts 756 carried in sleeves 758 (FIG. 46). Note that upper rolls 754 are offset relative to lower rolls 750.

Sleeves 758 may be moved up and down by rods 760 (FIGS. 49 and 50) and power means 762. This will cause upper rolls 754 to deflect or to release the edges of the web, and control warping.

For additional guidance side rolls 764 are mounted on blocks 766 (FIGS. 49 and 50) and rotate in contact with lower rolls 750 to correct sideways deflection of the web.

Drive Mechanism

The drive for the dies on stands 510 to 522 consists of relatively conventional gear drives 800 (FIG. 1) intermeshing with one another and driven by motor 802.

Figure 51:
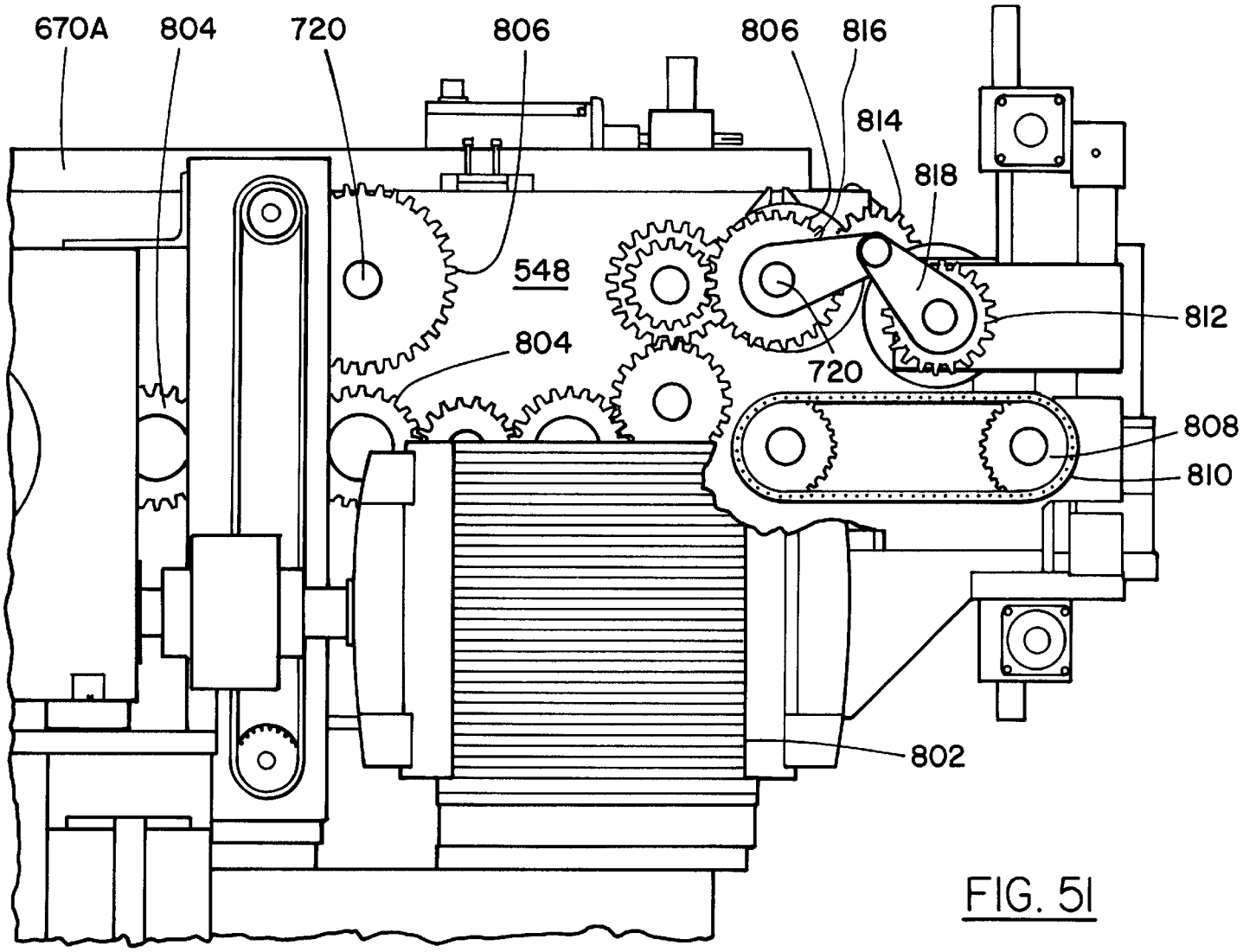
FIG. 51 is a side elevation of a portion of the drive mechanism for the stands of Groups 4 and 5.
Figure 52:
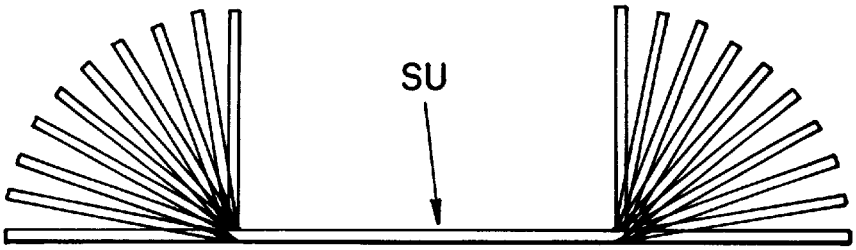
FIG. 52 is a schematic view showing the progressive bends involved in making a U section member.

The drive for the dies of stands 523 to 527 is more complex, and is shown in more detail in FIG. 51. The drive for the lower dies 702 and 712 is still relatively straightforward since all of the drive gears 804 are located on the outside of plate 548, in this embodiment. However the drive gears 806 for the upper dies 728A and B are located on the respective plates 548 and 550, since there are no cross shafts connecting the upper dies on one side with the upper dies on the other side of the machine. Gears 806 are driven by chain systems or the like (not shown), so that the dies rotate in unison.

The drives for the warp correcting rolls of stand 527 are also located on both sides of the machine since there are no cross shafts on this stand. Lower shafts 752 are driven by gears 808 and chains 810 (FIG. 51). The upper dies which can be adjusted upwardly and downwardly to accommodate the U section, or the C section, are driven by gears 812 connected through idler gears 814 to gears 816. Idler gears 814 are mounted on two swingable arms 818 so as to permit upward and downward movement of gears 812.

It will be appreciated that this explanation is not detailed in every respect since such drive systems are known in the art and various different drives could be adapted to perform the functions required.

Web Sensing

Referring to FIG. 31 it will be seen that a web thickness sensing unit 830 is provided at the upstream end U of the roll forming apparatus. The thickness sensing unit may typically comprise a pair of rolls, and a signal generator (not shown) connected to a computer control centre (not shown), The sensing unit 830 operates to sense the thickness of the web and to cause the computer control to send adjustment signals for adjusting the die clearances in the manner described above.

In addition to providing for sensing the thickness of the web provision is made through means such as optical sensors (not shown) to sense any warping of the section and to send signals to the computer control. This will in turn send signals for adjusting upper rolls 754 and side rolls 764 so as to correct any tendency of the section to warp.

The method of roll forming is self evident from the foregoing.

The foregoing is a description of a preferred embodiment of the invention which is given here by way of example only. The invention is not to be taken as limited to any of the specific features as described but comprehends all such variations thereof as come within the scope of the appended claims.

What is claimed is:

1. A roller die apparatus for supporting pairs of roller dies in predetermined clearances for processing a web workpiece, at least some of said pairs being adjustable for varying said clearances between said roller dies to accommodate variations in the thickness of a web workpiece passing there between, said apparatus comprising, first and second roller dies in each of said adjustable pairs of roller dies being rotatably mounted on respective roller stands, said roller dies having at least two forming surfaces lying in planes different from one another, wherein at least some of said first and second roller dies are movable relative to the other of said first and second roller dies, for adjusting the clearances between said first and second roller dies;

movable die bearing means for one of said first and second roller dies;

movement means for moving said movable die bearing means both axially and transversely relative to its axis of rotation, and, control means for causing both axial and transverse movements simultaneously, thereby moving said one of said first and second roller dies along an axis diagonal to said axis of rotation during operation of said roller die apparatus, thereby achieving adjusting of the die clearance between said first and second roller dies in two phases simultaneously.

2. A roller die apparatus as claimed in claim 1 wherein one of said first and second roller dies is fixed in each of said adjustable pairs, and the other said die in each of said adjustable pairs is moveable by adjustment means moving said moveable die along said diagonal axis, all of the adjustment movement means being connected together for movement by a common adjustment control.

3. A roller die apparatus as claimed in claim 2 and wherein said moveable die bearing means comprise eccentric rotatable bearing means, said eccentric bearing means being both rotatable and axially slidable for causing both axial and transverse movements of said ones of said first and second dies simultaneously, as aforesaid.

4. A roller die apparatus as claimed in claim 3 and including power operated means for operating said movement means.

5. A roller die apparatus as claimed in claim 4 wherein said apparatus defines leading and trailing ends and including a thickness sensor for sensing the thickness of said web material workpiece and generating a thickness signal in response thereto, said signal causing movement of said movement means, whereby to procure simultaneous movement of said moveable bearing means along both axes in response to said thickness signal.

6. A roller die apparatus is claimed in claim 5 wherein said die pairs are arranged in groups of two pairs, each pair comprising upper and lower dies adapted to engage a said web workpiece at spaced apart locations, and wherein upper dies of said pairs of dies are moveable, and lower dies of said pairs are fixed, and including first single movement control means connecting all of said moveable upper dies on one side of said web, and second single movement control means connecting all of said moveable dies on a second side of said web, and transmission means connecting said first and second single movement control means, and being responsive to said thickness signal, whereby to procure movement of said first and said second single movement control means simultaneously.

7. A roller die apparatus is claimed in claim 6 wherein said each of said first and second single movement control means are coupled to each of said moveable dies whereby to procure both axial movement and transverse movement, upon movement of said movement control means.

8. A roller die apparatus as claimed in claim 1 and wherein said roller die apparatus defines a leading end and a trailing end, for entry and exit of said web, and including leading end web edge guide rolls, engaging side edges of said web as the same enters said leading end, and controlling the axial alignment of said web.

9. A roller die apparatus as claimed in claim 8 and including leading edge pinch rolls, engaging upper and lower surfaces of said web along said edges as the same enters said leading end of said apparatus.

10. A roller die apparatus as claimed in claim 9 wherein said pinch rolls and said edge guide rolls are moveable towards and away from one another to accommodate webs of varying widths.

11. A roller die apparatus as claimed in claim 1 and including right and left edge formation control die assemblies for controlling edge formations formed on said workpiece and means for moving said edge control assemblies relative to one another, to maintain said edge formations within predetermined limits.

12. A roller die apparatus as claimed in claim 1 and including straightening rolls adapted to engage the workpiece after exiting from the roller dies to correct warping of the workpiece.

13. A roller die apparatus as claimed in claim 12 wherein said straightening rolls include, lower fixed rolls and upper moveable rolls, moveable relative to said fixed rolls and said upper and lower rolls being out of registration with one another, and means for supporting said upper rolls.

14. A roller die apparatus as claimed in claim 13 and wherein said support means are for movement upwardly or downwardly, and including power operated movement means for moving said support means upwardly and downwardly.

15. A roller die apparatus as claimed in claim 14 and including movement means for moving one of said upper and lower dies relative to the other, whereby to accommodate workpieces of varying height.

16. A roll forming apparatus as claimed in claim 1 for progressively forming a workpiece having edge flanges and for subsequently forming side flanges between said edge flanges of said workpiece and the apparatus and including side control rolls engageable with the sides of said side flanges and controlling the angle thereof.

17. A roll forming apparatus as claimed in claim 16 and including mounting blocks for mounting said side control rolls, and means movably supporting said mounting blocks whereby the same may be tilted between two positions.

18. A roll forming apparatus as claimed in claim 17 including support means moveable in a vertical plane to adjust the location of said angled upper rolls upwardly and downwardly.

19. A roll forming apparatus as claimed in claim 18 wherein said side support means is moveable in a horizontal plane to adjust the location of said angled upper rolls inwardly and outwardly.

20. A method of continuously roll forming a web work piece in a roller die apparatus for supporting pairs of roller dies in predetermined clearances for processing a web workpiece, and for varying said clearances between said roller dies to accommodate variations in the thickness of a web workpiece passing there between, and having first and second forming planes lying in first and second forming planes, said apparatus having first and second roller dies rotatably mounted on rotation axes on respective roller die stands, means for moving one of said first and second roller dies upwardly and downwardly transversely to its axis of rotation and means for moving one of said first and second roller dies axially along its axis of rotation, simultaneously with said upward and downward movement thereby achieving adjusting of the die clearance between said first and second roller dies in two planes; and including the steps of;

continuously sensing the thickness of said web, and, adjusting the location of said moveable dies relative to said fixed dies along diagonal axes of movement, whereby to accommodate the variations in thickness of said web.

21. The method as claimed in claim 20 and including a thickness sensor for sensing the thickness of said web material workpiece, and including the step of generating a thickness signal in response thereto, and signal responsive means for generating movement signals, and moving said die in response thereto in response to said thickness signal.

22. The method as claimed in claim 20 and including right and left edge forming roller die assemblies for forming edge formations on said web and moving said edge forming assemblies relative to one another to compensate for variations in thickness of said web.

23. The method as claimed in claim 22 and including straightening rolls adapted to engage the workpiece after exiting from the roller dies, and engaging said workpiece and correcting warping of the workpiece.

24. The method as claimed in claim 21 and including die stands, web support means located beneath said die stands, and movement means for moving said support means, upwardly and downwardly, and free running rolls supported on said support means and including the step of moving said support means moved upwardly between adjacent said drive shafts to support said web between adjacent die stands.

25. The method as claimed in claim 24 and including, fixed lower die means engaging an underside of said workpiece at a predetermined pass line level for said workpiece, leading correcting die means and trailing correcting die means;

and including the step of causing either said leading correcting die or said trailing correcting die to engage an upper portion of said workpiece, said leading and trailing dies being located spaced apart from one another on opposite sides of said lower die, thereby causing either downward bending of said workpiece or upward bending of said workpiece, to correct warping and straighten said workpiece.

26. The method as claimed in claim 21 and including, side flange corner forming upper dies, angled shafts on which said corner forming dies are mounted, whereby said corner forming dies are adapted to fit around said flanges of said workpiece and enter into the side flange corners and, side flange control rolls, cooperating with said corner forming dies.

27. The method as claimed in claim 26 and including moving said corner dies in a vertical plane to adjust the location of said corner dies upwardly and downwardly, and moving said corner dies in a horizontal plane to adjust the location of said corner dies inwardly and outwardly.

* * * * *